US011019872B2

(12) United States Patent
Calilung et al.

(10) Patent No.: US 11,019,872 B2
(45) Date of Patent: Jun. 1, 2021

(54) SPORTS HELMET HAVING MODULAR COMPONENTS

(71) Applicant: Oakley, Inc., Foothill Ranch, CA (US)

(72) Inventors: Ryan Anthony Calilung, Irvine, CA (US); Brian Andrew Lewis-Clark, Costa Mesa, CA (US); Neil Wylie Ferrier, Foothill Ranch, CA (US); Chad Michael McKonly, San Clemente, CA (US); Benjamin John Meunier, San Clemenete, CA (US); Ryan Neil Saylor, Mission Viejo, CA (US); Eric Yoshinari, Laguna Niguel, CA (US)

(73) Assignee: Oakley, Inc., Foothill Ranch, CA (US)

( * ) Notice: Subject to any disclaimer, the term of this patent is extended or adjusted under 35 U.S.C. 154(b) by 0 days.

(21) Appl. No.: 15/555,025

(22) PCT Filed: Jun. 17, 2016

(86) PCT No.: PCT/US2016/038250
§ 371 (c)(1),
(2) Date: Aug. 31, 2017

(87) PCT Pub. No.: WO2016/205757
PCT Pub. Date: Dec. 22, 2016

(65) Prior Publication Data

US 2018/0303190 A1 Oct. 25, 2018

Related U.S. Application Data

(60) Provisional application No. 62/182,332, filed on Jun. 19, 2015.

(51) Int. Cl.

| | |
|---|---|
| ***A42B 3/18*** | (2006.01) |
| ***A42B 3/22*** | (2006.01) |
| ***A42B 3/28*** | (2006.01) |

(52) U.S. Cl.
CPC ..... *A42B 3/185* (2013.01); *A42B 3/221* (2013.01); *A42B 3/227* (2013.01); *A42B 3/28* (2013.01)

(58) Field of Classification Search
CPC ..... A42B 3/185; A42B 3/227; A42B 3/042; A42B 3/18; A42B 3/221; A42B 3/228
See application file for complete search history.

(56) References Cited

U.S. PATENT DOCUMENTS

| | | | |
|---|---|---|---|
| 2,616,081 | A | 11/1952 | Weaver et al. |
| 2,935,985 | A | 5/1960 | Andrews et al. |

(Continued)

FOREIGN PATENT DOCUMENTS

| | | | |
|---|---|---|---|
| CN | 1833563 | A | 9/2006 |
| DE | 78 28 336 | U1 | 3/1984 |

(Continued)

OTHER PUBLICATIONS bellhelmets.com, Bell Bicycling and Motorcycle Helmets, available at: https://www.bellhelmets.com/mips.

(Continued)

*Primary Examiner* — Megan E Lynch
(74) *Attorney, Agent, or Firm* — Sterne, Kessler, Goldstein & Fox P.L.L.C.

(57) ABSTRACT

Disclosed herein are sports helmets having modular components. A modular component includes an eyewear adapter that is releasably attachable to the helmet and configured to interface with corresponding eyewear in an orientation that permits a wearer of the helmet to see through the eyewear. The eyewear adapter is configured such that, in use, the eyewear adapter enhances the fit or function of the eyewear relative to the use of the helmet and the eyewear without the eyewear adapter. A modular component includes electronics modules that can be mechanically and electrically coupled to (Continued)

the helmet. A modular component includes other functional modules that affect the aerodynamics of the helmet, the air flow of the helmet, the fit of the helmet, or the look of the helmet.

28 Claims, 50 Drawing Sheets

(56) References Cited

U.S. PATENT DOCUMENTS 3,430,261 A 3/1969 Benner
3,548,411 A * 12/1970 Barstow ..... A42B 3/042 2/6.5
3,774,239 A * 11/1973 Kotzar ..... A42B 3/221 2/10
3,873,998 A 4/1975 Norris et al.
3,984,875 A 10/1976 Farquaharson
4,638,512 A 1/1987 Frankel
4,916,759 A 4/1990 Arai
5,005,926 A 4/1991 Spielberger
5,093,937 A * 3/1992 Kamata ..... A42B 3/283 2/171.3
5,190,802 A 3/1993 Pilato
5,263,204 A 11/1993 Butsch
5,329,641 A 7/1994 Kalhous
5,448,780 A 9/1995 Gath
5,603,117 A 2/1997 Hudner
5,621,923 A 4/1997 Tapocik
5,636,388 A 6/1997 Hodges
5,752,298 A 5/1998 Howell
6,012,164 A 1/2000 Deal, III
6,237,161 B1 5/2001 Lee
6,247,811 B1 6/2001 Rhoades et al.
6,281,149 B1 8/2001 Hussein
6,353,936 B2 3/2002 Flatt
6,481,024 B1 11/2002 Grant
6,490,729 B1 12/2002 Dondero
6,786,786 B1 9/2004 Davis
6,892,393 B1 * 5/2005 Provost ..... A42B 3/185 2/10
6,923,537 B2 8/2005 Hartley
7,069,601 B1 7/2006 Jacobsen
7,308,721 B1 12/2007 Rivera, Jr.
7,398,559 B2 7/2008 Flatt
7,546,645 B2 * 6/2009 Goodhand ..... A42B 3/22 2/15
7,698,750 B2 4/2010 Bullock
7,954,204 B2 6/2011 Hammerslag et al.
2003/0070200 A1 * 4/2003 Crye ..... A42B 3/08 2/6.6
2004/0003452 A1 1/2004 Schiebl
2005/0183190 A1 * 8/2005 Hussey ..... A42B 3/185 2/424
2005/0204446 A1 9/2005 Wright
2006/0288468 A1 12/2006 Jorgenson
2007/0022520 A1 * 2/2007 Grassl ..... A62B 18/084 2/424
2007/0050895 A1 3/2007 Broersma
2007/0083967 A1 * 4/2007 Crossman ..... A42B 3/044 2/15
2007/0186324 A1 8/2007 Sheldon
2008/0127400 A1 * 6/2008 Dupuis ..... A42B 3/105 2/424
2008/0289085 A1 11/2008 Bryant
2009/0013439 A1 * 1/2009 Thoman ..... A42B 3/185 2/10
2009/0044316 A1 * 2/2009 Udelhofen ..... A42B 3/20 2/424
2009/0229043 A1 * 9/2009 Cyr ..... A42B 3/22 2/422
2010/0064405 A1 * 3/2010 McGovern ..... A42B 3/225 2/6.7
2010/0154093 A1 * 6/2010 Provost ..... A42B 3/185 2/10
2011/0061152 A1 3/2011 Wismann
2012/0047765 A1 * 3/2012 Kolesar ..... A42B 3/185 34/442
2012/0054936 A1 * 3/2012 Cornell ..... A42B 3/227 2/9
2012/0180203 A1 * 7/2012 Giroux ..... A42B 3/185 2/422
2013/0042397 A1 2/2013 Halldin
2013/0227768 A1 * 9/2013 Van Waes ..... A42B 3/185 2/422
2013/0298318 A1 * 11/2013 Rogers ..... A42B 3/185 2/439
2013/0318673 A1 12/2013 Huh
2014/0033406 A1 * 2/2014 Lebel ..... A42B 3/04 2/422
2014/0143937 A1 * 5/2014 Cram ..... A42B 3/32 2/410
2014/0173811 A1 * 6/2014 Finiel ..... A42B 3/185 2/422
2014/0259319 A1 9/2014 Ross et al.
2014/0317835 A1 10/2014 Mejia, Jr.
2015/0026858 A1 1/2015 Ross et al.
2015/0033457 A1 2/2015 Tryner
2015/0245682 A1 * 9/2015 McGinn ..... A42B 3/221 2/422
2016/0029734 A1 2/2016 Kurpjuweit

FOREIGN PATENT DOCUMENTS

DE 10240744 B3 4/2004
DE 10 2004 005757 A1 8/2005
FR 1.527.271 A 5/1968
FR 2864753 7/2005
WO WO 2001/091679 12/2001
WO WO 2006/093868 9/2006
WO WO 2016/205757 12/2016

OTHER PUBLICATIONS http://ecx.images-amazon.com/images/I/51hHAUvwykL.jpg (retrieved online Jun. 3, 2010).
International Search Report in co-pending Application No. PCT/US2016/038250, dated Oct. 10, 2016, in 5 pages.
kickstarter.com, Link Pro—Explore1 Ski & Snowboard Communication Helmet, available at: https://www.kickstarter.com/projects/1884657220/linkpro-explore1tm-the-ultimate-sports-communicati?rei=category, appears to have been available as early as Jan. 18, 2016.
lazersports.com, Lotto Soudal Chooses Lazer Magneto + Z1, available at: http://www.lazersport.com/news/lotto-soudal-chooses-lazer-magneto-z1.
pocsports.com, Receptor BUG Communication Archive, available at: https://www.pocsports.com/us/products/receptor-bug-communication-archive/10251.html.
Wayback Machine (poctsports.com), Octal, available at: https://web.archive.org/web/20160213071343/http://www.pocsports.com/en/product/2193/octal, archived Feb. 13, 2016.
WorthSports.com, "Face First", available at: http://worthsports.com/fastpitch/protective/face-first (retrieved online Jun. 3, 2010).
Supplementary European Search Report in related EPO Application No. 16812589.6, dated Feb. 14, 2019; 8 pages.
German to EnglishTranslation of Summarizing Paragraphs from German Patent No. DE 78 28 336 U1; 1 page.
French to EnglishTranslation of Summarizing Paragraphs from French Patent No. FR 1.527.271 A; 1 page.

* cited by examiner

SPORTS HELMET HAVING MODULAR COMPONENTS

CROSS-REFERENCE TO RELATED APPLICATIONS

This application is a national stage application under 35 U.S.C. § 371 of PCT Application No. PCT/US2016/038250, filed on Jun. 17, 2016, which published in English as WO 2016/205757 on Dec. 22, 2016, and which claims priority to U.S. Prov. Pat. App'n No. 62/182,332, entitled "MODULAR SPORTS HELMET," filed Jun. 19, 2015, the entire contents of which is incorporated by reference herein for all purposes.

BACKGROUND

Field

The disclosure relates generally to protective sports helmets, and more particularly to protective sports helmets having attachable modular components that can add or modify aesthetic and functional aspects of the helmet.

Description of Related Art

A physical impact to the head of a person may cause serious injury or death. To reduce the probability of such consequences, protective gear, such as a helmet, is often used in activities that are associated with an increased level of risk for a head injury. In particular, there are a wide range of non-motorized sports and activities that require or benefit from the use of a helmet. Examples of such activities include, but are not limited to, cycling, mountain biking, skiing, snowboarding, sledding, ice skating, rollerblading, rock climbing, skate boarding, surfing, skydiving, football, baseball, lacrosse, hockey, and kayaking In general, a helmet is designed to absorb and/or distribute the force of an impact to reduce ill effects on the head of a wearer.

SUMMARY

Example embodiments described herein have several features, no single one of which is indispensable or solely responsible for their desirable attributes. Without limiting the scope of the claims, some of the advantageous features will now be summarized.

In a first aspect, an eyewear adapter is provided that includes a brim that is releasably attachable to a helmet and configured to interface with corresponding eyewear in an orientation that permits a wearer of the helmet to see through the eyewear, wherein the eyewear adapter is configured such that, in use, the eyewear adapter enhances the fit or function of the eyewear to provide, in the combination of the helmet and eyewear, one or any combination of more than one functional advantage selected from the group consisting of improved air flow across or through portions of the helmet and eyewear; improved aerodynamics of the helmet; improved sweat control; and improved fit; wherein the one or more than one functional advantage comprises an improvement compared to the use of the helmet and the eyewear without the eyewear adapter.

In some embodiments of the first aspect, the brim releasably attaches to a base portion of the helmet, the base portion comprising a shell and an inner layer coupled to the shell, the base portion configured to absorb or distribute force from an impact. In some embodiments of the first aspect, the eyewear adapter is further configured to releasably attach to the eyewear. In some embodiments of the first aspect, the eyewear adapter is further configured to be adjustable to position the eyewear adapter relative to the helmet and the eyewear to account for anatomical variations between different wearers. In some embodiments of the first aspect, the eyewear comprises goggles. In some embodiments of the first aspect, the brim comprises a first portion comprising a rigid material and a second portion attached to the first portion, the second portion comprising a flexible material, wherein, in use, the second portion of the brim is adjacent to a top portion of the eyewear. In some embodiments of the first aspect, the brim is configured to direct air downward toward an inner surface of the eyewear. In some embodiments of the first aspect, the brim is configured to extend outward beyond an outer surface of the eyewear. In some embodiments of the first aspect, the brim is configured to cover one or more openings on a front portion of the helmet.

In some embodiments of the first aspect, the eyewear adapter is configured to attach the helmet to the eyewear, the brim configured to attach to the corresponding eyewear in an orientation that permits a wearer of the helmet to see through the eyewear. In some embodiments of the first aspect, the one or any combination of more than one functional advantage consists additionally of improved securing of the eyewear to or on or in the helmet. In some embodiments of the first aspect, the brim releasably attaches to a base portion of the helmet, the base portion comprising a shell and an inner layer coupled to the shell, the base portion configured to absorb or distribute force from an impact. In some embodiments of the first aspect, the eyewear adapter is further configured to be adjustable to position the eyewear relative to the helmet to account for anatomical variations between different wearers. In some embodiments of the first aspect, the eyewear comprises goggles. In some embodiments of the first aspect, the brim comprises a first portion comprising a rigid material and a second portion attached to the first portion, the second portion comprising a flexible material, wherein, in use, the second portion of the brim is adjacent to a top portion of the eyewear. In some embodiments of the first aspect, the brim is configured to direct air downward toward an inner surface of the eyewear. In some embodiments of the first aspect, the brim is configured to extend outward beyond an outer surface of the eyewear. In some embodiments of the first aspect, the brim is configured to cover one or more openings on a front portion of the helmet. In some embodiments of the first aspect, the eyewear adapter is secured to the helmet to allow the eyewear adapter to be adjusted by sliding the eyewear adapter relative to the base portion.

In some embodiments of the first aspect, the eyewear adapter is in contact with the corresponding eyewear along the contour of the eyewear adapter. In some embodiments of the first aspect, the eyewear adapter includes additional venting ports configured to provide, in use, venting between the corresponding eyewear and the base portion.

In a second aspect, a modular helmet system is provided that includes a base portion configured to absorb or distribute force from an impact, the base portion comprising a shell and an inner layer coupled to the shell, an eyewear adapter comprising a contour that substantially matches a contour of corresponding eyewear, wherein the eyewear adapter is configured to be secured to the base portion of the helmet system such that, in use, the contour of the eyewear adapter forms a gap of less than or equal to about 0.5 inches from a top portion of the corresponding eyewear.

In some embodiments of the second aspect, the eyewear adapter is configured to be vertically adjusted relative to the base portion. In some embodiments of the second aspect, the eyewear adapter is secured to the base portion of the modular helmet system to allow the eyewear adapter to rotate about a pivot point. In some embodiments of the second aspect, the eyewear adapter is secured to the base portion of the modular helmet system to allow the eyewear adapter to be adjusted by sliding the eyewear adapter relative to the base portion. In some embodiments of the second aspect, the eyewear adapter comprising a forward biasing element configured to apply a force away from the base portion toward the corresponding eyewear. In some embodiments of the second aspect, the eyewear adapter comprising a rearward biasing element configured to apply a force toward the base portion away from the corresponding eyewear. In some embodiments of the second aspect, a range of motion of the eyewear adapter is configured to be limited so that, in use, the eyewear adapter does not cross a line of sight of a wearer. In some embodiments of the second aspect, the eyewear adapter is a non-optical component. In some embodiments of the second aspect, the eyewear adapter is opaque. In some embodiments of the second aspect, the eyewear adapter is in contact with the corresponding eyewear along the contour of the eyewear adapter. In some embodiments of the second aspect, the eyewear adapter includes additional venting ports configured to provide, in use, venting between the corresponding eyewear and the base portion. In some embodiments of the second aspect, the eyewear adapter includes a mount for a camera. In some embodiments of the second aspect, the eyewear adapter is configured to be secured to the base portion of the modular helmet system such that, in use, the eyewear adapter and the corresponding eyewear form a substantially smooth profile. In some embodiments of the second aspect, a curvature of the eyewear adapter is within a tolerance of a curvature of the base portion. In a further embodiment, a curvature of the eyewear adapter is within a tolerance of a curvature of the corresponding eyewear. In some embodiments of the second aspect, the eyewear adapter is configured to automatically adjust its position in use to maintain the contour of the eyewear adapter less than about 0.5 inches from the top portion of the corresponding eyewear. In some embodiments of the second aspect, the eyewear adapter is configured to automatically adjust its position in use to maintain the contour of the eyewear adapter in contact with the top portion of the corresponding eyewear. In some embodiments of the second aspect, the corresponding eyewear comprises goggles.

In a third aspect, a helmet is provided that includes a base portion configured to absorb or distribute force from an impact, the base portion comprising a shell having one or more module attachment points comprising a mechanical connection and a wired connection; an inner layer coupled to the shell; and an electrical layer coupled to the shell or the inner layer, the electrical layer comprising electrical conductors configured to conduct electrical power to the wired connections of the one or more module attachment points on the shell. Individual wired connections are configured to provide a wired electrical connection with an electrical module attached to the helmet at an attachment point, and the wired connections are at least one of a port and connector.

In some embodiments of the third aspect, individual mechanical connections are configured to interface with corresponding mechanical features of an electrical module to secure the electrical module to the base portion. In some embodiments of the third aspect, the base portion further comprises a reinforcement structure. In some embodiments of the third aspect, the reinforcement structure includes the electrical layer such that the electrical conductors form part of the reinforcement structure. In some embodiments of the third aspect, the reinforcement structure is at least partially contained within the inner layer. In some embodiments of the third aspect, included are one or more batteries electrically coupled to the reinforcement structure to provide electrical power to the electrical conductors. In some embodiments of the third aspect, the electrical module comprises at least one of a safety light, forward-facing illumination, GPS, computer processor, a microphone, a speaker, a sensor, eyewear, a camera, or a heads-up display.

In a fourth aspect, a helmet is provided that is configured to removably attach to eyewear, the helmet including a base portion configured to absorb or distribute force from an impact, the base portion comprising a shell and an inner layer coupled to the shell, and an eyewear adapter configured to attach eyewear to the base portion of the helmet within the field of view of the wearer of the eyewear and helmet such that the helmet and the eyewear can be positioned on the wearer's head at the same time and the user can see through the eyewear.

In some embodiments of the fourth aspect, the eyewear adapter is configured to removably attach to partial or complete earstems of the eyewear. In some embodiments of the fourth aspect, the eyewear adapter is configured to removably attach to orbitals of the eyewear. In some embodiments of the fourth aspect, the eyewear adapter comprises a plurality of struts that are each configured to attach to a corresponding earstem of the eyewear.

In a fifth aspect, a modular sports helmet is provided having one or more modules releasably attached thereto, the modular sports helmet including a base portion comprising a shell and an inner layer coupled to the shell, the base portion configured to absorb or distribute force from an impact; a helmet module configured to releasably attach to the base portion, wherein the helmet module is configured such that, in use, the helmet module enhances the fit, aesthetic, or function of the modular sports helmet to provide, in the combination of the modular sports helmet and helmet module, one or any combination of more than one functional advantage selected from the group consisting of improved air flow across or through portions of the modular sports helmet; improved aerodynamics of the helmet; improved sweat control; improved fit; improved integration of eyewear with the modular sports helmet; improved aesthetic appearance; and improved shock absorption, wherein the one or more than one functional advantage comprises an improvement compared to the use of the helmet without the helmet module.

In some embodiments of the fifth aspect, the one or more modules includes a strap guide, a decorative plate, modules that provide selective venting, shock absorbing layers, or ear pieces.

In a sixth aspect, a helmet is provided that includes a base portion comprising a shell and an inner layer coupled to the shell, the base portion configured to absorb or distribute force from an impact; an internal gutter coupled to the base portion and comprising an outer leg, an inner leg shorter than the outer leg, and a channel between the outer leg and the inner leg, the internal gutter configured to direct liquid away from a face of the wearer; a fit system comprising a flexible elongate structure having a portion that is positioned within the internal gutter, the fit system, in use, configured to secure the base portion to a head of a wearer by adjusting the flexible elongate structure; and pull at least a portion of the inner leg of the internal gutter against the head of the wearer.

In some embodiments of the sixth aspect, the internal gutter comprises a deformable material. In some embodiments of the sixth aspect, the fit system comprises a reel that is configured to adjust the length of the flexible elongate structure. In some embodiments of the sixth aspect, the base portion comprises a jog positioned above the internal gutter so that, in use, liquid drips from the jog into the internal gutter. In some embodiments of the sixth aspect, the internal gutter comprises a deformable structure that forms a channel configured to direct liquid away from a face of the wearer. In some embodiments of the sixth aspect, the internal gutter is removable from the helmet. In some embodiments of the sixth aspect, the internal gutter is configured to attach to the inner layer. In a further embodiment, the inner layer comprises a low friction layer configured to translate or rotate with respect to the shell.

BRIEF DESCRIPTION OF THE DRAWINGS

Throughout the drawings, reference numbers may be re-used to indicate correspondence between referenced elements. The drawings are provided to illustrate example embodiments described herein and are not intended to limit the scope of the disclosure.

DETAILED DESCRIPTION

Figure 1:
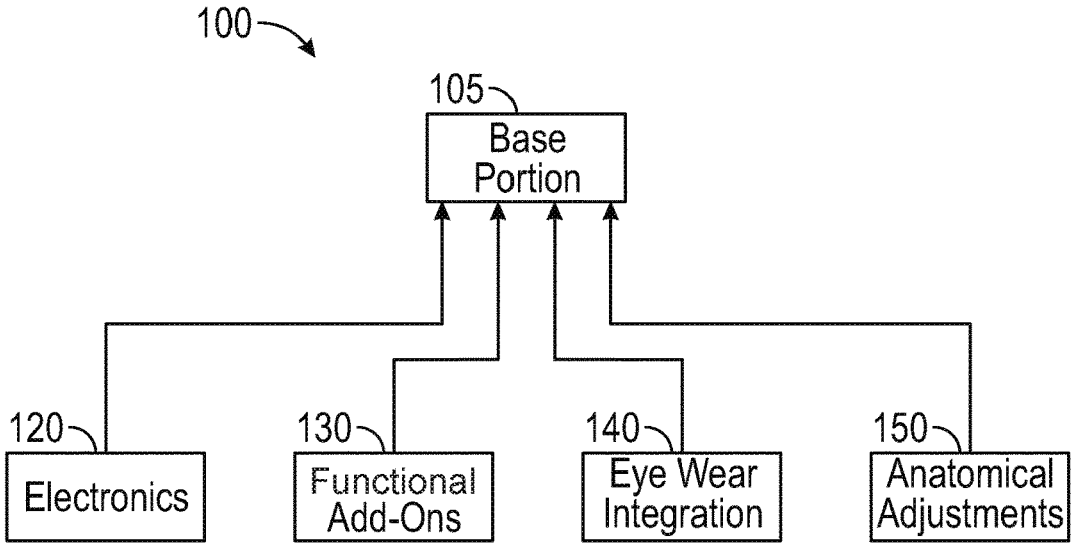
FIG. 1 illustrates a flow chart of configuring a sports helmet to be suitable for a number of different activities using modular components.

Helmets for use in athletic, non-motorized activities are generally designed to protect the wearer's head by absorbing and/or distributing energy during an impact with a surface, such as the ground. Helmets can include a shell and cushioning made from materials configured to attenuate forces from impact such as an exterior shell of plastic and an inner layer of padding and/or foam, wherein the impact-attenuating materials cover and contact a significant extent of the wearer's head. Helmets may also include internal reinforcement structures that may be part of the shell and/or inner layer. Such helmets may be unitary in design and/or construction such that the exterior shell and/or inner layer provide continuous coverage (allowing for discontinuities in portions of the exterior shell and/or inner layer for, e.g., ventilation or aesthetic elements) over the area of the wearer's head that the helmet is designed to protect.

It may be desirable, however, to utilize a single helmet for different activities that would benefit from different functional features. It may also be desirable to extend the range of functionality or features a helmet provides depending on the circumstances of use. For example, a helmet may be designed to be complementary with particular eyewear. If the user then changes eyewear, the change may result in an unsatisfactory outcome for the wearer due to incompatibilities between the helmet and eyewear. As another example, a helmet that is designed to keep a wearer warm may be too hot during other times, such as when a skier is ascending a slope. This may cause the user to take the helmet off exposing the user to an increased risk of injury. As another example, a user may desire to utilize certain advances in technology or design into the user's helmet. Typical helmets may be unable to incorporate such advances, requiring the user to acquire a new helmet.

Accordingly, disclosed herein are sports helmets that generally include a base portion and an eyewear adapter. The eyewear adapter is configured to interface with corresponding eyewear to integrate the eyewear into the helmet. The eyewear adapter can be configured to enhance the functionality of the combination of the eyewear and the helmet relative to the functionality of each individually. For example, the eyewear adapter can provide improved air flow through portions of the helmet and/or eyewear to improve cooling of the wearer. For example, the eyewear adapter can provide improved aerodynamic properties to the combination of the helmet and eyewear. For example, the eyewear adapter can provide a mechanical interface for stowing the eyewear out of the field of vision of the wearer. The eyewear adapter can be a brim that attaches to the base portion. The eyewear adapter may also attach or at least be in contact with the eyewear when the eyewear adapter and eyewear are in use with the helmet.

Also disclosed herein are sports helmets that include an electrical system and physical and electrical adapters. The physical and electrical adapters can be configured to receive modules or components that physically attach to the helmet and that electrically couple to the electrical system of the helmet. For example, the electrical system of the helmet can be configured to include wires that electrically couple the electrical adapters to each other and/or to a source of electrical power. A user may physically attach a helmet module to the physical adapter, and by so doing, create electrical contact between the helmet module and the electrical system through the corresponding electrical adapter. The attached helmet modules can be configured to receive power through one or more batteries coupled to the electrical system. The attached helmet modules can be configured to transmit electrical signals to each other and/or to a control system of the helmet through the electrical system.

In certain embodiments, the base portion is configured to receive one or more modules or panels that physically attach to the base portion to provide additional features to the helmet. In various implementations, the eyewear adapter can be a module that releasably attaches to the base portion. The attachable modules can be configured to provide or enhance mechanical features (e.g., impact protection, ventilation, insulation, aerodynamics, etc.), aesthetic features (e.g., decorations, desired look and feel, etc.), and/or electronic features (e.g., lights, audio, communication, etc.) of the helmet. The attachable modules can be configured to attach to the base portion and/or to each other. Thus, the user can configure the modular helmet to achieve one or more selected, desired, or targeted characteristics. In addition, the user can modify the configuration of the helmet (e.g., by adding, changing, or removing modules) to achieve benefits based on evolving desires of the user and/or changing circumstances. This can allow the helmet to be modified by the wearer to modify the helmet for use in a variety of different activities.

As used herein, the term module may refer to any physical component or device that releasably attaches to the helmets described herein. These modules may provide functional features, aesthetic features, or a combination of functional and aesthetic features to the helmet. In stating that the modules releasably attach to the helmet, it is to be understood that the modules are designed for repeated installation and removal from the helmet. In particular, a module is configured so that it generally receives little or no damage during a routine installation or removal. Installation and/or removal may be accomplished using no tools (e.g., using a friction-fit or interference fit interface). Installation and/or removal may be accomplished using common, household tools (e.g., a screwdriver and/or wrench). For example, a wearer can add and remove modules from a helmet using non-specialized tools. Installation and/or removal may be accomplished using a specialized tool that is configured specifically or specially for the module and/or helmet. The specialized tool can be provided with the helmet and/or module and may be keyed to the particular helmet or module. A module may include physical features that are configured to interface with corresponding features on the helmet to provide for attachment. The physical features may be a physical port that allows the module to physically couple to the helmet. A module may include electrical connectors that are configured to electrically couple to corresponding electrical connectors on the helmet to provide for electrical connection between the module and the helmet. In certain implementations, the physical features may be combined with the electrical connectors so that the same port or connection point can provide physical and electrical connection between the module and the helmet.

As used herein, the term modularity or modular may refer to the ability of a helmet to receive one or more modules. The modular helmets described herein can be configured to physically and/or electrically couple with a module so that the module extends the capabilities or otherwise alters the helmet in some way. Modularity of the helmet may be used to adapt the helmet for different activities. Modularity of the helmet may be used to extend or enhance the functionality of the helmet. Modularity of the helmet may be used to customize the aesthetic appearance of the helmet. Modules can be designed for a user or consumer to replace modules on the helmet with alternative modules that provide different functionality or aesthetics and/or that provide new generations of features.

As a particular example of a modular helmet, the modular helmet can be configured to mate with an eyewear adapter module. The eyewear adapter module can be interchangeable with other eyewear adapter modules. This can allow a user to select an appropriate eyewear adapter module for use with particular eyewear. The eyewear adapter modules can also be configured to be positioned or adjusted after being attached to the base portion to account for differences between facial or cranial geometries. For example, particular eyewear may be positioned differently on different users due at least in part to variations in preferences of the users, variations in their faces, etc. A compatible or complementary eyewear adapter module can be configured to be positioned to account for such differences so that the eyewear adapter module and eyewear interface satisfactorily on different users.

The base portion of the helmet can be configured to provide protective coverage for the user with the option of extending the functionality and/or protection of the helmet with the addition of a variety of modules. In some embodiments, the helmets include a base portion that satisfies one or more safety standards without the use of any additional modules.

The present disclosure generally describes a sports helmet. In certain implementations, the helmet can receive one or more modules or panels to extend or enhance capabilities or features of the helmet. In various implementations, the features and components described herein can be integrated into the helmet without the use of modules. Although some examples described herein are for a helmet for use while cycling, skiing, snowboarding, or participating in other similar sports, it is to be understood that the disclosed sports helmets can be used in conjunction with other athletic activities. For example, the disclosed helmets may be used in non-motorized activities to protect a user's head from possible impact trauma including, for example and without limitation, mountain biking, sledding, ice skating, rollerblading, rock climbing, skate boarding, surfing, skydiving, football, baseball, lacrosse, hockey, and kayaking. Accordingly, the disclosed helmets can be used in non-motorized activities where it is desirable or suitable to use a head-protective apparatus that at least partially surrounds the user's head.

Configuration of a Sports Helmet Having Modular Components

FIG. 1 illustrates a flow chart of configuring a sports helmet 100 to be suitable for a number of different activities using modular components. The helmet 100 includes a base portion 105 that can be configured to receive one or more modules that alter the functionality and/or aesthetics of the helmet. These modules can be electronics modules 120, functional add-ons 130, eyewear integration modules 140, and/or anatomical adjustment modules 150. A particular module may fit within one or more of these categories of modules, thus it is to be understood that the described modules are not intended to be mutually exclusive but are used to facilitate description of the cross-functionality of the helmets described herein.

The base portion 105 of the helmet 100 can be configured to include one or more layers or components that together provide the core functionality of the helmet. The base portion 105 can include an inner layer (e.g., foam padding), a reinforcement structure, an exterior shell, and/or an electrical system. The inner layer can include, for example, a low friction layer such as a multi-directional impact protection system (MIPS™) provided by MIPS AB at Kalltorpsvagen 2, SE-183 71 Taby Sweden, the low friction layer configured to provide a material that allows for movement of the inner layer relative to the exterior shell to reduce rotational forces on the head of the wearer that may be caused by certain impacts. An example of a low friction layer in a helmet is provided in U.S. Patent Publication No. 2013/0042397, entitled "Helmet," published Feb. 21, 2013, the entire contents of which is incorporated by reference herein for all purposes. The base portion 105 of the helmet can be designed for single impact use or multi-impact use. The base portion 105 can include layers that are made of expanded polypropylene (EPP) foam and/or expanded polystyrene (EPS) foam.

The base portion 105 can include one or more mechanical attachment points that are configured to couple to the modules described herein. In some embodiments, the mechanical attachment points can also be configured to include electrical contacts to interface electrically with electronics modules 120. In this way, the same attachment point can provide mechanical and electrical connections for modules. The base portion 105 can include a power source (e.g., a battery). The power source can be configured to provide electrical power to the electrical contacts so that connected modules can be powered by a battery that is in a different location on the helmet. This can aid in reducing the size and weight of the electronics modules 120 configured for use with the helmet 100.

The electronics modules 120 can be configured to provide a variety of electrical capabilities. The electronics modules 120 can be physically and electrically coupled to the base portion through physical and electrical ports on or in the helmet 100. The electronics modules 120 can receive power through the base portion 105 or may provide their own power. The electronics modules 120 can be configured to communicate with a control system on the helmet 100 or with one another through an electrical system of the helmet 100. Examples of the electronics modules 120 are described herein with respect to FIGS. 2 and 3.

The functional add-ons 130 include modules that alter the functionality of the helmet. Examples of such modules include, for example and without limitation, face masks, strap clips, air vents, ear pads, shock absorbing layers, decorative plates, etc. Further examples are described herein with reference to FIG. 38.

The eyewear integration modules 140 can be configured to integrate eyewear with the helmet 100. Eyewear integration modules 140 include features, such as a brim, that can be configured to attach to the base portion 105 and that are configured to interface with the eyewear to improve air flow through portions of the helmet and/or eyewear, to improve aerodynamic properties of the helmet with the eyewear, and/or to provide a targeted aesthetic to the helmet with the eyewear. Examples of eyewear integration modules 140 are described in greater detail herein with respect to FIGS. 4A-10, and 12-36. As described herein, the eyewear integration modules 140 can include a brim. The eyewear can be, for example and without limitation, goggles, glasses, sunglasses, visors, eyewear with a single lens (e.g., a unitary lens), eyewear with dual lenses, eyewear with partial orbitals, eyewear without orbitals, eyewear with earstems, eyewear with partial earstems, eyewear without earstems, and the like.

The anatomical adjustments 150 include components that alter the fit of the helmet and/or position of the eyewear integration modules 140 or the eyewear. The anatomical adjustments 150 include, for example, a fit system comprising a mechanical reel and lace that adjusts an inner diameter of the helmet to fit onto a wearer. The anatomical adjustments 150 include, for example, eyewear adjustments that adjust the position of the eyewear with respect to the base portion 105 to account for differences in anatomical structure between users. The anatomical adjustments 150 include, for example, eyewear adapter adjustments that adjust the position of the eyewear adapter with respect to the base portion 105 to account for differences in anatomical structure between users. This can be used, for example, to close or reduce a gap between eyewear and the helmet 100.

One or more of the modules described herein can provide air management functionality to the helmet. For example, the functional add-ons 130 and/or eyewear integration 140 can be configured to improve aerodynamics of the helmet 100. These modules may also be configured to provide venting through portions of the helmet 100 and/or eyewear. These modules may also be configured to block venting through portions of the helmet 100 and/or eyewear. In some embodiments, the modules can be configured to selectively block or allow venting. These modules may also be configured to provide anti-fog capabilities for the eyewear (e.g., by directing air flow between the eyewear and the user). These modules may be configured to provide temperature and/or moisture management.

One or more of the modules described herein can provide mechanisms to adjust the fit of the helmet 100. The modules can provide for different fields of view to the wearer. This may be beneficial where the user desires a wide field of view while participating in certain activities and a narrower field of view while participating in other activities. One or more of the modules described herein can be configured to increase the protection provided by the helmet 100.

Sports Helmet with Integrated Electrical Capabilities

Figure 2:
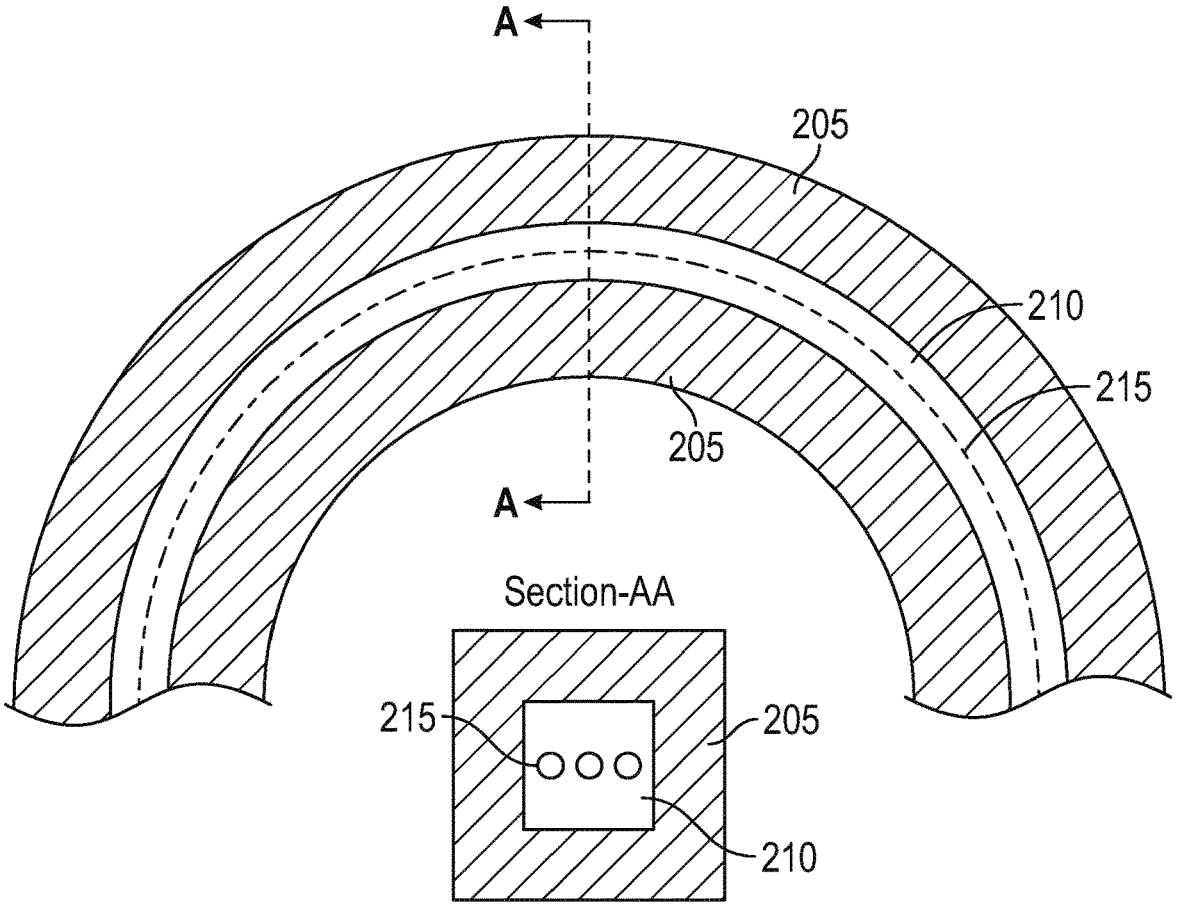
FIG. 2 illustrates a sports helmet configured to provide integration of electronic components using modular components.

FIG. 2 illustrates a sports helmet 200 configured to provide integration of electronic components using modular components. The helmet includes an inner layer 205 with a reinforcement structure 210 within the inner layer. The reinforcement structure 210 forms a conduit in which electrical wires 215 are situated. At various points in the inner layer 205 and reinforcement structure 210, the electrical wires 215 are electrically coupled to electrical connectors that provide electrical contacts at connection points on the helmet 200. It is to be understood that although the electrical wires 215 and the reinforcement structure 210 is illustrated as being within the inner layer 205, they may be located within any layer of the sports helmet such as the exterior shell. In some embodiments, the electrical wires 215 are embedded within the inner layer 205 or the exterior shell without the reinforcement structure 210. In some embodiments, the electrical wires 215 are within a separate, electrical layer to form the electrical system of the helmet 200.

The reinforcement structure 210 of the helmet 200 includes electrical connections that allow data and power to be transmitted over the electrical wires 215 to different parts of the reinforcement structure 210. The reinforcement structure 210 is configured to increase the strength of the helmet 200. In certain implementations, the reinforcement structure 210 is molded into the inner layer 205. The reinforcement structure 210 can be a structure of flexible linear material. In some embodiments, the reinforcement structure 210 includes a structure of composite material, preferably having unidirectional fiber orientation. In certain embodiments, the reinforcement structure 210 is a hand-laid filament. However, the arrangement of the filament can be produced using other suitable mechanisms, such as an automated lay-up process. In some embodiments, the filament includes Kevlar with an epoxy resin. In various embodiments, the filament can include carbon, fiberglass or a combination of one of these materials. For example, in some embodiments the filament can include Kevlar and carbon. In certain embodiments, the filament can include Kevlar, carbon and fiberglass. Other suitable filament materials can also be used. In some embodiments, the filament has a flexible unidirectional fiber orientation, allowing a frame to be formed by shaping a unitary filament into a desired layout structure. However, the reinforcement frame can include other suitable configurations, such as a rigid or semi-rigid frame. Other examples of reinforcement structures are provided in U.S. Pat. No. 7,698,750, entitled "Bicycle helmet with reinforcement structure," issued Apr. 20, 2010, and U.S. Pat. No. 7,069,601, entitled "Head protection system and method," issued Jul. 4, 2006, the entirety of each of which is incorporated by reference herein for all purposes.

In some embodiments, the electrical wires 215 form connection points within the helmet 200. At each connection point, the helmet 200 may include a module or integrated electronic component. For example, the helmet 200 can include a battery, sensors, data processing system, a system controller, data storage, etc. Electrical modules that connect to the electrical system formed by the wires 215 can include, for example and without limitation, a safety light, an illuminating light, a GPS, a processor, a microphone, a speaker, an earphone, a heads-up display, and the like.

Figure 3:
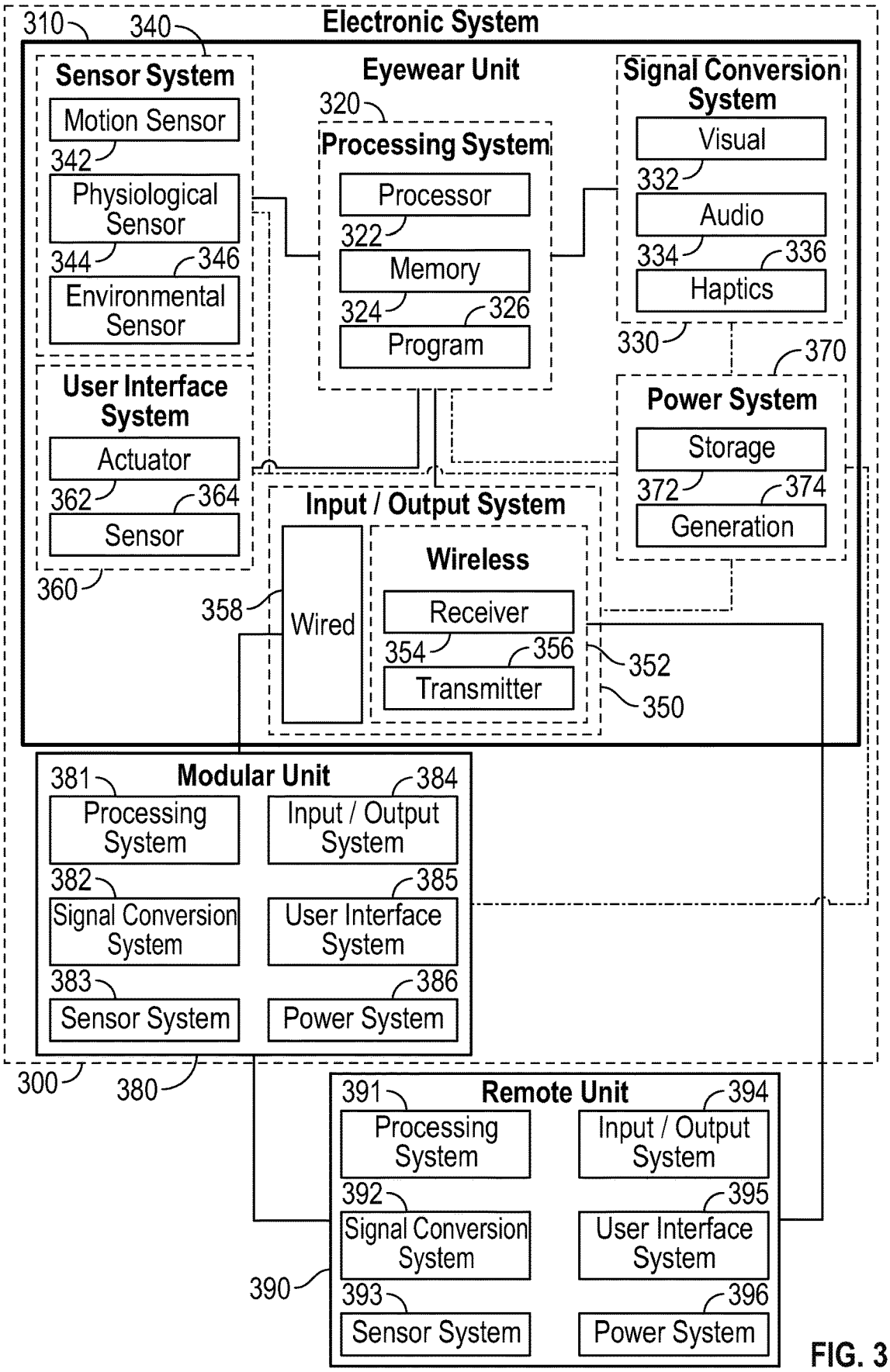
FIG. 3 illustrates a block diagram of an example electronic system of a sports helmet having modular components.

FIG. 3 illustrates a block diagram of an example electronic system 300 of a sports helmet having modular components 380. The electronic system 300 can include a headworn wearable unit, such as the helmet unit 310, with one or more systems such as a processing system 320, a signal conversion system 330, a sensor system 340 (ambient or environmental, motion, biometric, and/or physiological), an input/output (I/O) system 350, a user interface system 360, and a power system 370. The system 300 can also include one or more modular units 380 which can be removably coupled to the helmet unit 310. In some embodiments, one or more of the modular units 380 can function as source devices and provide signal sources for the system 300. In some embodiments, the one or more modular units 380 can be removably coupled to and/or carried by the helmet unit 310. This can advantageously provide a more compact and combined form factor for the user and reduce the number of detached components. This can be beneficial when the user does not have sufficient storage or carrying space, such as pockets, to hold detached components.

Each of the modular units 380 can include one or more systems. For example, the modular units 380 can include one or more systems such as a processing system 381, a signal conversion system 382, a sensor system 383, an input/output (I/O) system 384, a user interface system 385 and a power system 386. Processing system 381, signal conversion system 382, sensor system 383, input/output (I/O) system 384, user interface system 385 and/or power system 386 can include the same or similar components to those discussed in connection with processing system 320, signal conversion system 330, sensor system 340, input/output (I/O) system 350, user interface system 360, and/or power system 370.

The modular units 380 can include a forward facing camera, a solar cell, a GPS antenna, GPS, microphone, speaker, battery, data processing system, a sensor, eyewear, and the like. The modular units 380 can acquire data and transmit this data to other modular units 380 either wirelessly or through a wired connection that connects through the helmet unit 310.

In some embodiments, a modular unit 380 can include eyewear with electronics integration similar to the electronics integration described herein with respect to the helmet unit 310. The helmet unit 310 can be configured to communicate with the eyewear modular unit 380.

In some embodiments, a remote unit 390 can include eyewear with electronics integration similar to the electronics integration described herein with respect to the helmet unit 310. The helmet unit 310 can be configured to communicate with the eyewear remote unit 390.

Each system can be in communication, wired and/or wirelessly, with one or more other systems. In some embodiments, some or all communications between systems can be two-way communication such that a first system may transmit data to and receive data from a second system. For example, two-way communications may be established between the processing system 320 and the signal conversion system 330. The processing system 320 may transmit data to a speaker of the signal conversion system 330 and receive data from a microphone of the signal conversion system 330. In some embodiments, some or all communications between systems can be one-way communications such that a first system may transfer data to a second system whereas the second system does not transfer data to the first system. For example, the user interface system 360 may transmit data to the processing system 320 and the processing system 320 may not transmit data to the user interface system 360. It should be understood that one or two-way communication can be maintained between any systems described herein. Moreover, it should be understood that, when taken in its entirety, multiple systems can be in communication to each other via other system. For example, the sensor system 340 can be in communication with the signal conversion system 330 via intermediary communications with the processing system 320.

As another example, wired and/or wireless two-way communications may be established between the helmet unit 310 and one or more modular units 380, such as via input/output systems 350, 384. The helmet unit 310 may transmit data to one or more modular units 380 and receive data from one or more modular units 380. In some embodiments, some or all communications between the helmet unit 310 and one or more modular units 380 can be one-way communications such that the helmet unit 310 may transfer data to one or more modular units 380 whereas one or more modular units 380 do not transfer data to the helmet unit 310 or vice-versa. It should be understood that one or two-way communication can be maintained between one or more modular units 380 and the helmet unit 110. For example, two-way communications may exist between helmet unit 310 and a first modular unit 380 whereas one-way communications may exist between helmet unit 310 and a second modular unit 380. Moreover, it should be understood that, when taken in its entirety, multiple systems can be in communication to each other via other system. For example, a first modular unit 380 can communicate with a second modular unit 380 either directly via an input/output system 384 and/or through the helmet unit 310 as an intermediary via input/output system 350.

The systems can be in communication via a wired connection and/or via a wireless connection as illustrated by the solid connecting lines. One or more systems, such as those for the helmet unit 310 and the modular unit 380, can receive power from the power system 370 as shown by the dash-dot-dash lines. Of course, one or more systems, such as those for the helmet unit 310 and the modular unit 380, can receive power from the power system 386 either in addition to that received from the power system 370, or solely from the power system 386. Although the systems are shown as communicating to each other through the processing system 320, it should be understood that the systems may bypass the processing system 320 and communicate directly with each other.

In some embodiments, one or more systems of the helmet unit 310 can be integrated into or with a headworn wearable device, such as a helmet. For example, one or more of the components of the systems of the helmet unit 310 can be located on and/or within one or more components of the helmet such as one or more of the exterior shell, reinforcement structure, and/or inner layer. In some embodiments, a plurality of components of the one or more systems can be distributed to different components of the helmet to help distribute volume and/or weight in the helmet, thereby enhancing performance and user comfort when utilizing the helmet with the helmet unit 310.

In some embodiments, the one or more modular units 380 can be positioned such that a majority of the modular unit 380 is positioned outside the helmet unit 310. In some embodiments, the one or more modular units 380 can be positioned such that a majority of the modular unit 380 is hidden within a component of the helmet, such as one or more of the exterior shell, reinforcement structure, and/or inner layer.

The modular unit 380 can be a standalone device which can function without being connected to helmet unit 310 or any other electronic devices. For example, the modular unit 380 can include a processing system 381, a sensor system 383, and a power system 386 and can be capable of recording information even while disconnected from another device. When attached to the helmet unit 310, the modular unit 380 can provide this data to the helmet unit 310. In some embodiments, the modular unit 380 can be a standalone device which provides timing functionality to the helmet unit 310. When removed from the helmet unit 310, the modular unit 380 can beneficially be used as a timing device (e.g., stopwatch, timer) in other settings. For example, such a modular unit 380 can be used at home, attached to another part of one's person such as a user's wrist, and/or attached to another structural component such as a bike handle. Moreover, the modular unit 380 can supplement the capabilities of the helmet unit 310 such as by supplementing an existing processing system 320, sensor system 340, and/or power system 370 of the helmet unit 310 or, in embodiments of helmet unit 310 without one or more of these systems, wholly adding new functionality to the helmet unit 310.

The modular unit 380 may not be a standalone device. For example, the modular unit 380 may not include a power system 386 to provide power to electronics contained within the modular unit 380. In some embodiments, the modular unit 380 can receive this power via connection to the helmet unit 310 or another electronic device.

The helmet unit 310 and/or the modular units 380 can be in communication, wired and/or wirelessly, with a remote unit 390. As shown in the illustrated embodiment, the remote unit 390 can include one or more systems such as a processing system 391, a signal conversion system 392, a sensor system 393, an input/output (I/O) system 394, a user interface system 395, and a power system 396. As discussed in further detail below, processing system 391, signal conversion system 392, sensor system 393, input/output (I/O) system 394, user interface system 395 and/or power system 396 can include the same or similar components to those discussed in connection with processing systems 320, 381, signal conversion systems 330, 382, sensor systems 340, 383, input/output (I/O) systems 350, 384, user interface systems 360, 385, and/or power systems 370, 386.

The remote unit 390 can be a standalone device or can be operational only when in communication with the system 300 such as the helmet unit 310 and/or the modular unit 380. Examples of remote units 390 can include one or more electronic devices such as, but not limited to, standalone devices such as cell phones, smart phones, watches, smart watches, PDAs, tablets, laptops, desktops, game consoles, MP3 players, iPods, cameras, fitness or gym equipment, sensors, and the like. For example, the one or more electronic devices can include, bike computers and other on-board vehicle sensors or systems, activity trackers such as a Fitbit, and other wearable and smart devices such as an Apple iWatch, an Apple iPhone, Android-based phones, and other such devices.

In some embodiments, the helmet unit 310 and/or one or more of the modular units 380 can receive data from the remote units 390 and present or communicate this data to the user of the system 300. For example, the helmet unit 310 and/or one or more of the modular units 380 can be used to stream music from a remote unit 390, such as a smart phone or MP3 player, and present that to the user. In some embodiments, the helmet unit 310 and/or one of the modular units 380 can communicate with a remote unit 390, such as a smart phone or cell phone, such that the user of the communication unit 300 can use the helmet unit 310 and/or one of the modular units 380 for a phone call and/or for sending text messages. In some embodiments, the helmet unit 310 and/or one or more of the modular units 380 can communicate with multiple remote units 390.

Use of a modular unit 380 with the helmet unit 310 can advantageously supplement the features and functionality of the helmet unit 310. This can be particularly beneficial as it can allow a user to upgrade the device over time. In this manner, the usable lifespan of the helmet unit 310 can be expanded thereby reducing waste and reducing total costs to the user who need not replace the helmet unit 310 with a newer version of the helmet unit 310 if newer functionality is desired. Moreover, in circumstances where the desired functionality may change depending on the activity being performed by the user, this system can beneficially allow the user to more effectively configure the system 300 depending on the activity.

In some embodiments, the helmet unit 310 can omit systems such as a processing system 320 and/or signal conversion system 330, which might include components which are expensive to manufacture and are quickly antiquated or rendered incompatible with other components by new developments in technology. The user can then purchase one or more modular units 380 to provide one or more of the upgraded, repaired, or missing systems, or to provide improvements or enhancements to the system. For example, in some embodiments, the helmet unit 310 can omit the wireless system 352 and the user can connect one or more modular units 380 to provide an input/output system 350 which includes wireless systems. This can be particularly advantageous as wireless protocols often vary for remote units 390 from different manufacturers and, in some instances, from the same manufacturer. The one or more modular units 380 can provide one or more wireless protocols. In some embodiments, the helmet unit 310 can omit the processing system 320, signal conversion system 330, the sensor system 340, and/or the wireless system 352 and the user can connect one or more modular units 380 to provide the missing systems.

Moreover, it is contemplated that due to advances in technology, systems on the helmet unit 310 can eventually become antiquated by newer technology. The modular unit 380 can be used to supplement or replace existing systems on the helmet unit 310. For example, the modular unit 380 can be used to assist in providing faster, more efficient, and/or otherwise enhanced operation of the device by including one or more supplemental components, such as a power system 386 and/or supplement storage of data by including a memory with processing system 381. This ability to supplement or improve the existing systems of the device can also be beneficial as the user need not be inconvenienced with purchasing an entirely new helmet unit 310 to upgrade certain features and functionality. Rather, the user can purchase modular units 380 to add or upgrade components, features and/or functionality of the system 300.

As should be understood from the discussion of the multiple systems below, it should be appreciated that any of the components can be omitted from one or more of the systems of the helmet unit 310 and/or modular unit 380. Accordingly, it should be understood that any combination of such components between the helmet unit 310 and/or modular unit 380 can be achieved as desired by the user.

For example, in some embodiments, the modular unit 380 can include systems and/or components which are not present on the helmet unit 310 or vice versa. For example, in some embodiments, the helmet unit 310 can include solely a power system 370 and the modular unit 380 can include one or more of a processing system 381, a signal conversion system 382, a sensor system 383, an input/output (I/O) system 384, and a user interface system 385. The helmet unit 310 can provide power to the modular unit 380 via a port or connector of the helmet unit 310 similar to those described in connection with I/O system 350 below. In this manner, a user can specifically choose modular units 380 which provide the functionality that the user desires. This can beneficially reduce total costs to the user as the user need not purchase modular units 380 with functionality that the user does not desire. Moreover, selection of specific functionality can further reduce size and/or weight of the system 300.

As another example, in some embodiments, the helmet unit 310 can include an I/O system 350 and the modular unit 380 can include an I/O system 384 and one or both of the helmet unit 310 and the modular unit 380 can include a power system. This can beneficially provide for a greater degree of connectivity with other devices. For example, the I/O system 384 can be a more up-to-date wireless protocol capable of communicating with newer devices. In some embodiments, the helmet unit 310 can include a processing system 320 and power system 370 in addition to the I/O system 350. In some embodiments, the modular unit 380 can include one or more other systems, such as a processing system 381, a signal conversion system 382, a sensor system 383, a user interface system 385, and/or a power system 386 in addition to the I/O system 350. In some embodiments, the modular unit 380 can provide one or more of the following functionality: additional processing capabilities such as a second microprocessor, image capture (e.g., still camera and/or video camera), audio input devices (e.g., microphones, such as a bone conduction microphone), audio output devices (e.g., in-ear speakers, bone conduction speakers, directional audio speakers, outwardly facing speakers), physiological sensing (e.g., heart rate sensors, blood-oxygen sensors, and the like), environmental sensing (e.g., air temperature sensors, air humidity sensors, air quality sensors, pressure sensors, wind speed sensors which can be used in calculating power, and the like), motions sensors (e.g., accelerometers, gyroscope, and the like), biometric calculations (e.g., skin temperature and air temperature to calculate hydration, biochemical sensors to determine sweat characteristics, EEG sensors), provision of directions (e.g., audio and/or visual indicators such as a turn signal and/or haptic feedback, GPS), additional wireless capabilities (e.g., receivers, transmitters, and/or transceivers) which can add new protocols or supplement existing protocols (e.g., a second Bluetooth connection), Wi-Fi, or any other protocol described herein, wind noise reduction (e.g., windscreens, specific housing shapes), enhanced audio (e.g., enhanced speakers), enhanced booms (e.g., built-in power sources such as batteries, different sizes such as smaller sizes designed to better fit women), user interfaces (e.g., touch controls or buttons), power charging (e.g., one or more ports or connectors which allow for charging of the system while still allowing a user to listen to the boom), safety features (e.g., LED lights, radar system which can be rear-facing, peer-to-peer communications), and other functionality.

Use of a remote unit 390 with the system 300 can also advantageously enhance the features and functionality of the system 300. For example, the remote unit 390 can include systems and/or components which are not present on the system 300 or vice versa. Similar to the description in connection with modular unit 380, the user can purchase one or more remote units 390 to provide additional components, features and/or functionality. As should be understood from the discussion of the multiple systems below, it should be appreciated that any of the components can be omitted from one or more of the systems of the system 300 and/or remote unit 390. Accordingly, it should be understood that any combination of such components between the system 300 and/or remote unit 390 can be achieved as desired by the user.

Although the discussion of the multiple systems is primarily in reference to the helmet unit 310, it should be understood that such discussion also pertains to systems of the modular unit 380 and the remote unit 390. For example, it should be understood that any or all of the components discussed in connection with processing system 320, signal conversion system 330, sensor system 340, I/O system 350, user interface system 360, and/or power system 370 can also be included instead of or in addition to those described and/or illustrated in processing systems 381, 391, signal conversion systems 382, 392, sensor systems 383, 393, I/O systems 384, 394, user interface systems 385, 395, and/or power systems 386, 396.

Processing System

The support structure such as helmet unit 310 of the system 300 can include a processing system 320 which can be designed to process and/or store data received from one or more of the other systems of the system, such as the helmet unit 310, modular unit 380, and/or remote unit 390. As shown in the illustrated embodiment, the processing system 320 can include one or more components, such as a processor 322, a memory 324 and program 326. The processor 322 can be a microprocessor or central processing unit (CPU) designed to receive data from one or more of the other systems and transmit this processed data to one or more of the other systems. In some embodiments, the processor 322 can be designed to process this data in accordance with an algorithm from program 326. The functionality of processor 322 and/or any other component of the helmet unit 310, modular unit 380, and/or remote unit 390 can be modified and/or enhanced by utilizing a different program 326. The processed data can also be stored in the memory 324 for later use. For example, the data stored in memory 324 can be retrieved at a later time for further processing by the processing system 320 and/or viewing by the user. In some embodiments, the program 326 can be software stored in memory 324 and/or firmware stored in hardware, such as the processor 322 and/or other components of the helmet unit 310. The program 326 can be updated, modified, fixed, and/or replaced, such as by receiving a new or modified program 326 through the system 300, and/or by attaching the component in which the program 326 is stored or some other portion of the system to another computing device, either in a wired or wireless manner, to convey new or modified program information into the program 326, or by replacing the component in which the program 326 is stored with another component containing a different program 326.

Program 326 can include software which can provide one or more different features or user experiences when utilizing the system 300. For example, such software can include one or more applications which provide one or more features and/or functionality such as, but not limited to, tracking designed to track and store a user's activity such as number of steps taken, amount of time the user was active, environmental conditions in which the system 300 has been used, and the like. The software can also include one or more features and functionality related to user operation of the helmet unit 310, modular unit 380, and/or remote unit 390, such as voice command functionality allowing for hands-free operation of the units 310, 380, 390. In some embodiments, the software can enable one or more other types of features and functionality such as conversion of text messages to voice messages and vice versa.

In some embodiments, the program 326 can include software found on mobile devices such as, but not limited to, cell phones, smart phones, PDAs, and tablets running Android, iOS, and/or Windows operating systems, etc. For example, the helmet unit 310 can include an Android, iOS, and/or Windows operating system to enable compatibility with such software. In some embodiments, program 326 can include software found on other types of electronic devices including, but not limited to, laptops and desktops. Advantageously, in embodiments where such functionality is enabled in the helmet unit 310, the helmet unit 310 of the system 300 can include one or more functions of other stand-alone mobile devices.

Although program 326 is illustrated as forming part of the processing system 320, as noted above program 326 can include firmware which is built into any aspect of the system, such as in the processor 322 and/or any other components of the helmet unit 310. For example, program 326 can be used to control the operation of components of the helmet unit 310 such as the various components of the signal conversion system 330, sensor system 340, I/O system 350, user interface system 360 and/or the power system 370 or similar systems on the modular unit 380 and/or remote unit 390. For example, the program 326 can be used to control the operation of the wireless system 352 of the I/O system 350 which can include a receiver, transmitter, and/or transceiver designed to communicate with other devices typically within a personal area network distance from the helmet unit 310 using a wireless protocol such as, but not limited to, Bluetooth, Bluetooth Low Energy (Bluetooth Smart), ANT, ANT+, ZigBee, Wi-Fi, GSM, CDMA, and MMS. The program 326 can also be used to monitor the statuses of the one or more sensors of the system 300.

In some embodiments, the modular unit 380 and/or remote unit 390 can include processing systems 381, 392 having components, features and/or functionality similar to that described above in connection with processing system 320. In some embodiments, the helmet unit 310 can omit one or more components of the processing system 320 such that a user can provide such components with processing systems 381, 391. For example, the helmet unit 310 can omit the processor 322, memory 324 and/or program 326 allowing the user to supply one or more of such components by connecting the helmet unit 310 with a modular unit 380 and/or remote unit 390 via a wired connection and/or wirelessly. The helmet unit 310 can include components which overlap with those of processing systems 381, 391 of the modular unit 380 and/or remote unit 390. This can advantageously supplement and/or enhance the functionality of the processing system 320. For example, the helmet unit 310 can be provided with a power-efficient processor 322 to conserve battery life and a modular unit 380 and/or a remote unit 390 can include a more powerful processor. As another example, the modular unit 380 and/or remote unit 390 can have a processing system 381, 391 designed to decode MP3s or other audio files and can provide such additional features and/or functionality to the helmet unit 310 when connected. Of course, in some embodiments, one or more components of the processing systems 381, 391 of the modular unit 380 and/or remote unit 390 can be omitted.

Signal Conversion System

The helmet unit 310 of the system 300 can include a signal conversion system 330 which can be designed to convert signals from one form to another. The signal conversion system 330 can be designed to convert analog and/or digital electrical signals into signals more readily perceptible by the user of the helmet unit 310 such as audio, visual, and/or tactile signals, etc. The signal conversion system 330 can be designed to convert audio, visual, and tactile signals into analog and/or digital electrical signals for processing by a processing system such as processing system 320. Accordingly, as shown in the illustrated embodiment, the signal conversion system 330 can include one or more of a visual component 332, an audio component 334 and a tactile component 336.

In some embodiments, the visual component 332 can include a display device which can convert analog and/or digital signals into visual images and display them to the user. This may be accomplished by projecting an image or other data directly on the retina (i.e., retinal projection) and/or by displaying an image on an image plane such as a surface or screen within the wearer's field of view such as, but not limited to, an LCD screen, an OLED screen, a projector onto a surface such as a prism having an opaque surface, any other display screen, or a combination of such devices. The display device may be driven by any of a wide variety of source materials, either carried on board the helmet unit 310, or in communication with the eyeglasses from another source, such as the modular unit 380 and/or the remote unit 390, either via wired communication such as via a wired connection 358 such as a port and/or connector and/or wirelessly such as via the wireless system 352.

In some embodiments, to provide such functionality, the display device can include a variety of components. In some embodiments, the visual component 332 can include an image capture device which can convert visual images into analog and/or digital signals. For example, the image capture device can be a camera which can capture pictures and/or video. One or more visual components 332 can be removably coupled to one or more components of the system 300 to enable selective use of one or more of the visual components 332. For example, in some embodiments, a user can attach a visual component 332 when needed to receive or transmit visual data, but then remove such visual component 332 when not needed, to reduce the weight and bulk of the eyewear and/or to change the appearance of the eyewear. The removable attachment between the visual component 332 and any other component of the system 300 can be accomplished using any suitable structures or methods, including but not limited to any of the wired or wireless structures or methods described and/or illustrated in this specification.

The visual component 332 can be used to provide the user with visualizations of data desired by the user. For example, the visual component 332 can be used to provide the user with a visualization of data received from one or more of the systems such as the sensors of the sensor system 340. The visual component 332 can provide the user with a visual indicator of parameters being detected and/or measured by the sensors of the sensor system 340 such as, but not limited to, the user's heart rate, body temperature, velocity, acceleration, pace, distance traveled, power expended, energy expended, ambient temperature, pressure, altitude, body orientation and other such parameters and data. By providing a visual indication of such parameters, the user of the device can track such parameters on an ongoing or continuous or constant basis. Other visual indicators of parameters from other systems can also be shown such as the status of such systems. Other types of data, such as pictures and/or videos, can be displayed using the visual component 332. Moreover, the visual component 332 can be used as a camera to capture pictures and/or videos which can be advantageous to increase the safety of the user of the device. For example, the camera can be directed behind and/or laterally to provide the user with images of user's blind spots.

In some embodiments, the audio component 334 can include a speaker device which can convert analog and/or digital signals into sound waves and direct them to the user. This may be accomplished by generating pressure waves and directing these pressure waves to the user's ears, such as via a speaker, and/or by generating vibrations, such as via a bone-conduction speaker. In some embodiments, the audio component 334 can include an audio capture device which can convert sound waves into analog and/or digital signals. For example, the audio capture device can be a microphone.

The audio component 334 can be used to provide the user with audible representations of data desired by the user. For example, the audio component 334 can be used to provide the user with an audible representation of data received from one or more of the systems such as the sensors of the sensor system 340. The audio component 334 can provide the user with intermittent and/or continuous audio updates of parameters being detected and/or measured by the sensors of the sensor system 340 such as, but not limited to, the user's heart rate, body temperature, velocity, pace, distance traveled, power expended, energy expended, ambient temperature, pressure, altitude and other such parameters and data. Other audio updates of parameters from other systems can be shown such as the status of such systems. Other types of data, such as music, voice calls, can also be audibly presented using the audio component 334. The audio component 334 can be used as a microphone which can be used in conjunction with operating the helmet unit 310, modular unit 380, and/or remote unit 390, voice calls, and similar functions. In some embodiments, the microphone can be used in conjunction with a speaker for purposes of noise cancellation.

In some embodiments, the haptic component 336 can include a force or vibration device which can convert analog and/or digital signals into tactile feedback and direct them to the user. This may be accomplished by generating forces or vibrations, such as via one or more of an imbalanced motor, linear actuators, voice coils, piezoelectrics, electrostatics, and/or electroactive polymers, etc. In some embodiments, the haptic component 336 can include a tactile capture device which can convert tactile forces into analog and/or digital signals. For example, the tactile capture device can comprise one or more piezoelectrics, electrostatics, electroactive polymers, any other device as desired, or a combination of any of these devices.

The haptic component 336 can be used to provide the user with tactile representations of data desired by the user. For example, the haptic component 336 can be used to provide the user with a tactile representation of data received from one or more of the systems such as the sensors of the sensor system 340. Accordingly, the haptic component 336 can provide the user with intermittent and/or continuous tactile updates of parameters being detected and/or measured by the sensors of the sensor system 340 such as, but not limited to, the user's heart rate, body temperature, velocity, pace, distance traveled, power expended, energy expended, ambient temperature, pressure, altitude and other such parameters and data. In some embodiments, the haptic component 336 can vibrate to provide the user with notifications of trigger events. For example, the haptic component 336 can vibrate when an email or text message has been received, when a call is being received, and other types of trigger events.

In some embodiments, one or more haptic components 336 can be positioned on multiple components of the helmet unit 310 and/or modular unit 380. For example, haptic components 336 can be placed on lateral components of the helmet unit 310 and on anterior components of the helmet unit 310. The different haptic components 136 can be activated separately or together based on the specific trigger event. For example, if an email or text message is received, a lateral haptic component 336 can be activated. If a call is being received, an anterior haptic component 336 can be activated. Separate activation of different haptic components 336 can help the user to more easily identify different trigger events.

In some embodiments, use of multiple haptic components 336 can be used to assist the user in navigation. For example, a haptic component 336 located to the left of the user's head can be activated to indicate to the user to turn left, a haptic component 336 located to the right of the user's head can be activated to indicate to the user to turn right, and a haptic component 336 located to the front of the user's head can be activated to indicate to the user to continue proceeding forward. Use of haptic components 336 for navigation can be particularly beneficial for users of the helmet unit 310 and/or modular unit 380 who are blind and/or deaf. This can also be particularly beneficial, even for those with full vision and/or hearing capabilities, when use of visual indicators and/or audio indicators may be intrusive or impractical during a particular activity, such as when other visual or audio indicators are already being utilized by a user. In some embodiments, the haptic components 336 can be used to inform a user of objects and/or persons in a user's blind spot. This can beneficially enhance the safety of the user of the device. As another example, visual indicators could potentially make the user more visible to others as a result of the light output in providing such indicators. Audio indicators can potentially be heard by others.

In some embodiments, the modular unit 380 and/or remote unit 390 can include signal conversion systems 382, 392 having components, features and/or functionality similar to or the same as any of those described above in connection with signal conversion system 330. In some embodiments, the helmet unit 310 can omit one or more components of the signal conversion system 330 such that a user can provide such components with signal conversion systems 382, 392. For example, the helmet unit 310 can omit the visual component 332, audio component 334 and/or haptic component 336 thereby allowing the user to supply one or more of such components by connecting the helmet unit 310 with a modular unit 380 and/or remote unit 390 via a wired connection and/or wirelessly. In some embodiments, an audio component such as an in-ear, on-ear, near-ear, over-the-ear, and/or an outwardly facing speaker can be provided on a modular unit 380 and/or remote unit 390. For example, the remote unit 390 can have an outwardly facing speaker and serve as an external speaker. The helmet unit 310 can include components which overlap with those of the signal conversion systems 382, 392 of the modular unit 380 and/or remote unit 390. This can advantageously supplement and/or enhance the functionality of the signal conversion system 330. For example, the helmet unit 310 can be provided with a speaker and a modular unit 380 and/or remote unit 390 can be provided with a microphone. In some embodiments, one or more components of the signal conversion systems 382, 392 of the modular unit 380 and/or remote unit 390 can be omitted.

Sensor System

The helmet unit 310 of the system 300 can include a sensor system 340 which can be designed to obtain sensory data from the environment (e.g., an ambient or environmental sensor) and/or the user (a biometric and/or physiological sensor). Accordingly, as shown in the illustrated embodiment, the sensor system 340 can include a plurality of sensors including, but not limited to, one or more motion sensors 342, one or more biometric and/or physiological sensors 344, and one or more ambient or environmental sensors 346. By utilizing data from the sensor system 340, the helmet unit 310 can provide beneficial data regarding the user's condition and/or the surrounding environment. The data received from the sensor system 340, can be further processed by the processing system 320 to provide the user with general data about the user's activities, such as number of steps taken and duration of time the user was active.

The one or more motion sensors 342 can be designed to detect and/or measure movement or motion. The one or more motion sensors 342 can include any type of sensor which can detect and/or measure such movement or motion including, but not limited to, an accelerometer to detect and/or measure acceleration and a gyroscope to detect and/or measure orientation. Other types of sensors motion sensors 342 can also be used such as, but not limited to, a cadence sensor for measuring the rotational speed of a crank arm of a bicycle, a speed sensor for measuring the speed of a bike, a pedometer for measuring the number of steps taken by a user and similar sensors. It should be understood that some of these sensors may be more advantageously placed, for example, on one or more remote units 390 due to the positioning of such sensors relative to the user. For example, a cadence sensor and/or pedometer may be more advantageously placed proximate a user's feet.

The one or more physiological sensors 344 can be designed to detect and/or measure one or more physiologic parameters of the user. As such, the one or more physiological sensors 344 can include any type of sensor which can detect and/or measure such physiological parameters including, but not limited to, sensors for monitoring cardiovascular parameters such as a heart rate sensor, a blood pressure sensor, a blood sugar sensor, and a blood-oxygen and/or blood CO2 sensor, sensors for monitoring hydration levels and temperature of a user such as a perspiration sensor, a skin resistivity sensor, a hydration sensor, a dermal moisture sensor, an electrolyte sensor, and a body temperature sensor, and/or any other types of sensors, such as a lactic acid sensor and pO2 sensor. Other types of physiological sensors 344 can be used as desired. It should be understood that some of these sensors may be more advantageously placed, for example, on one or more remote units 390 due to the positioning of such sensors relative to the user. For example, a heart rate sensor may be more advantageously placed in contact with or adjacent a user's chest.

The one or more ambient or environmental sensors 346 can be designed to detect and/or measure parameters of the surrounding environment. As such, the one or more ambient or environmental sensors 346 can include any type of sensor which can detect and/or measure such parameters including, but not limited to, an air temperature sensor, an air humidity sensor, a pressure sensor, an altitude sensor (such as an altimeter), an oxygen sensor, an air quality sensor, a wind speed sensor (such as a pitot tube), a solar irradiance sensor, a proximity sensor such as a sonar device, a magnetometer, and any other sensor which can detect parameters of the surrounding environment. In some embodiments, the ambient or environmental sensor 346 can include a range finder which can detect a distance to an object.

In some embodiments, the modular unit 380 and/or remote unit 390 can include sensor systems 383, 393 having components, features and/or functionality similar to that described above in connection with sensor system 340. In some embodiments, the helmet unit 310 can omit one or more components of the sensor system 340 such that a user can provide such components with sensor systems 383, 393. For example, the helmet unit 310 can omit the motion sensor 342, physiological sensor 344 and/or ambient or environmental sensor 346 thereby allowing the user to supply one or more of such components by connecting the helmet unit 310 with a modular unit 380 and/or remote unit 390 via a wired connection and/or wirelessly. In some embodiments, a heart rate sensor, gyroscope, accelerometer and/or magnetometer can be provided on a modular unit 380 and/or remote unit 390. Of course, the helmet unit 310 can include components which overlap with those of the sensor systems 383, 393 of the modular unit 380 and/or remote unit 390. This can advantageously supplement and/or enhance the functionality of the sensor system 340. For example, the helmet unit 310 can be provided with an accelerometer, gyroscope, and a modular unit 380 can be provided with a heart rate sensor and a remote unit 390 can be provided with a cadence sensor. In some embodiments, one or more components of the sensor systems 383, 393 of the modular unit 380 and/or remote unit 390 can be omitted.

Input/Output (I/O) System

The helmet unit 310 of the system 300 can include an I/O system 350 which can interface with one or more modular units 380 and/or one or more remote units 390. As shown in the illustrated embodiment, the I/O system 350 can include a wireless system 152 as well as one or more wired connections 358, such as ports and/or connectors, for removable mechanical and/or electrical coupling with another device such as one or more modular units 380. As shown in the illustrated embodiment of FIG. 3, the helmet unit 310, the modular unit 380, and/or the remote unit 390 can each communicate with each other such that the units 310, 380, 390 can receive communications from and/or send communications to each other. For example, each of the respective input systems of each of the helmet unit 310, the modular unit 380, and/or the remote unit 390 can receive communications from each of the respective output systems of each of the helmet unit 310, the modular unit 380, and/or the remote unit 390; and each of the respective output systems of each of the helmet unit 310, the modular unit 380, and/or the remote unit 390 can send communications to each of the respective input systems of each of the helmet unit 310, the modular unit 380, and/or remote unit 390.

The wireless system 352 can include one or more receivers 354 to receive wireless signals from another device such as one or more remote units 390 and one or more transmitters 356 to send wireless signals to another device such as one or more remote units 390. The wireless system 352 can include one or more transceivers which can perform both functions. The one or more receivers 354, one or more transmitters 356, and/or one or more transceivers can include one or more antennas. The one or more antennas can be configured to receive one or more electronic signals including, but not limited to, Bluetooth, Bluetooth Low Energy (Bluetooth Smart), ANT, ANT+, ZigBee, Wi-Fi, GSM, CDMA, MMS, and/or any other type of signal. The one or more antennas can be positioned on any portion of the helmet unit 310. In some embodiments, the antennas can be positioned along bottom, top, outer, and/or inner surfaces of any portion of the helmet unit 310. In some embodiments, the antennas can be positioned along interior and/or exterior surfaces of the helmet unit 310. The one or more antennas can include movable antennas. For example, in some embodiments the movable antenna can be an articulating antenna which is coupled to the helmet unit.

The one or more receivers 354 and/or one or more transmitters 356 can be designed to wirelessly communicate with other devices using one or more protocols. For example, the receiver 354 and/or transmitter 356 can include protocols such as Bluetooth, Bluetooth Low Energy (Bluetooth Smart), ANT, ANT+, ZigBee, Wi-Fi, GSM, CDMA, and MMS. The receiver 354 can be designed such that the helmet unit 310 is viewed as an ANT+ master unit when communicating with other ANT+ devices. In some embodiments, the one or more receivers 354 and/or one or more transmitters 356 (or transceivers) can include two or more protocols such that the helmet unit 310 can advantageously be used with a wider variety of devices such as modular units 380 and/or remote units 390. In some embodiments, the one or more receivers and/or one or more transmitters (or transceivers) can utilize the two or more protocols simultaneously. In some embodiments, the receiver 354 can be designed to receive signals from a global positioning satellite (GPS). As shown in the illustrated embodiment, the wireless system 310 can be designed to wirelessly communicate with the one or more remote units 390.

The one or more wired connections 358, such as ports and/or connectors, can allow for removable mechanical and/or electrical coupling with other devices such as one or more modular units 380. The one or more wired connections 358 can be designed to be universally compatible with a variety of devices. For example, in some embodiments, the one or more wired connections 358 can include a Universal Serial Bus (USB) port and/or connector, such as USB 1.0, USB 2.0, USB 3.0, USB 3.1, and including microUSB and type-C ports and/or connectors, an IEEE 1394 (FireWire) port and/or connector, an Ethernet port and/or connector, a Thunderbolt port and/or connector, a Displayport port and/or connector, a DVI port and/or connector, an HDMI port and/or connector, an optical port and/or connector, a coaxial port and/or connector, and/or other ports and/or connectors. In some embodiments, the one or more wired connections 358 can have different mechanical and/or electrical connectors to allow for an even wider range of devices to be used. For example, a first wired connection 358 can be a USB 3.0 port or connector whereas a second wired connection 358 can be a Thunderbolt port or connector. As shown in the illustrated embodiment, the one or more wired connections 358 can be designed to mechanically and/or electrically couple with the one or more modular units 380. The wired connections 358 can be positioned on any portion of the helmet unit 310. In some embodiments, the wired connections 358 can be positioned along bottom, top, outer, and/or inner surfaces of any portion of the helmet unit 310. In some embodiments, the wired connections 358 can be positioned along interior and/or exterior surfaces of the helmet unit 310.

The one or more modular units 380 can have different shapes, appearances, features, and/or functionality, but the modular units 380 can include generally the same mechanical and/or electric connectors to wired connections 358 to enable interchangeability. In some embodiments, a vendor can provide a selection (simultaneously or over time) of a plurality of different interchangeable modular units 380 with multiple different shapes, sizes, and/or colors, and/or with different features and/or functionality. In this way, a user can purchase different modular units 380 to customize the user's system 300, to upgrade the user's system 300, and/or to replace broken or damaged components in the user's system 300. In some embodiments where the modular unit 380 includes a universally compatible wired connection, such as a USB connector, the modular unit 380 can be connected to other devices which have a similar connector. For example, the modular unit 380 could be attached to devices such as, but not limited to, a computer, a smartphone, an audio/video player, and a vehicle entertainment system. In some embodiments, each or all of the modular units 380 can be standalone devices which can be removed from the helmet unit 310 and function separately from the helmet unit 310 or any other electronic devices.

In some embodiments, the modular units 380 are mounted in close proximity to the helmet unit 310. The helmet unit 310 and modular unit 380 can be coupled to form a relatively compact, combined unit. This can be particularly advantageous in many situations as this can reduce the burden on the user of the system 300. By placing both the helmet unit 310 and the modular unit 380 in an eyewear, the user need not be inconvenienced with using such remote devices.

In some embodiments, the modular unit 380 and/or remote unit 390 can include I/O systems 384, 394 having components, features and/or functionality similar to that described above in connection with I/O system 350. For example, in some embodiments, the modular unit 380 can include a wireless system having a receiver, transmitter and/or transceiver similar to that discussed in connection with I/O system 350. In some embodiments, the helmet unit 310 can omit one or more components of the I/O system 350 such that a user can provide such components with I/O systems 384, 394. For example, the helmet unit 310 can omit the wireless system 352 including the receiver 354 and/or transmitter 356, and/or wired connection 358 thereby allowing the user to supply one or more of such components by connecting the helmet unit 310 with a modular unit 380 and/or remote unit 390 having one or more of such components. In some embodiments, a port and/or connector can be provided on a modular unit 380 and/or remote unit 390 to allow additional modular units 380 to be attached to the system 300. The helmet unit 310 can include components which overlap with those of the I/O systems 384, 394 of the modular unit 380 and/or remote unit 390. This can advantageously supplement and/or enhance the functionality of the I/O system 350. For example, the helmet unit 310 can be provided with a wireless system 352 having Bluetooth and/or ANT+ protocols and the modular unit 380 can be provided with a wireless system having different protocols such as ZigBee or Wi-Fi. In some embodiments, the helmet unit 310 can be provided with no wireless system 352 and the modular unit 380 can be provided with a wireless system having one or more different protocols. This can be particularly beneficial when wireless protocols are often updated thereby reducing the likelihood that the helmet unit 310 will have an antiquated wireless protocol. In some embodiments, one or more components of the I/O systems 384, 394 of the modular unit 380 and/or remote unit 390 can be omitted.

While the input/output system 350 have been generally described as having a wireless system 352 for communication with remote units 390 and one or more wired connections 358 for communication with modular units 380, in some embodiments communications between the helmet unit 310 and one or more modular units 380 can be via the wireless system 352 and/or wired connections 358 and/or communications between the helmet unit 310 and the remote units 390 can be can be via the wireless system 352 and/or wired connections 358. In some embodiments, communications between the modular unit 380 and the remote unit 390 can be via wireless systems of input/output systems 384, 394. In some embodiments, communications between the modular unit 380 and the remote unit 390 can be via one or more wireless systems and/or wired connections of the input/output systems 384, 394.

User Interface System

The helmet unit 310 of the system 300 can include a user interface system 360 which can be designed to allow the user to operate the helmet unit 310, modular unit 380, and/or remote unit 390. As shown in the illustrated embodiment, the user interface system 360 can include one or more actuators 362 and/or one or more sensors 364.

In some embodiments, the one or more actuators 362 can include mechanical switches such as, but not limited to, toggle, rocker, button, and/or rotary switches. One or more actuators 362 can advantageously be used to provide tactile feedback when operating the switch such that the user can easily operate the device without having to view the actuators 362 directly. The actuators 362 can be used to control one or more operating parameters such as the on-off state of the helmet unit 310, modular unit 380, and/or remote unit 390, audio volume control, and/or video brightness control, etc.

In some embodiments, the one or more sensors 364 can include sensors which detect contact such as capacitive and/or resistive sensors. In some embodiments, the capacitive and/or resistive sensors can be designed to detect contact with a user's finger. For example, the user interface system 360 can include a touch screen having capacitive and/or resistive sensors on which the user can use different gestures to modify parameters of the helmet unit 310, modular unit 380 and/or remote unit 390. Such gestures can include, but are not limited to, a frontward swipe, a rearward swipe, an upward swipe, a downward swipe, one or more taps such as a double or triple tap, pressing the screen for a specific duration of time, a multiple position tap, and any combination of the above. The touch screen can be sized to fit along any portion of the helmet unit 310.

In some embodiments, the modular unit 380 and/or remote unit 390 can include user interface systems 385, 395 having components, features and/or functionality similar to that described above in connection with user interface system 360. In some embodiments, the helmet unit 310 can omit one or more components of the user interface system 360 such that a user can provide such components with user interface systems 385, 395. For example, the helmet unit 310 can omit the actuator 362 and/or sensor 364 thereby allowing the user to supply one or more of such components by connecting the helmet unit 310, via a wired connector and/or wirelessly, with a modular unit 380 and/or remote unit 390 having one or more of such components. This can be beneficial as it can allow a user to select a type of user interface that the user prefers and/or switch the type of user interface. For example, a user may find it advantageous to use a user interface having tactile buttons for certain activities and may find it more advantageous to utilize a user interface having touch capabilities for other activities. Accordingly, the user may wish to swap between a tactile button user interface with a touch user interface based on the specific activity. Of course, the helmet unit 310 can include components which overlap with those of the user interface systems 385, 395 of the modular unit 380 and/or remote unit 390. This can advantageously supplement and/or enhance the functionality of the user interface system 360. Of course, in some embodiments, one or more components of the user interface systems 385, 395 of the modular unit 380 and/or remote unit 390 can be omitted.

Power System

The helmet unit 310 of the system 300 can include a power system 370 which can be designed to provide energy to the one or more systems of the helmet unit 310, modular unit 380 and/or remote unit 390. As shown in the illustrated embodiment, the power system 370 can include an energy storage component 372 and/or an energy generation component 374.

The energy storage component 372 can be a device designed to store energy for use with the helmet unit 310, modular unit 380 and/or remote unit 390. For example, the energy storage component 372 can be a battery device such as primary cell (non-rechargeable) and/or a secondary cell (rechargeable) such as, but not limited to, a Li-ion battery, LiPo battery, NiCad battery, and Ni-MH battery. The battery device can be designed to provide between about 50 mAh to about 500 mAh, about 150 mAh and/or any other energy storage capacity as desired. In some embodiments, the energy storage component 372 can be a capacitor, fuel cell, or other device which can store energy for later use.

The energy generation component 374 can be a device designed to generate energy from another source. The energy generation component 374 can be a device designed to convert kinetic energy, solar energy and/or thermal energy to electrical energy for powering the systems of helmet unit 310, modular unit 380 and/or remote unit 390. The energy generation component 374 can be a device designed to convert electromagnetic energy to electrical energy. In such an embodiment, the helmet unit 310, modular unit 380 and/or remote unit 390 can be wirelessly powered and charged.

In some embodiments, the modular unit 380 and/or remote unit 390 can include power systems 386, 396 having components, features and/or functionality similar to that described above in connection with power system 370. In some embodiments, the helmet unit 310 can omit one or more components of the power system 370 such that a user can provide such components with power systems 386, 396. For example, the helmet unit 310 can omit the energy storage component 372 and/or energy generation component 374 thereby allowing the user to supply one or more of such components by connecting the helmet unit 310 with a modular unit 380 via a wired connection and/or wirelessly. In some embodiments, the modular unit 380 can be provided with an energy storage component such as a battery. The helmet unit 310 can include components which overlap with those of the power systems 386, 396 of the modular unit 380 and/or remote unit 390. This can advantageously supplement and/or enhance the functionality of the power system 370. For example, the modular unit 380 can include an energy storage component to supplement the energy storage component 372 of the helmet unit 310 thereby increasing the duration of operation of the helmet unit 310, modular unit 380 and/or remote unit 390. In some embodiments, one or more components of the power systems 386, 396 of the modular unit 380 and/or remote unit 390 can be omitted.

Brim and Eyewear for a Sports Helmet with Modular Components

FIGS. 4-8C illustrate example embodiments of eyewear adapters, such as brims, that are configured to integrate eyewear with a sports helmet. Some embodiments of the eyewear adapters integrate the eyewear with the helmet by attaching to the helmet and interfacing with the eyewear. As used herein, the eyewear adapter is said to interface with the eyewear where the eyewear adapter is in contact with the eyewear, is adjacent to the eyewear, or is in proximity to the eyewear (e.g., a contour of the eyewear adapter is less than or equal 0.5 inches away from a top portion of the eyewear). In some implementations, the eyewear adapter is said to interface with the eyewear where the eyewear adapter is attached to the eyewear. The eyewear adapter is configured such that, in use, the eyewear adapter enhances the fit or function of the eyewear to provide, in the combination of the helmet and eyewear, one or more functional advantages. These functional advantages can include, for example and without limitation, improved air flow across or through portions of the helmet and eyewear, improved aerodynamics of the helmet, improved sweat control, improved fit, or improved securing of the eyewear to or on or in the helmet. These functional advantages represent an improvement compared to the use of the helmet and the eyewear without the eyewear adapter. The brims can also be configured to provide at least two functions including improved aerodynamics and occupying or reducing space between eyewear and the helmet. The brim can be configured to move relative to the helmet and/or relative to the eyewear to provide the ability to match eyewear to the helmet and/or to compensate for anatomical differences between wearers.

Figure 4:
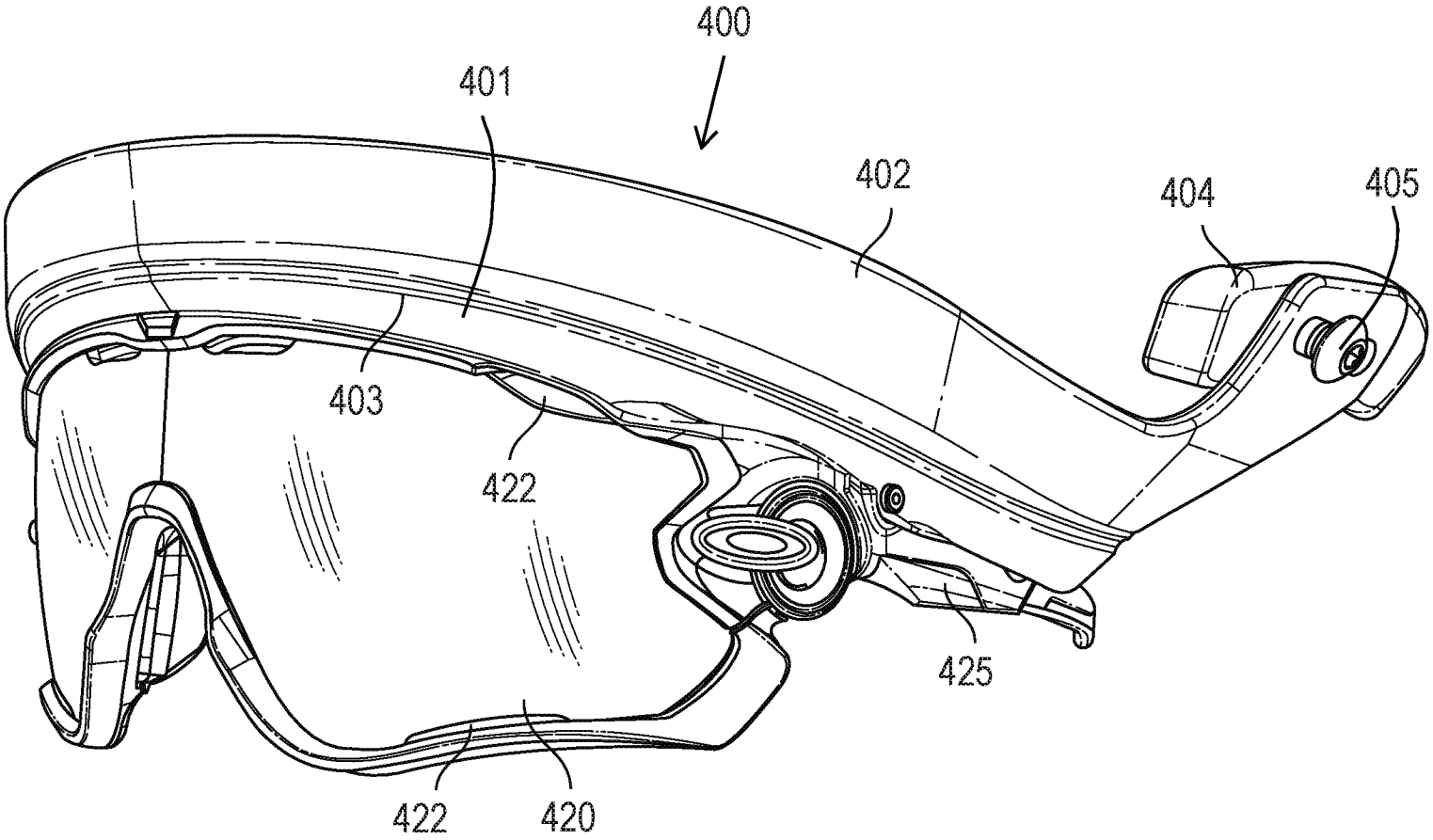
FIG. 4 illustrates an eyewear adapter comprising a top portion and a flexible bottom portion, the brim configured to interface with eyewear.

FIG. 4 illustrates an eyewear adapter 400 (e.g., a brim) comprising a top portion 402 and a bottom portion 401. The top portion 402 of the eyewear adapter 400 can be made of a rigid material. The bottom portion 401 of the eyewear adapter 400 can be made of a flexible material. In some embodiments, the eyewear adapter 400 includes a channel 403 in the bottom portion to increase flexibility of the bottom portion 401. The bottom portion 401 of the eyewear adapter 400 can be configured to contact a top portion of eyewear 420. In certain implementations, the bottom portion 401 of the eyewear adapter 400 can be configured to contact at least a portion of the earstems 425. The eyewear adapter 400 can be considered to float above or on the eyewear 420 (as opposed to attaching to the eyewear). In this way, the eyewear adapter 400 interfaces with the eyewear 420 to integrate the eyewear with a helmet. The eyewear adapter 400 can be configured to connect to a helmet using pads 404. The fastener 405 can be used to control the friction between the eyewear adapter 400 and the pad 404. For example, the fastener 405 can be used to create a relatively high frictional force between the eyewear adapter 400 and the pads 404 so that the brim remains substantially fixed with respect to the pads 404. In use, this may cause the brim to remain relatively stationary with respect to the helmet. As another example, the fastener 405 can be used to create a relatively low frictional force between the eyewear adapter 400 and the pads 404 so that the brim can move with respect to the pads 404. In use, this may cause the brim to remain in contact with the eyewear. The fasteners 505 may be any appropriate fastener, such as a screw, clip, clamp, or the like. The flexible material in the bottom portion 401 of the eyewear adapter 400 may advantageously reduce the forces on the nose of the wearer when the brim and/or helmet move downward on the head of the wearer. In some embodiments, the eyewear includes venting holes 422 to pass air through the eyewear 420 to provide temperature management functionality and/or anti-fog functionality by passing air between the wearer and the inner surface of the eyewear 420.

Figure 5:
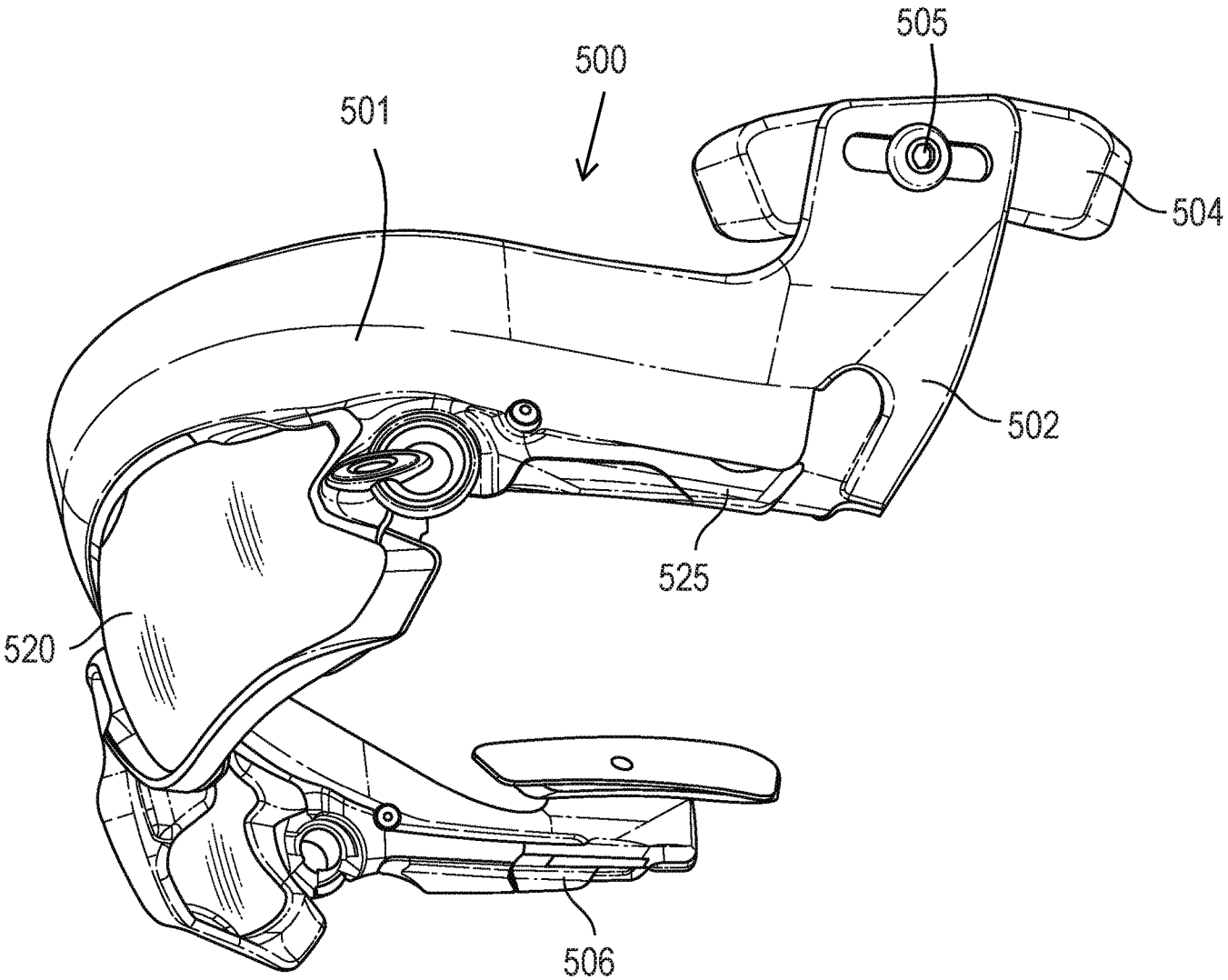
FIG. 5 illustrates an eyewear adapter comprising a top portion and a flexible bottom portion, the brim configured to attach to eyewear.

FIG. 5 illustrates an eyewear adapter 500 that is configured to attach to eyewear 520. Similar to the eyewear adapter 400 described with reference to FIG. 4, the eyewear adapter 500 includes a top portion 502 and a bottom portion 501 and is attached to pads 504 with fastener 505. The eyewear adapter module 500 attaches to the eyewear 520 at the earstems 525 using attachment clip 506. In some embodiments, the earstems 525 can be configured to specifically to attach to the eyewear adapter 500. In some embodiments, the earstems 525 of the eyewear are interchangeable between standard earstems and the earstems 525 configured to attach to the eyewear adapter 500.

In some embodiments, the distal ends of the earstems 525 can be adjusted on the eyewear adapter 500 to adjust the length of the earstem 525. This can be done to customize the fit for the wearer. In some embodiments, the eyewear adapter 500 cooperates with the pads 504 to adjust the orientation and/or position of the eyewear 520 to compensate for anatomical differences between wearers. Similar to the eyewear adapter 400 described herein with reference to FIG. 4, the fastener 505 can be adjusted to tighten or loosen the coupling between the eyewear adapter 500 and the pads 504 to restrict or allow movement of the eyewear adapter 500 relative to a helmet to which it is attached. Because the eyewear adapter 500 is attached to the eyewear 520, this results in the eyewear adapter 500 and eyewear 520 either being substantially fixed with respect to the helmet (e.g., when the fasteners 505 are tightened) or being able to move with respect to the helmet (e.g., when the fasteners 505 are loosened). The fasteners 505 may be any appropriate fastener, such as a screw, clip, clamp, or the like.

Figure 6:
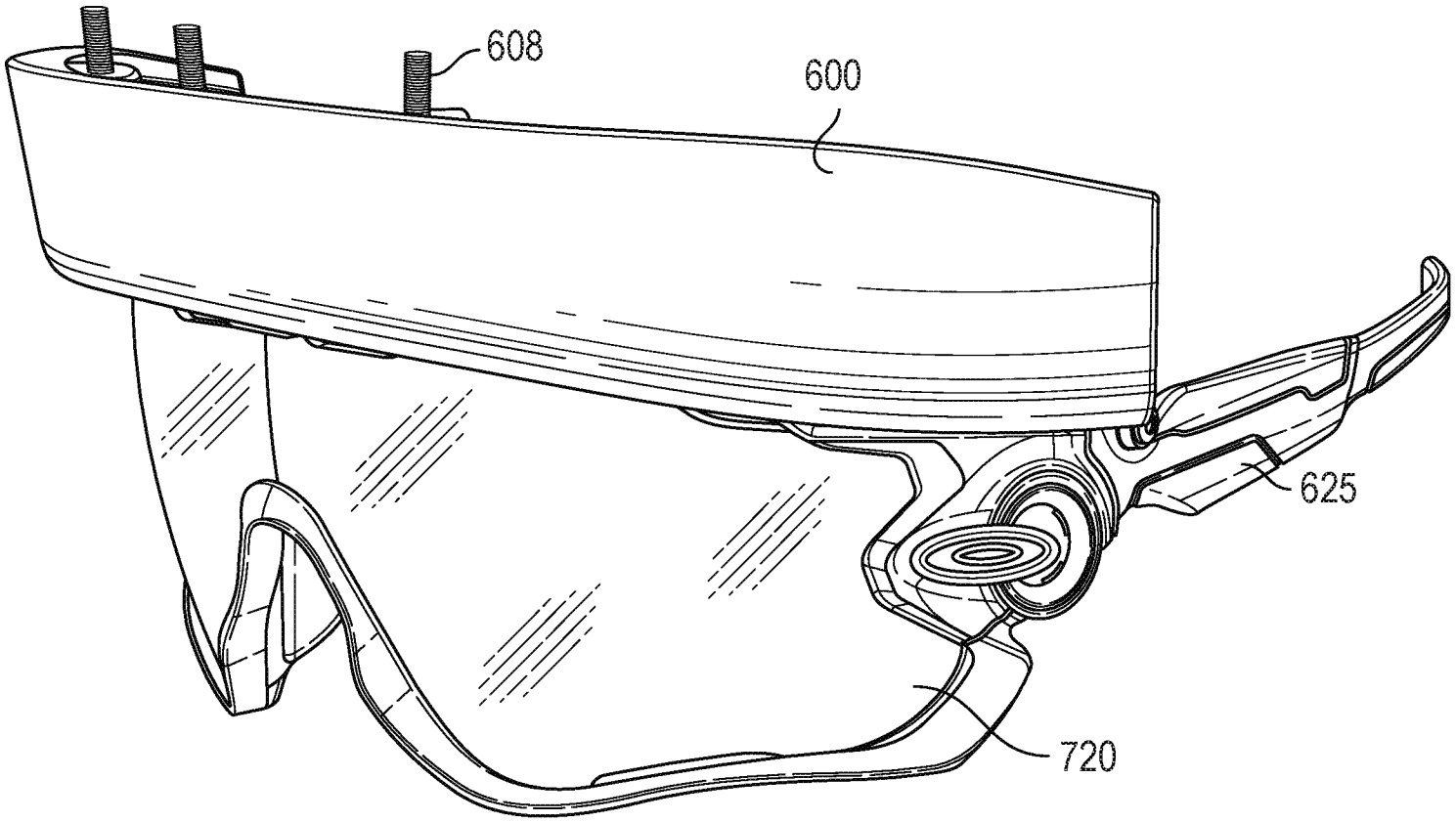
FIG. 6 illustrates an eyewear adapter comprising a rigid or flexible brim that attaches to a helmet, the eyewear adapter configured to be positioned forward of eyewear.

FIG. 6 illustrates an eyewear adapter 600 comprising a rigid or flexible brim that attaches to a helmet using fasteners 608. The fasteners 608 may be any appropriate fastener, such as a screw, clip, clamp, magnets, tongue and groove connection, or the like. The fasteners 608 of the eyewear adapter 600 may be configured to allow the eyewear adapter 600 to move relative to the helmet or may fix the eyewear adapter 600 to the helmet so that there is no relative movement. In some embodiments, the eyewear adapter 600 is attached to the helmet using rigid or floating side mounts, similar to those described with respect to FIGS. 4 and 5.

The eyewear adapter 600 can be configured to be positioned forward of the eyewear 620 when attached to the helmet. Accordingly, the eyewear adapter 600 can be configured to not contact the eyewear 620 while still closing the gap between the top of the eyewear 620 and the helmet. The eyewear adapter 600 can be configured to push wind away from the wearer. In some embodiments, the eyewear adapter 600 includes vents for selectively passing air through the eyewear adapter 600. In certain implementations, the vents may be able to be opened and closed as the wearer desires. In some embodiments, the eyewear adapter 600 is made of a material that is at least partially transparent to allow the wearer to see through the eyewear adapter 600. This may be beneficial when the wearer desires to look over the eyewear 620 because then the eyewear adapter 600 would not significantly obstruct the vision of the wearer.

Figure 7A:
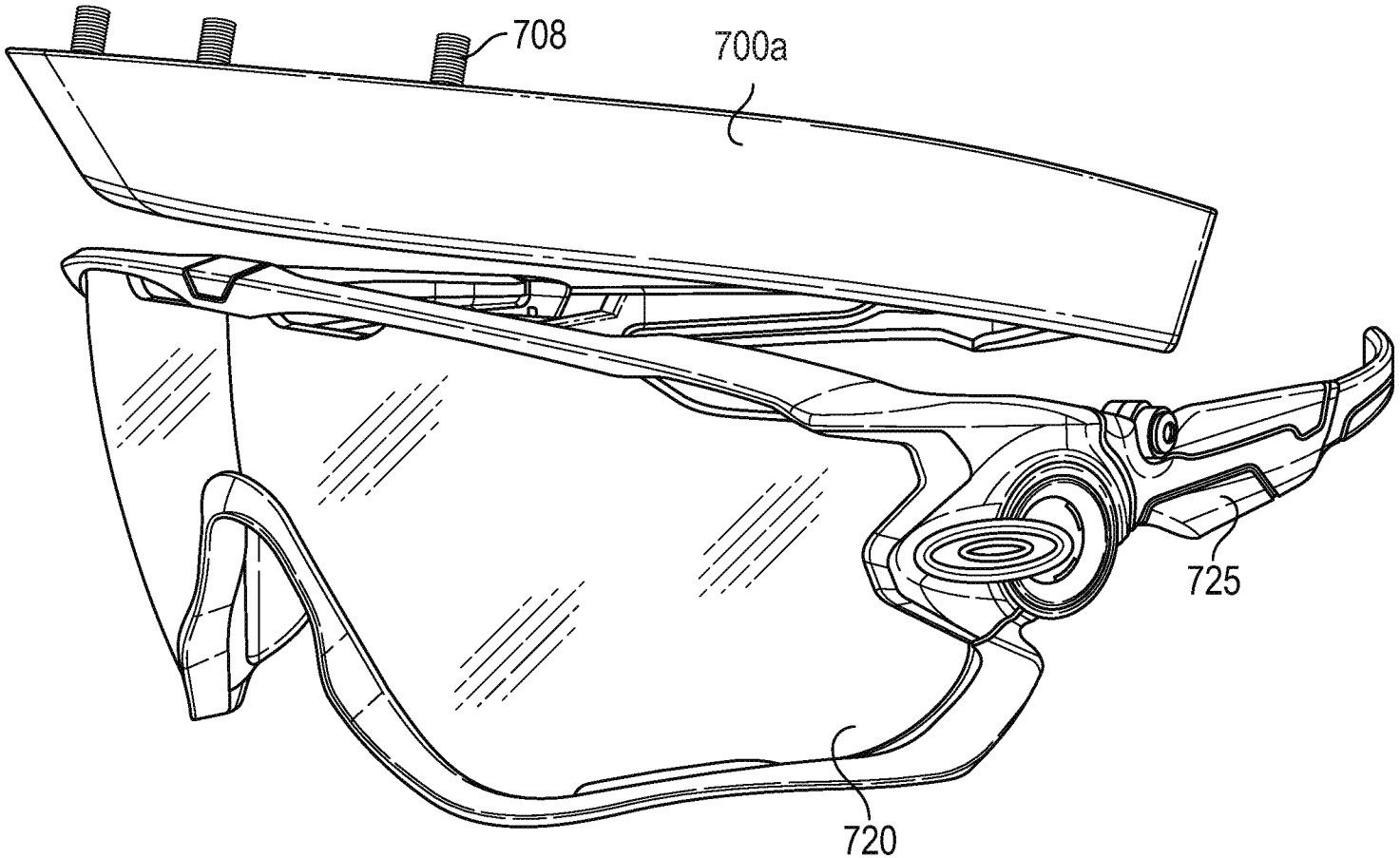
FIGS. 7A and 7B illustrate eyewear adapters comprising a rigid or flexible brim that attaches to a helmet, the eyewear adapter configured to be positioned rearward of eyewear.
Figure 7B:
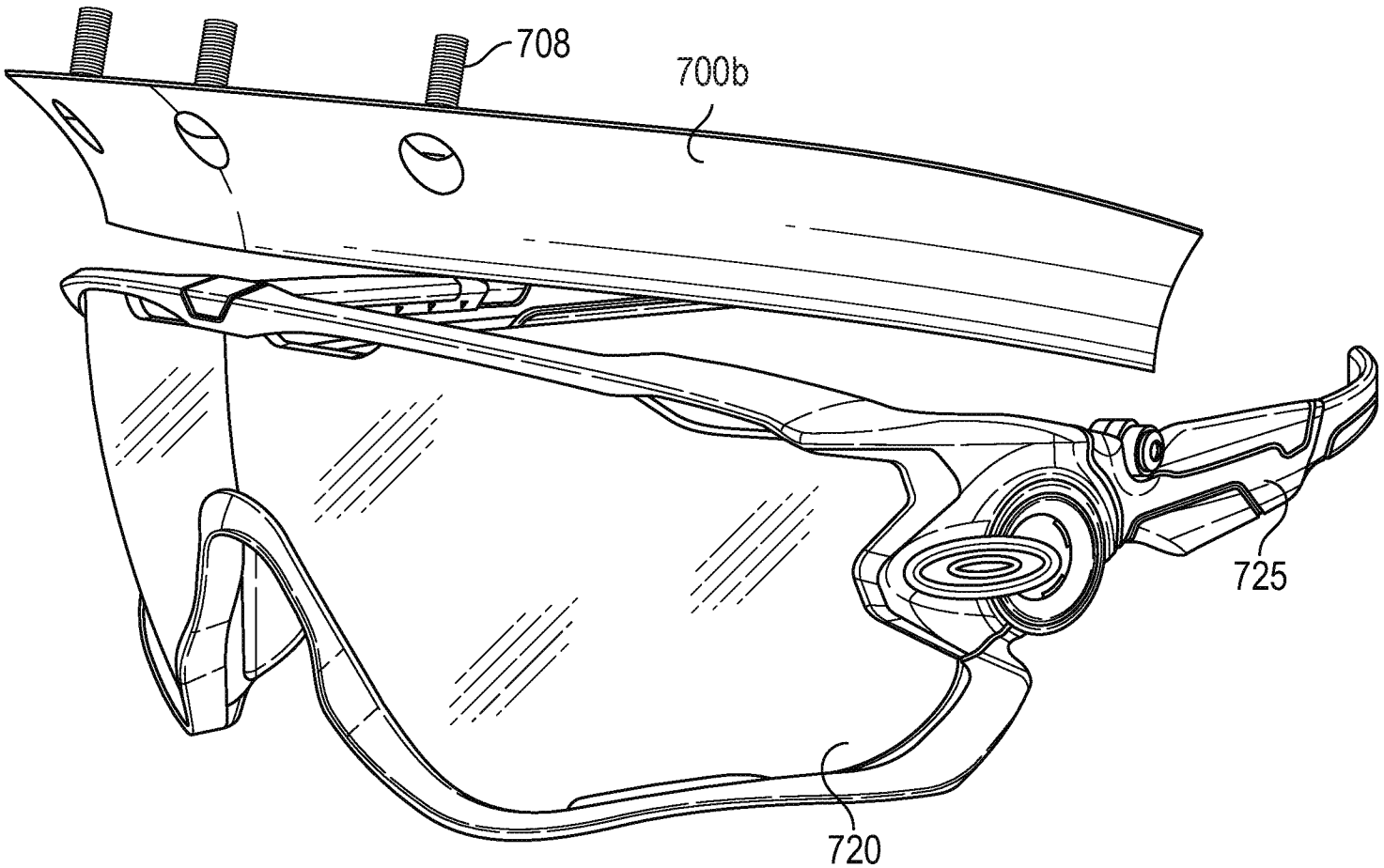

FIGS. 7A and 7B illustrate eyewear adapters 700*a*, 700*b* that are similar to the eyewear adapter 600 described herein with reference to FIG. 6, except that the eyewear adapters 700*a*, 700*b* are configured to sit behind the eyewear 720. This can advantageously direct wind down the face of the wearer, such as between the eyewear 720 and the wearer's face. This can increase air flow on the wearer's face providing temperature management benefits. This may also decrease fogging on the interior surface of the eyewear 720. Similar to the eyewear adapter 600, the eyewear adapters 700*a*, 700*b* may be transparent. Also similar to the eyewear adapter 600, the fasteners 708 of the eyewear adapters 700*a*, 700*b* may be configured to allow the eyewear adapter 700*a*, 700*b* to move relative to the helmet or may fix the eyewear adapter 700*a*, 700*b* to the helmet so that there is no relative movement. In some embodiments, the eyewear adapters 700*a*, 700*b* are attached to the helmet using rigid or floating side mounts, similar to those described with respect to FIGS. 4 and 5.

In some embodiments, the eyewear adapter 700*b* may differ from the eyewear adapter 700*a* in that the eyewear adapter 700*b* may be configured to contact a rear portion of a frame of the eyewear 720. This can advantageously increase the anti-fogging functionality provided by the eyewear adapter 700*b*, for example.

Figure 8A:
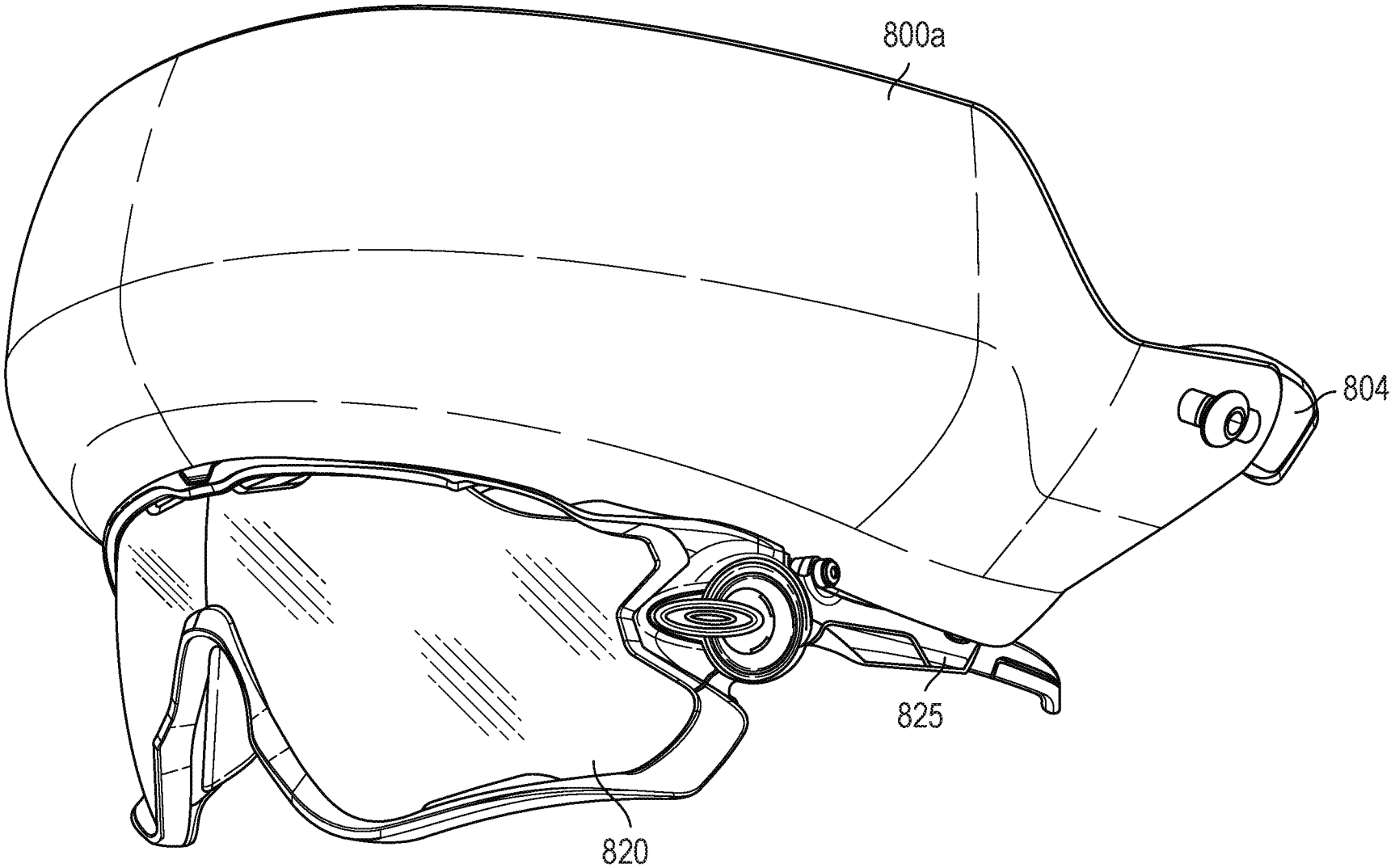
FIGS. 8A-8C illustrate eyewear adapters that are configured to cover one or more vents on a front portion of a helmet.
Figure 8B:
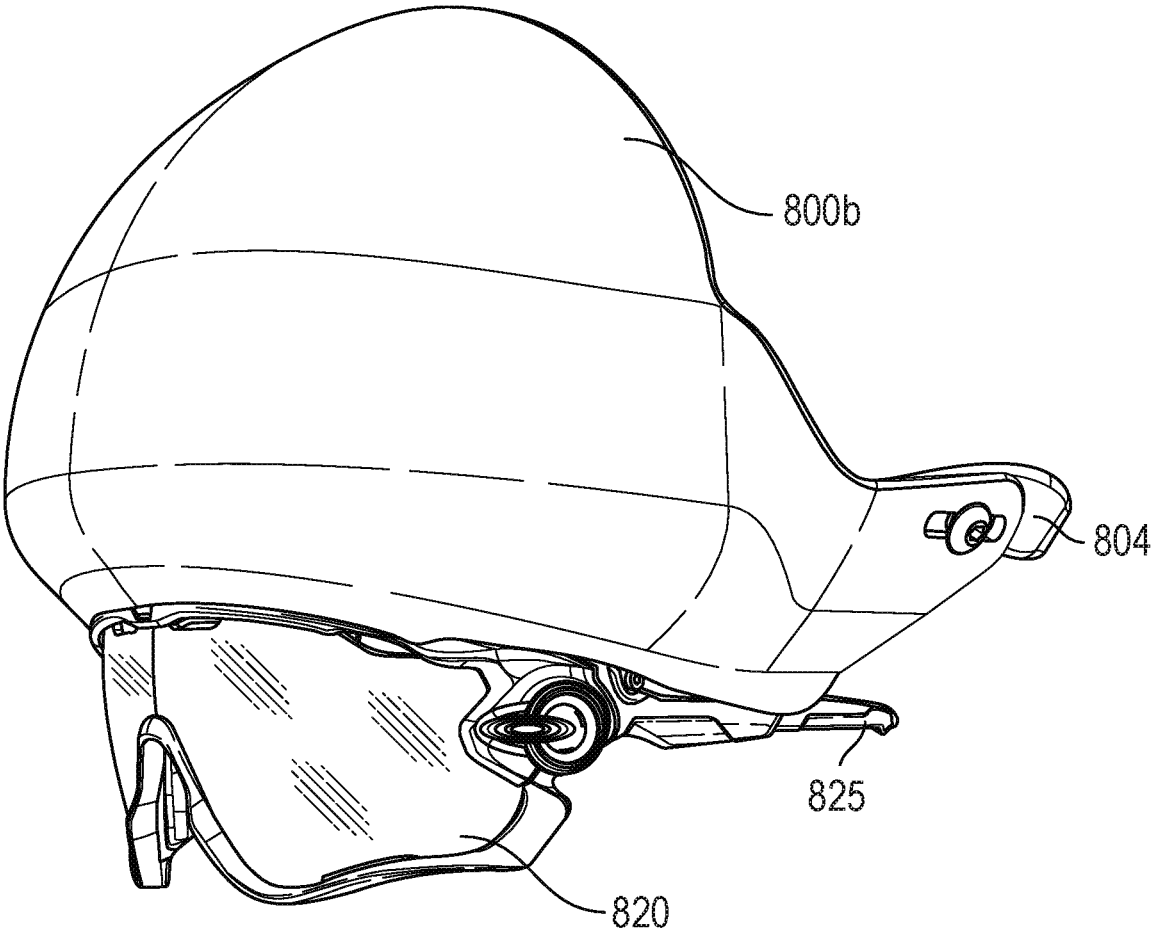
Figure 8C:
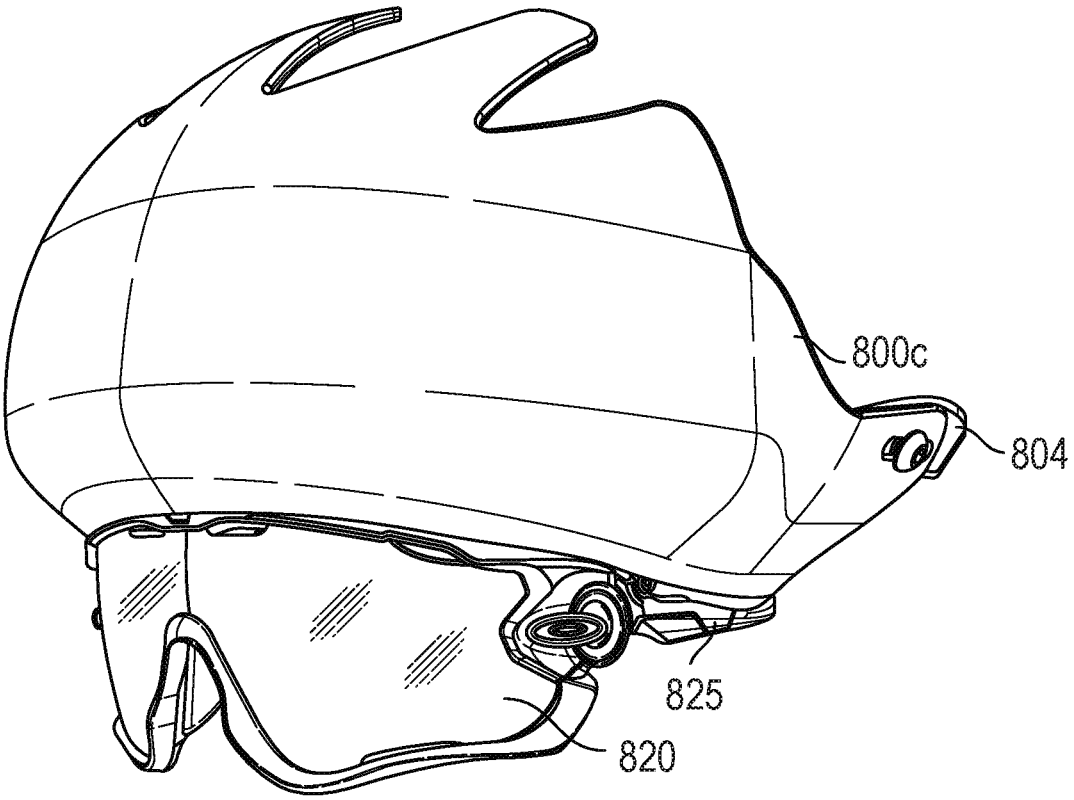

FIGS. 8A-8C illustrate eyewear adapters 800*a*-800*c* that are configured to cover one or more vents on a front portion of a helmet. The different coverages provided by the eyewear adapters 800*a*-800*c* can be used to provide different levels of vent coverage and/or aerodynamic benefits. The eyewear adapters 800*a*-800*c* can be configured to include any one or more of the features of the other eyewear adapters described herein with reference to FIGS. 4-7B.

Figure 9A:
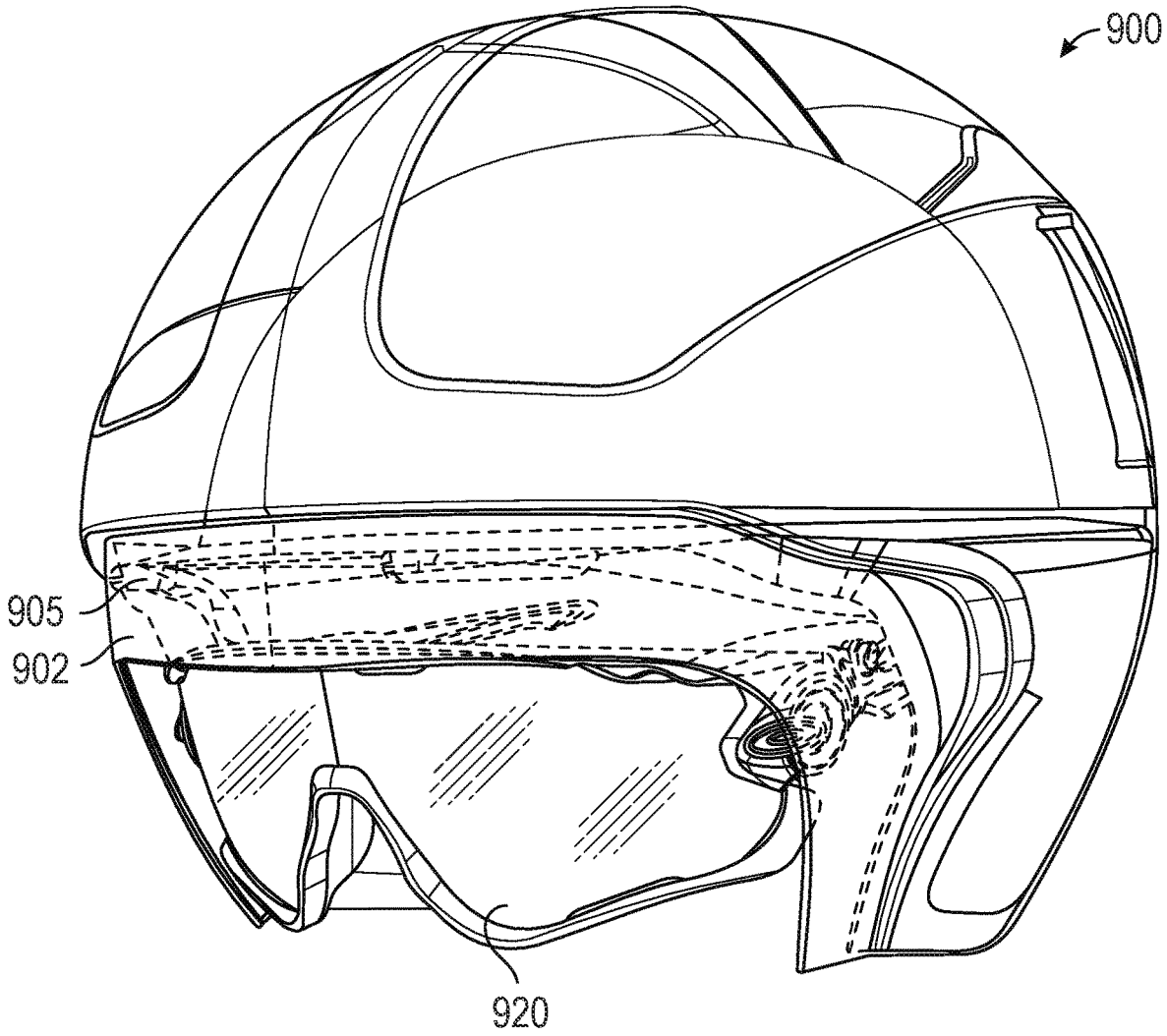
FIGS. 9A and 9B illustrate a helmet configured to switch between using a full visor and a partial visor with eyewear.
Figure 9B:
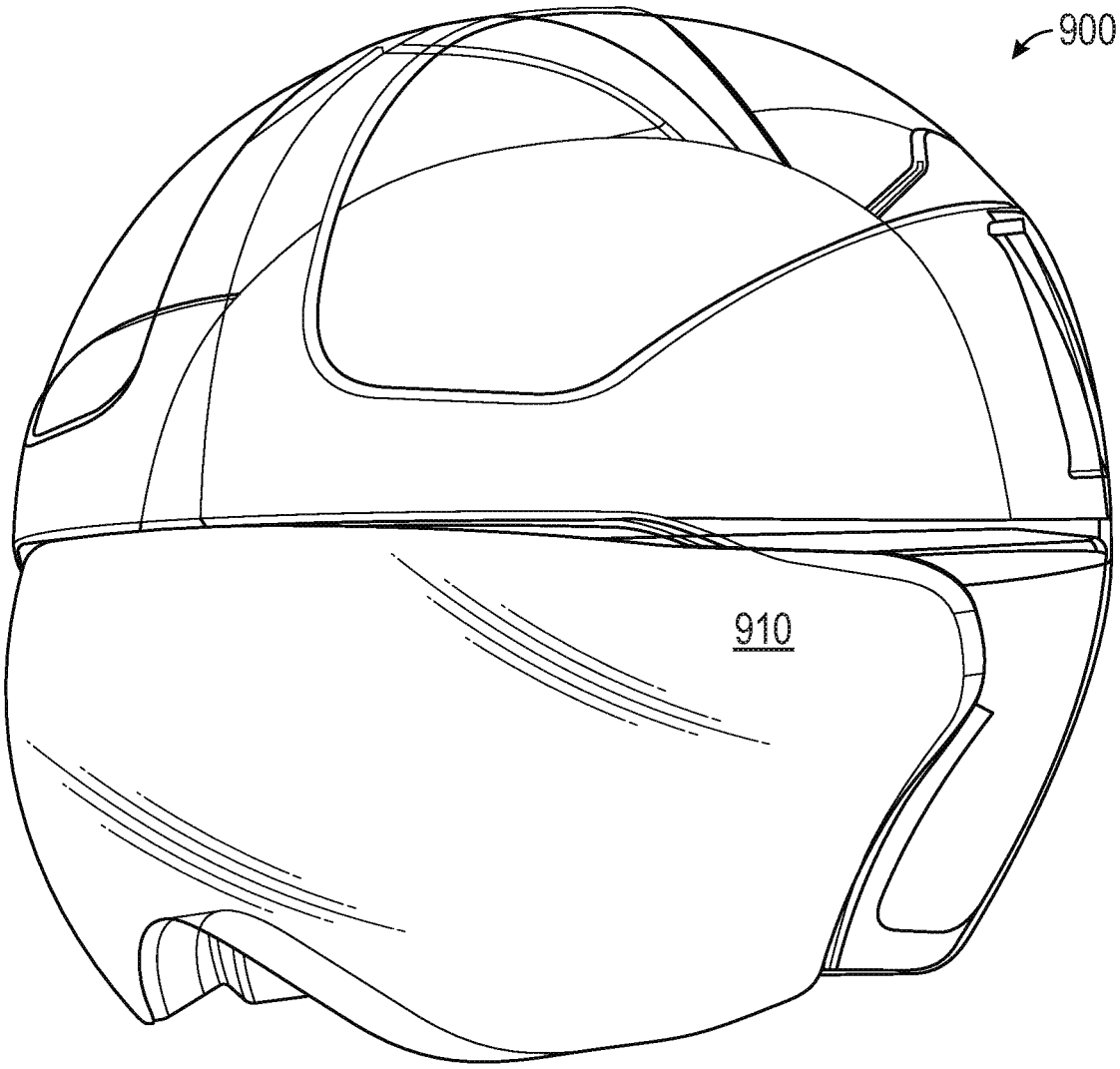

FIGS. 9A-9B illustrate a helmet 900 configured to switch between using a full visor 910 and a partial visor 902 with eyewear 920. As illustrated, the partial visor 902 comprises a transparent portion that a wearer may see through. This complements the eyewear 920, allowing the user to have a large field of view when using eyewear 920. In some embodiments, the partial visor can include air vents 905 to provide air management through the visor 902. The partial visor 902 can be removed from the helmet 900 and replaced with a full visor 910. This allows the wearer to adjust the properties of the helmet 900 based on the intended use of the helmet.

Sports Helmet with Modular Attachment Having Stem Tunnels

Figure 10:
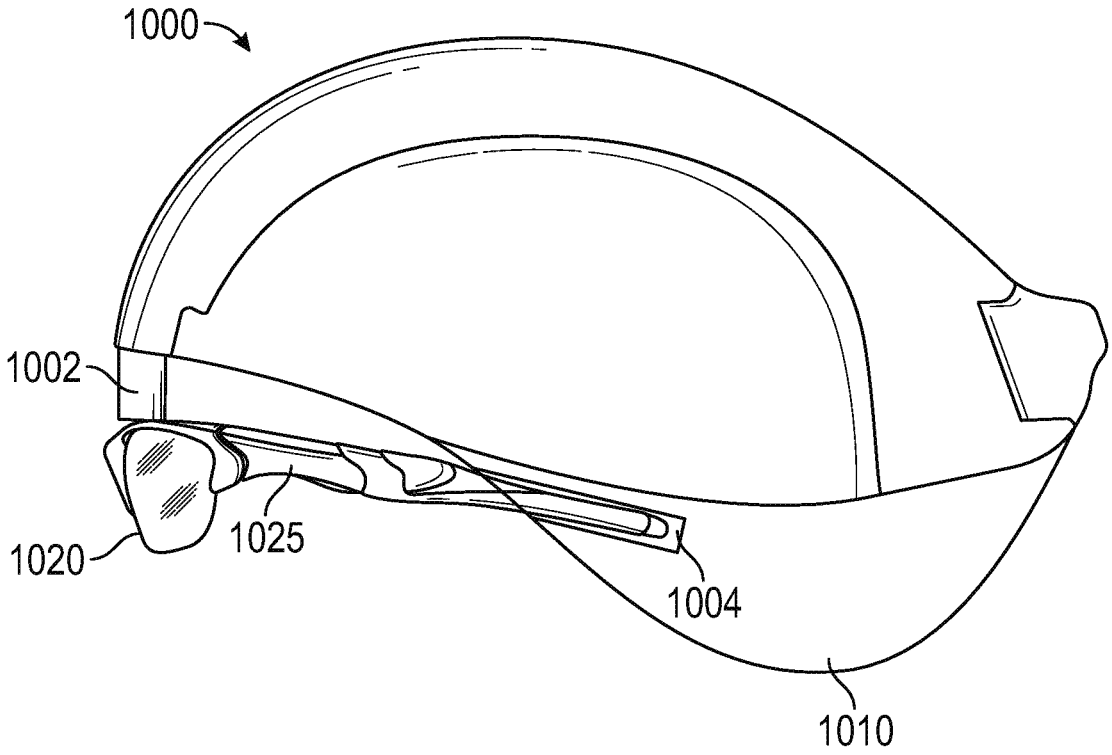
FIG. 10 illustrates a helmet having a modular attachment with stem tunnels to receive earstems of eyewear.

FIG. 10 illustrates a helmet 1000 having a modular attachment 1010 with stem tunnels 1004 to receive earstems 1025 of eyewear 1020. The helmet 100 can include a brim 1002 and the modular attachment 1010 with the stem tunnels 1004 can provide a way to adjust the earstems relative to the face of the wearer to position the eyewear 1020. In some embodiments, the stem tunnels 1004 can be configured to provide a frictional force on the earstems 1025 to cause the eyewear to remain substantially fixed in position.

Sports Helmet with Modular Components

Figure 11A:
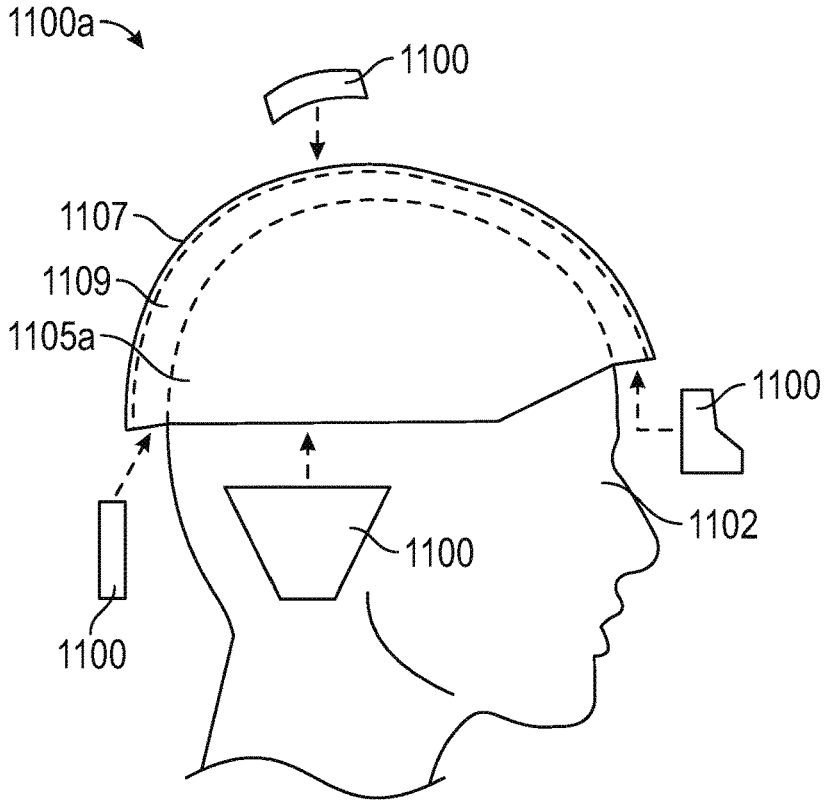
FIGS. 11A and 11B illustrate a modular sports helmet having a base portion configured to protect a portion of a user's head.
Figure 11B:
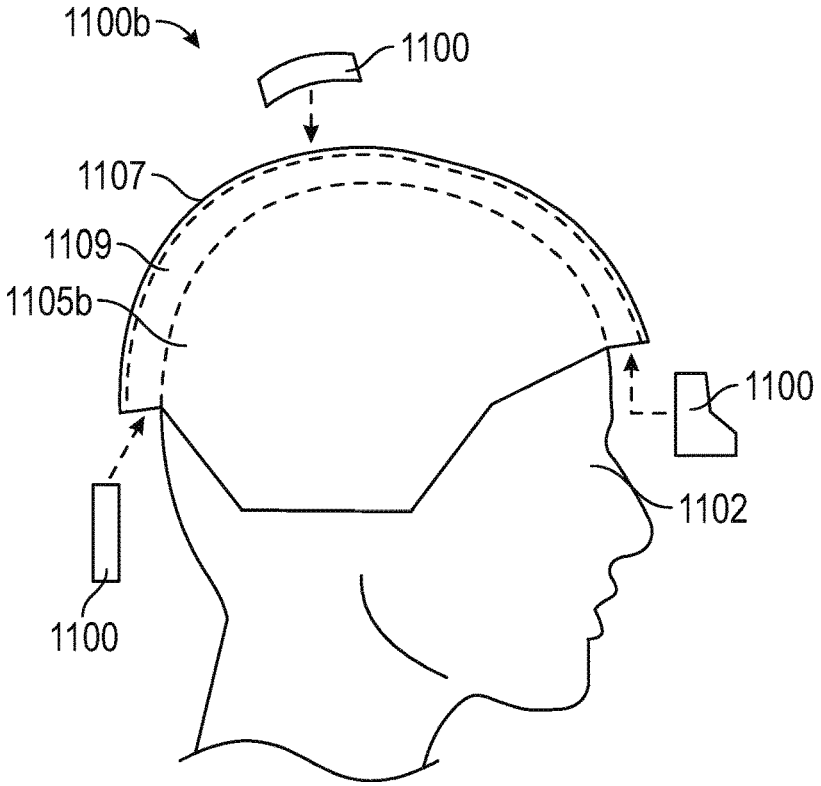

FIGS. 11A and 11B illustrate example modular sports helmets 1100*a*, 1100*b* having a base portion 1105*a*, 1105*b* configured to protect a portion of a user's head 1102. The base portion 1105*a*, 1105*b* can be configured to provide different coverage based at least in part on the intended activity, safety regulations or standards, aesthetic considerations, or the like. The base portion 1105*a*, 1105*b* can be configured to receive one or more modules 1110 to extend or enhance the capabilities or features of the helmet 1100*a*, 1100*b*. The modules 1110 can be attached or otherwise added to a periphery of the base portion 1105*a*, 1105*b*, to an exterior surface of the base portion 1105*a*, 1105*b*, to an interior surface of the base portion 1105*a*, 1105*b*, or the modules 1110 can be attached to any combination of these parts of the base portion 1105*a*, 1105*b*.

Figure 12:
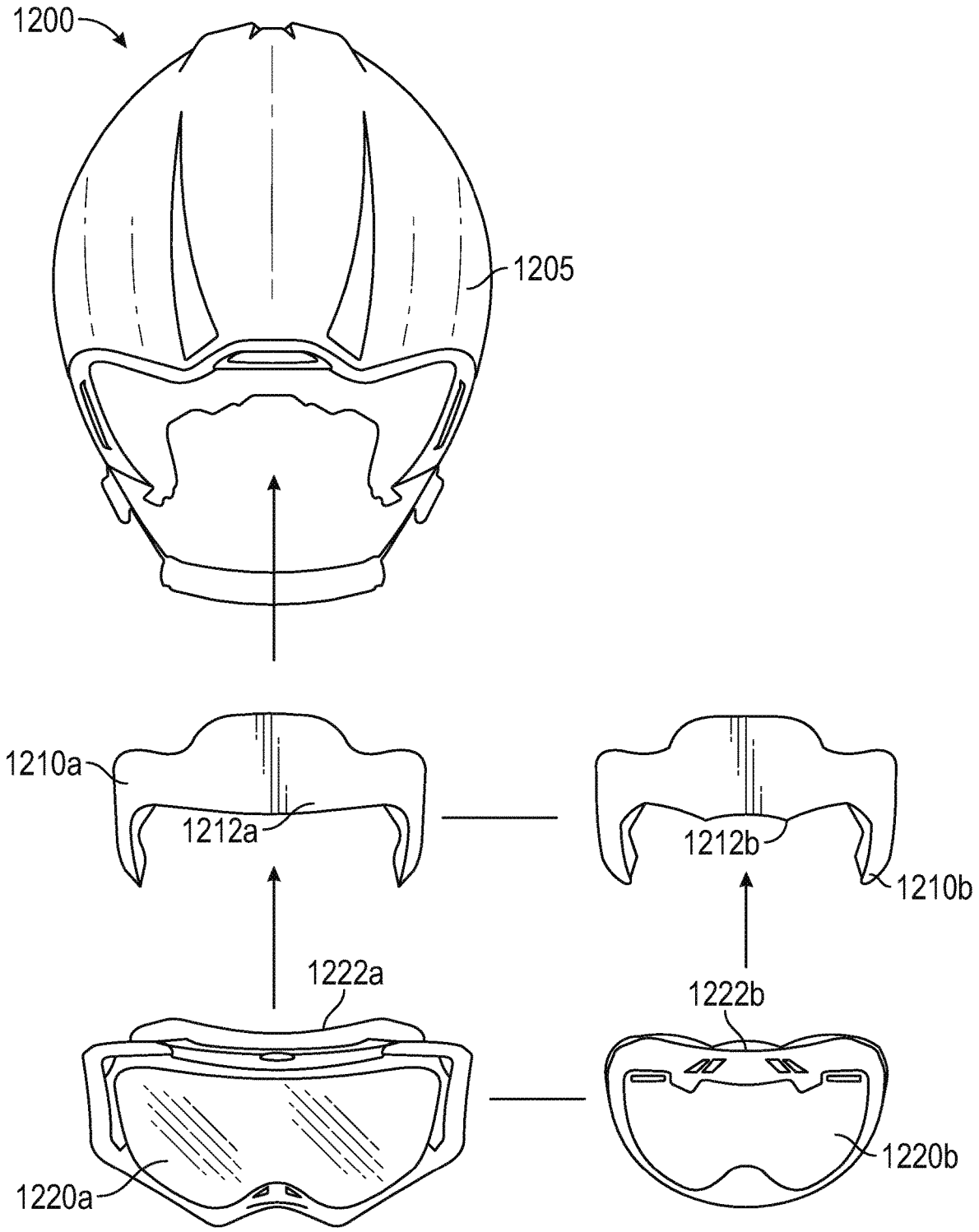
FIG. 12 illustrates an example modular helmet having two eyewear adapter modules configured to attach to the modular helmet and to be compatible with two different eyewear.

As an example, FIG. 12 illustrates an example modular helmet 1200 having a base portion 1205 and two eyewear adapter modules 1210*a*, 1210*b* configured to attach to the base portion 1205, the two eyewear adapter modules 1210*a*, 1210*b* tailored for different eyewear 1220*a*, 1220*b*. The first eyewear adapter module 1210*a* can be configured to be tailored for the first eyewear 1220*a* and the second eyewear adapter module 1210*b* can be configured to be tailored for the second eyewear 1220*b*. This can allow a user to switch between different eyewear without switching helmets. As used herein, an eyewear adapter module can be considered to be tailored for eyewear when the eyewear adapter module, helmet, and eyewear combine to provide a tailored aesthetic appearance, a tailored fit, tailored functionality (e.g., venting), or the like. For example, an eyewear adapter module can be said to be tailored for eyewear when a contour of the eyewear adapter module is complementary to a corresponding contour of the eyewear. For example, an eyewear adapter module can be configured to reduce a gap between a helmet (including the eyewear adapter module) and a top portion of eyewear to less than or equal to about 0.5 inches, to less than or equal to about 0.25 inches, to less than or equal to about 0.125 inches, or the eyewear adapter module can be in contact with the top portion of the eyewear along a majority of the top portion of the eyewear. An eyewear adapter module may also be tailored for eyewear where the eyewear and the eyewear adapter module cooperate to provide enhanced functionality such as ventilation, anti-fogging, aerodynamics, or the like.

For example, the eyewear adapter module 1210*a* is tailored for the eyewear 1220*a* based at least in part on the contour 1212*a* of the eyewear 1210*a* matching the contour 1222*a* of the eyewear 1220*a*. This can advantageously control the flow of air around the eyewear 1220*a* as well as provide a desirable aesthetic appearance. In certain implementations, a profile of the eyewear adapter module 1210*a* can be tailored to create a substantially seamless transition between the helmet 1200 and a profile of the eyewear 1220*a*. For example, a curvature profile of the eyewear adapter module 1210*a* can provide a smooth transition from the curvature profile of the base portion 1205 to the eyewear 1220*a* wherein the eyewear adapter module 1210*a* has a base curvature that is within a tolerance of the eyewear 1220*a* and/or within a tolerance of the base portion 1205. The curvature profile can be considered along a longitudinal plane (e.g., a plane that vertically divides a head of the wearer into left and right sides), along a transverse plane (e.g., a plane that vertically divides a head of the wearer into front and back sides), a horizontal plane, or any combination of these planes. The curvature can be circular, parabolic, hyperbolic, toroidal, a progressive curve, an accelerated curve, or any other smooth curving surface. The surfaces of the base portion 1205, eyewear adapter module 1210*a*, and/or eyewear 1220*a* may also include flat portions in addition to curved portions. Matching the profiles of the helmet and eyewear can advantageously improve aerodynamics of the helmet 1200 and eyewear 1220 when worn by a user as well as provide a desirable aesthetic appearance. Matching the profiles of the helmet 1200 and the eyewear 1220*a* may also advantageously reduce the risk of injury that may occur when a wearer is sliding down a slope (e.g., after falling down) or moving rapidly through vegetation or other obstacles by reducing edges that may catch on a surface and cause an undesirable torsion on the neck of the wearer.

The eyewear adapter modules 1210*a*, 1210*b* can be designed to integrate with eyewear so that it can improve air flow, to remove gaps between the eyewear and the helmet for design and functional reasons, and to provide additional functionality to the helmet 1200. The eyewear adapter modules 1210*a*, 1210*b* can be configured to be vertically adjustable (e.g., to reduce or eliminate gaps between the eyewear and the helmet), to include adjustable vents (e.g., to integrate air flow), to reduce or to prevent eyewear bash, to reduce or to prevent undesirable nose pressure, to include an extra-long brim (e.g., for protection from sun and/or precipitation), to include LEDs or lights, to extend over the eyewear, to provide an attachment point on the helmet for eyewear (e.g., when not being worn by the user), to provide a flip-up visor, to provide a mount and/or case for a camera, to provide attachment points for eyewear (e.g., to eliminate the need for earstems or a strap on the eyewear), to provide features on the side of the eyewear adapter module to decrease or to eliminate gaps between the helmet and the sides of the eyewear, to create a secondary eyewear attachment point, and the like.

In some embodiments, the eyewear adapter modules 1210*a*, 1210*b* include electronics configured to provide additional functionality to the user of the helmet 1200, as described in greater detail herein. For example, the eyewear adapter modules 1210*a*, 1210*b* can include active cooling mechanisms such as, for example and without limitation, fans, pumps, blowers, thermoelectric devices, or the like.

The eyewear adapter module may be provided with one or more motion sensors designed to detect and/or measure movement or motion. The one or more motion sensors can include any type of sensor which can detect and/or measure such movement or motion including, but not limited to, an accelerometer to detect and/or measure acceleration and a gyroscope to detect and/or measure orientation. Other types of sensors motion sensors can also be used such as, but not limited to, a cadence sensor for measuring the rotational speed of a crank arm of a bicycle, a speed sensor for measuring the speed of a bike, a pedometer for measuring the number of steps taken by a user and similar sensors. It should be understood that some of these sensors may be more advantageously placed, for example, on different modules due to the positioning of such sensors relative to the user.

One or more physiological sensors may be provided to detect and/or measure one or more physiologic parameters of the wearer. As such, the one or more physiological sensors can include any type of sensor which can detect and/or measure such physiological parameters including, but not limited to, sensors for monitoring cardiovascular parameters such as a heart rate sensor, a blood pressure sensor, a blood sugar sensor, and a blood-oxygen sensor, sensors for monitoring hydration levels and temperature of a user such as a perspiration sensor, an electrolyte sensor, and a body temperature sensor, and/or any other types of sensors, such as a lactic acid sensor. Other types of physiological sensors can be used as desired. It should be understood that some of these sensors may be more advantageously placed, for example, on different modules due to the positioning of such sensors relative to the user.

One or more ambient or environmental sensors can be provided in the eyewear adapter module 1210*a*, 1210*b* to detect and/or measure parameters of the surrounding environment. As such, the one or more ambient or environmental sensors can include any type of sensor that can detect and/or measure such parameters including, but not limited to, an air temperature sensor, an air humidity sensor, a pressure sensor, an altitude sensor (such as an altimeter), an oxygen sensor, an air quality sensor, a wind speed sensor (such as a pitot tube), a solar irradiance sensor, a proximity sensor such as a sonar device, a magnetometer, and any other sensor which can detect parameters of the surrounding environment. In some embodiments, the ambient or environmental sensor can include a range finder which can detect a distance to an object.

Sensor data may be exported wirelessly to a remote device by way of an input/output system which can include a receiver, transmitter, and/or transceiver designed to communicate with other devices using a wireless protocol such as, but not limited to, Bluetooth, Bluetooth Low Energy (Bluetooth Smart), ANT, ANT+, ZigBee, Wi-Fi, GSM, CDMA, or MMS.

Returning to FIG. 11A, the helmet 1100*a* can include a base portion 1105*a* configured to mate with one or more modules 1110. The base portion 1105*a* can include a shell 1107 and cushioning 1109. Generally, a rigid and relatively thin shell or cap 1107 is made by injection molding (PC, ABS) or by any other appropriate means (for example, by layering of various resin-impregnated layers of fabric). The shell 1107 can be fitted with comfort and/or shock-absorbing elements in an inner layer 1109 of an expanded polystyrene (EPS), foams, fabrics, or the like. It should be understood that the base portion 1105*a* can be a unitary piece made of a uniform material. For example, the base portion 1105*a* does not necessarily include a shell 1107 in combination with cushioning 1109.

The helmet 1100*a* can be configured to provide protection through a combination of the shell 1107, which can be a hard shell, and the cushioning 1109, which can be a compressible inner liner or one or more compressible elements configured to absorb and/or distribute impact forces. The shell 1107 can be configured to provide a structural base of the helmet 1100*a*. The shell 1107 may be hard and rigid, and its outer surface may be adapted to be painted, resurfaced, or refinished, potentially to accommodate graphic elements. The cushioning 1109 can be configured to line the inside of the shell 1107 or to be placed at a plurality of locations on an interior surface of the shell 1107 to form an impact absorbing layer between the head 1102 of the wearer and the hard surface of the shell 1107. As illustrated, the shell 1107 forms the exterior surface of the helmet 1100*a*, and is contiguous with the cushioning 1109. However, the shell 1107 need not constitute the outermost layer of the helmet 1100, but may be located elsewhere to accomplish energy absorption. Similarly, one or more additional layers may be configured to be between the shell 1107 and the cushioning 1109 or one or more additional layers may be configured to be between the cushioning 1109 and the head 1102 of the wearer.

In some embodiments, the shell 1107 may be made with materials such as ABS plastic, polycarbonate plastic, or the like. However, the shell 1107 may be made of any number of plastics, energy-absorbing materials, or composite materials. Further, the physical characteristics of the shell 1107, such as flexibility, hardness, weight, and shape, may be varied to accomplish desired, selected, or targeted performance characteristics. Such variations are to be understood to fall within the scope of the present disclosure.

The cushioning 1109 can be configured to further absorb and distribute energy caused by an impact with the helmet 1100*a*. The cushioning 1109 can be configured to be more energy-absorbent than the shell 1107. The cushioning 1109 can include foam lining, one or more foam pads, one or more air pads, or any combination thereof. The cushioning 1109 may also include any apparatus or material that effectively absorbs and distributes impact energy and/or that generally cushions the user's head 1102. The cushioning 1109 can include foam lining and/or foam pads made of polystyrene foam, vinyl nitrile foam, thermoplastic urethane foam, or the like. The cushioning 1109 can include air pads that include bladders adapted to be filled with air and may be made of vinyl or a similarly flexible plastic material. In certain embodiments, the cushioning 1109 is arranged in a fixed or removable manner inside the shell 1107, for example by means of adhesives, fasteners, and/or self-gripping straps (e.g., using a hook-and-loop fastening material).

The base portion 1105*a* can include depressions or apertures in the shell 1107 and/or the cushioning 1109. Such apertures and depressions may decrease the weight of the base portion 1105*a*, enhance performance, provide elements of aesthetic design, provide air flow to the user's head 1102, enhance aerodynamic properties of the helmet 1100*a*, or may be adapted or provide other functions. For example, one or more vents can be provided on the base portion 1105*a* for cooling and/or removal of moist air. As another example, a base portion 1105*a* may be comprised of multiple depressions to increase aesthetic quality and provide a distinct visual appeal.

In some embodiments, the helmet 1100*a* may further include other features such as chin straps for securing the helmet to the wearer, passive and/or active vents in the base portion 1105*a*, a retention system for securing eyewear to the helmet 1100*a*, a contoured front opening for receiving eyewear, additional layers on or in the base portion 1105*a* for insulation and/or comfort, or the like. These features may be provided by one or more modules 1110. For example, features may be added to the helmet 1100*a* or existing features of the helmet 1100*a* can be enhanced with the addition of modules 1110, such as rear panels, ear pieces, visors, vents, earstem guides, goggle strap guides, or the like, that are releasably attached to the base portion 1105*a*. In certain implementations, the modules 1110 can provide additional areas of energy absorption, thereby potentially decreasing the incidence of injury. In some implementations, the modules 1110 can provide aesthetic and functional advantages such as an improved interface between the base portion 1105*a* and eyewear. In certain implementations, the modules 1110 can provide electronic capabilities such as LED lights, speakers, accelerometers, environmental sensors, physiological sensors, GPS, or the like.

In some embodiments, modules 1110 can be configured to be compatible with a particular base portion 1105*a*. For example, the modules 1110 can have a similar aesthetic as a compatible base portion 1105*a*. As another example, the modules 1110 can have a similar structure as a compatible base portion 1105*a*, having a similar shell 1107 and cushioning 1109 construction. As another example, the modules 1110 can include electrical connections configured to receive power from and/or to communicate with electronics in the base portion 1105*a*.

The modules 1110 can be releasably attached to the base portion 1105*a* of the helmet 1100*a* or to one another to accomplish any of several functions. A module 1110 may be releasably attached to the shell 1107, the cushioning 1109, or a combination of both using any suitable attachment mechanism. Suitable attachment mechanisms can be adapted to hold a module 1110 securely in place on the shell 1107, but to intentionally release the module 1110 with application of sufficient force or the use of an appropriate tool, and thereafter, to optionally receive the same or different module 1110, again holding it in place. The modules 1110 can be configured to break away, for example, under certain circumstances that correspond to a potential impact experienced by the wearer. For example, a ski helmet 1100*a* can include modules 1110 that are configured to break away when the wearer falls down and slides down a slope to reduce potential injuries. The modules 1110 can be attached using fasteners, adhesives, or other attachment mechanisms that are designed to fail or detach under certain sheer or impact forces. Attachment mechanisms can also include channel supports adapted to attach a module 1110 to the base portion 1105*a* or to another module 1110. The channel support members may be semi-rigid and adapted to interlock with one another upon application of sufficient force. The channel support members are further adapted to release upon subsequent applications of sufficient force. In other embodiments, attachment mechanisms can include a slide-locking mechanism, a hook and slot mechanism, a magnetic mechanism, an adhesive, or the like. It will be appreciated that, although an exhaustive list is not included herein, one skilled in the relevant art will appreciate that various attachment mechanisms may be used, all of which fall within the scope of the present disclosure. Furthermore, the attachment mechanisms can be designed to detach under targeted or selected conditions to reduce the potential of injury to the wearer. In some embodiments, the modules 1110 are configured to be compatible with a particular helmet configuration. In certain embodiments, the modules 1110 can be configured to be compatible with a range of helmet configurations.

The helmet 1100*a* thus described provides a number of advantages. For example, modules 1110 may be optionally removed and replaced after severe impacts, permanent deformation, or ordinary wear and tear. Modules 1110 may be optionally added, removed, or replaced to extend the capabilities of the helmet 1100*a*, such as by adding new electronic capabilities that were previously unavailable to the user. Modules 1110 may be changed to alter the aesthetic and functional qualities of the helmet 1100*a*. This may be done to satisfy the user's desire for change or to enhance the interface between the helmet 1100*a* and other pieces of equipment, such as eyewear. This modular design may improve cost efficiencies by decreasing the cost of helmet refurbishment and the frequency of helmet replacement.

Another advantage provided by the disclosed modular helmets includes the ability to break a helmet down into smaller pieces, making it easier and more space-efficient to pack the helmet. This can be beneficial, for example, when travelling or when packing the helmet from one location to another during a ski or snowboard session.

Advantageously, the modules 1110 can include interchangeable pieces that allow a user to swap one piece that provides particular features for another similar piece that provides one or more different features. For example, the user can replace an eyewear adapter module with a long brim with an eyewear adapter module with a shorter brim when lighting or precipitation conditions change.

As disclosed herein, components of the helmet 1100*a* (e.g., the shell 1107, the cushioning 1109, modules 1110) may be made of various materials and composites, including polycarbonate plastic, ABS plastic, carbon fiber, fiberglass, metals, ceramics, polystyrene foam, expanded polypropylene, vinyl nitrile foam, rubber, TPE, and thermoplastic urethane foam. Additionally, various materials may be combined to obtain attractive or desirable characteristics of existing (or as yet unknown) plastics, energy-absorbing materials, and composite materials, and may be incorporated into the helmet 1100*a*. Although an exhaustive list of materials is not included herein, one skilled in the relevant art will appreciate that various conventional plastics, rubbers, and energy-absorbing materials may be used, all of which fall within the scope of the present disclosure.

As illustrated in FIGS. 11A and 11B, the base portions 1105*a*, 1105*b* can be configured to provide differing coverage for a wearer's head 1102. For example, the base portion 1105*a* can cover a top portion of the wearer's head while leaving the area around the ear uncovered. Similarly, the base portion 1105*b* can cover the top portion of the wearer's head in addition to the area around the ear. The differing coverage can be based at least in part on the intended activity, safety regulations, aesthetics, and the like.

FIGS. 11C-11J illustrate coverage provided by various example embodiments of base portions 1105. The coverage provided by the base portions 1105 can conform to standards such as European Standard EN 1077:2007 Class A or Class B, ASTM F2040, SMF RS-98 or SMF S-98, or the like. In some embodiments, the base portion 1105 alone does not provide coverage that conforms to standards such as European Standard EN 1077:2007 Class A or Class B, ASTM F2040, SMF RS-98 or SMF S-98, or the like. In such embodiments, modules can be added to the base portion 1105 to provide coverage greater than or equal to the coverages specified in those standards.

Examples of the coverage provided by base portions 1105 will now be described with reference to geometries of selected standard headforms. For purposes of some of these examples, the geometry of the selected headforms is according to the definitions for the 'A', 'C', 'E', T, 'M', and 'O' headforms described in International Standards Organization (ISO) Draft Standard ISO DIS 6220-1983. However, coverage can be described relative to any other standard headform or other non-standard headforms. As illustrated in FIGS. 11C-11J, coverage is generally described relative to a basic plane that corresponds to the anatomical plane that includes the auditory meatuses and the inferior orbital rims. The longitudinal or midsagittal plane is perpendicular to the basic plane and is the plane of symmetry dividing the right half of the headform from the left. The transverse or coronal plane is perpendicular to both the longitudinal and basic planes. It corresponds to the anatomical plane that contains the two auditory meatuses and divides the front from the rear portions of the head. The reference plane is parallel to the basic plane and lies above it at a distance determined by the size of the headform: 24 mm, 26 mm, 27.5 mm, 29 mm and 30 mm for the 'A' through 'O' headforms respectively.

For ease of description, additional planes can be defined. The $S_0$ plane is parallel to the basic plane and lies above it at a distance determined by the size of the headform: 46.8 mm, 50 mm, 53 mm, 55.2 mm and 57.2 mm for the 'A' through 'O' headforms respectively. The $S_3$ plane is parallel to the $S_0$ plane and the basic plane and lies between them at a distance of 26.1 mm, 28.2 mm, 30 mm, 31.5 mm and 32.2 mm below the $S_0$ plane for the 'A' through 'O' headforms respectively. The $S_4$ plane is also parallel to the $S_0$ plane and lies below it a distance of 52.2 mm, 56.4 mm, 60 mm, 63 mm and 64.5 mm for the 'A' through 'O' headforms respectively. The rear plane divides the rear third of the head from the front two thirds. It is parallel to the coronal plane and lies at a given distance behind the point where the reference plane and longitudinal planes intersect with the front surface of the headform. The distance from this point, hereafter called the reference point, is determined by the size of the headform: 128.6 mm, 139 mm, 148.4 mm, 155.8 mm and 161.5 mm for the 'A' through 'O' headforms respectively. The fore plane is also parallel to the coronal plane. It lies behind the reference point at a distance determined by the size of the headform: 39 mm, 42.2 mm, 45.2 mm, 47.4 mm and 49.2 mm for the 'A' through 'O' headforms respectively.

Figure 11C:
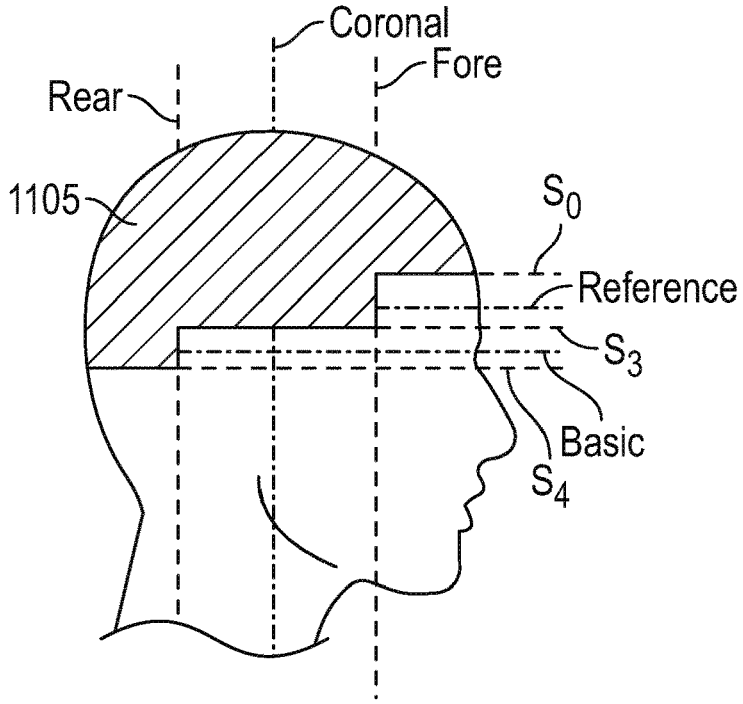
FIGS. 11C-11J illustrate coverages for a variety of example base portions relative to reference planes.
Figure 11D:
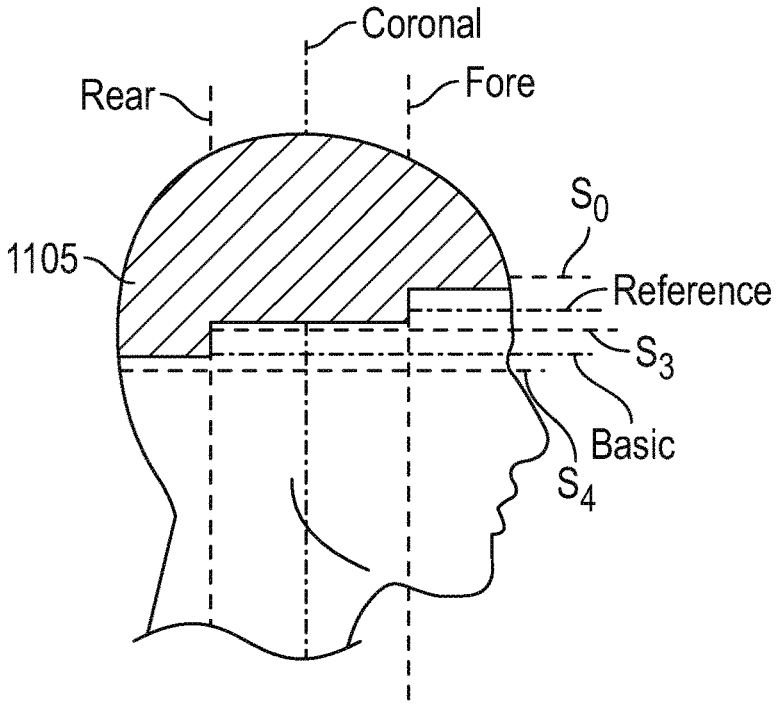
Figure 11E:
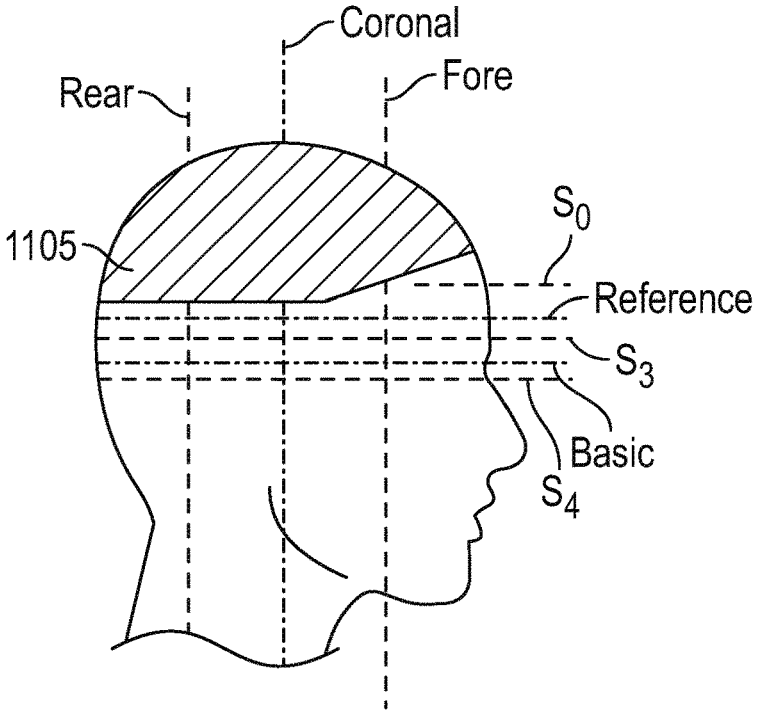
Figure 11F:
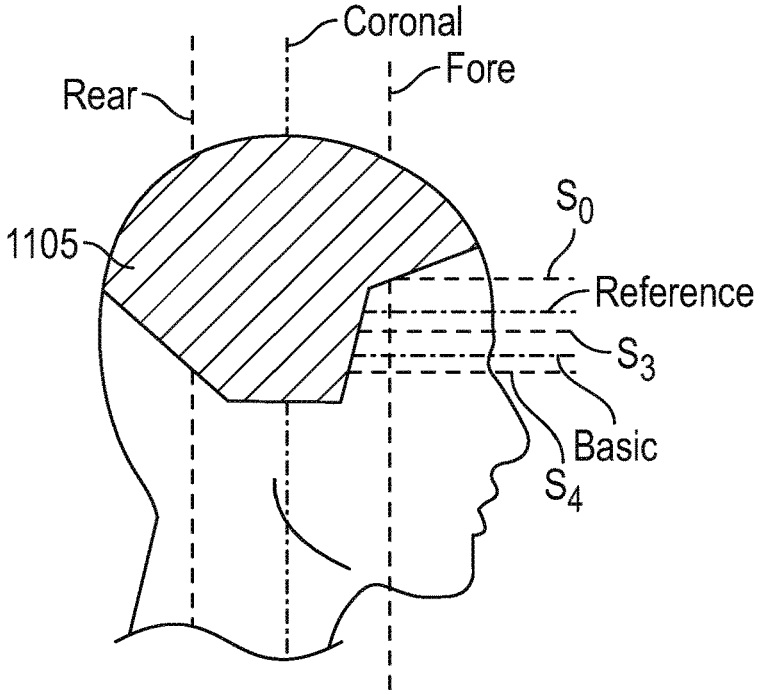
Figure 11G:
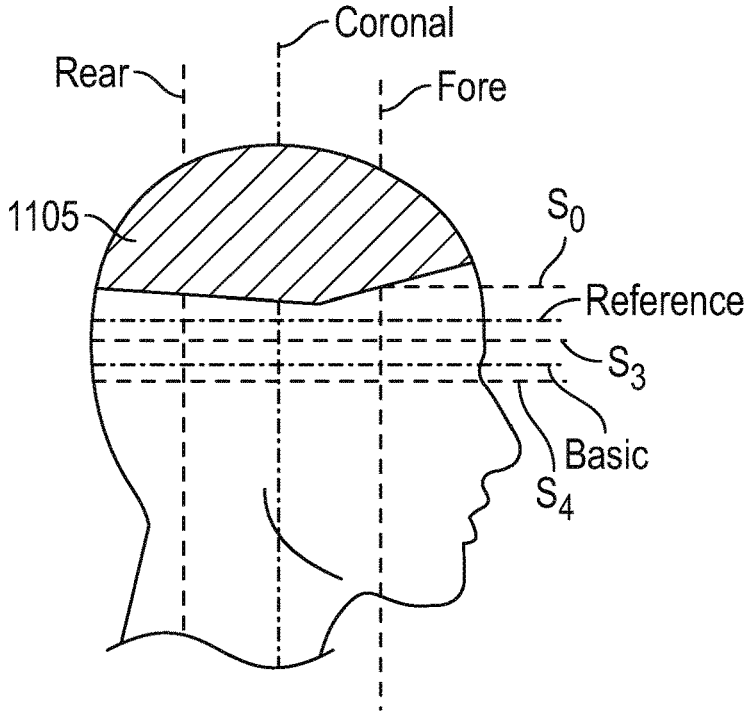
Figure 11H:
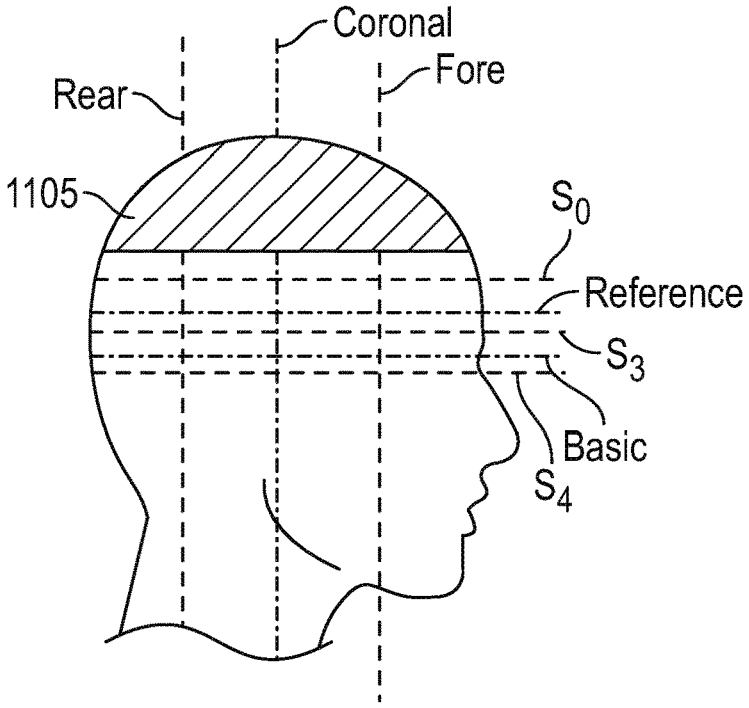
Figure 11I:
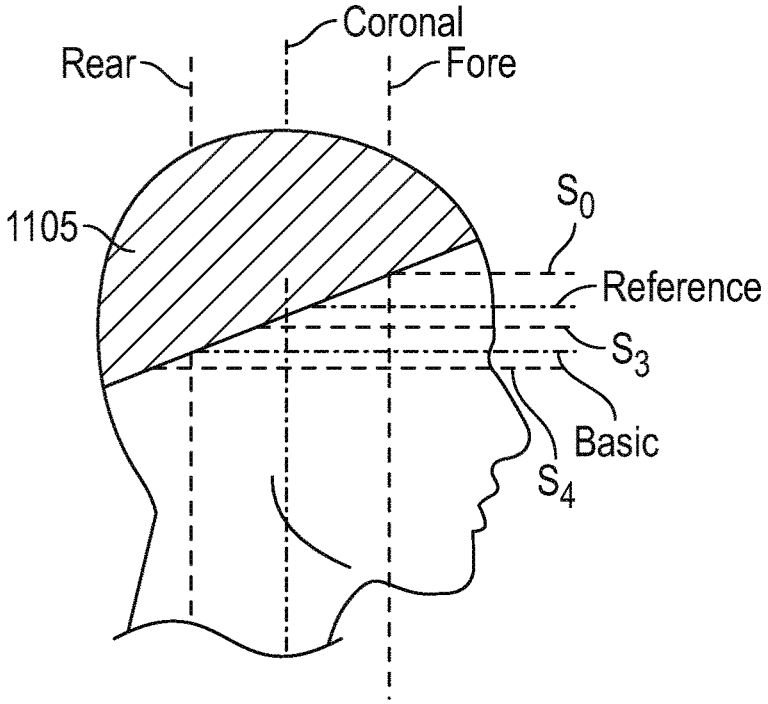
Figure 11J:
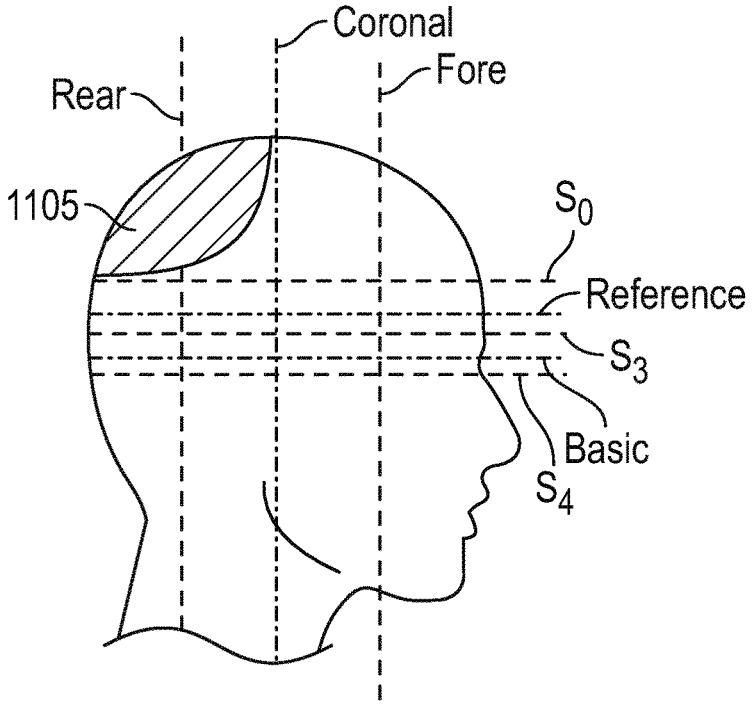

In the example illustrated in FIG. 11C, a base portion 1105 includes the entire region above the $S_0$ plane and forward of the fore plane, the entire region above the $S_3$ plane and between the fore and rear planes, and the entire region above the $S_4$ plane and behind the rear plane. In the example illustrated in FIG. 11D, the base portion 1105 includes the entire region above a line 50 mm above the basic plane and forward of the fore plane, the entire region above a line 25 mm above the basic plane and between the fore and rear planes, and the entire region above the basic plane and behind the rear plane (where the measurements are provided for the T head form). In the example illustrated in FIG. 11E, the base portion 1105 includes the entire region above a plane about 42 mm above the basic plane and behind a plane about 30 mm in front of the coronal plane, and the entire region above a plane that starts at about 30 mm in front of the coronal plane and about 42 mm above the basic plane and ascends to the reference point at a point about 62 mm above the basic plane. In the example illustrated in FIG. 11F, the base portion 1105 includes the entire region above a plane that starts at about 42 mm above the basic plane at the rear of the head form and extends to a point about 16 mm below the basic plane at a point that is about 26 mm behind the coronal plane, the entire region above the plane extending from about 26 mm behind the coronal plane to about 26 mm in front of the coronal plane and about 16 mm below the basic plane, the entire region above a plane starting at about 26 mm in front of the coronal plane and about 16 mm below the basic plane and extending to a point about 30 mm in front of the coronal plane and about 42 mm above the basic plane, and the entire region above a plane that starts at about 30 mm in front of the coronal plane and about 42 mm above the basic plane and ascends to the reference point at a point about 62 mm above the basic plane.

FIGS. 11G-11J illustrate other non-limiting examples of coverage provided by the base portion 1105. In some embodiments, the base portion 1105 can cover a region behind the coronal plane, in front of the coronal plane, or covering regions both in front of and behind the coronal plane. The base portion 1105 need not be symmetrical about the coronal plane, the midsagittal plane, or any other reference plane. In some embodiments, the base portion 1105 can cover at least the region above the $S_0$ plane and behind the fore plane, behind the coronal plane, in front of the coronal plane, and/or in front of the rear plane. In certain embodiments, the base portion 1105 can cover at least the entire region behind at least one of the fore plane, the coronal plane, or the rear plane and at least 100 mm above the reference plane, at least 75 mm above the reference plane, at least 50 mm above the reference plane, at least 25 mm above the reference plane, or above the reference plane. In certain embodiments, the base portion 1105 can cover regions as described relative to vertical planes, such as and without limitation, behind the fore plane, behind the coronal plane, behind the rear plane, in front of the fore plane, in front of the coronal plane, in front of the rear plane, between the coronal plane and the fore plane, between the rear plane and the coronal plane, or between the rear and fore planes. In certain embodiments, the base portion 1105 can cover regions as described relative to horizontal planes in combination with vertical planes, such as and without limitation, above the $S_0$ plane, above the reference plane, above the $S_3$ plane, above the basic plane, above the $S_4$ plane wherein each of the horizontal reference plane coverages can be combined with any of the vertical plane coverages described herein to form a particular, targeted, or desired coverage for the base portion 1105.

Example Helmet with an Adjustable Eyewear Adapter Module

Figure 13:
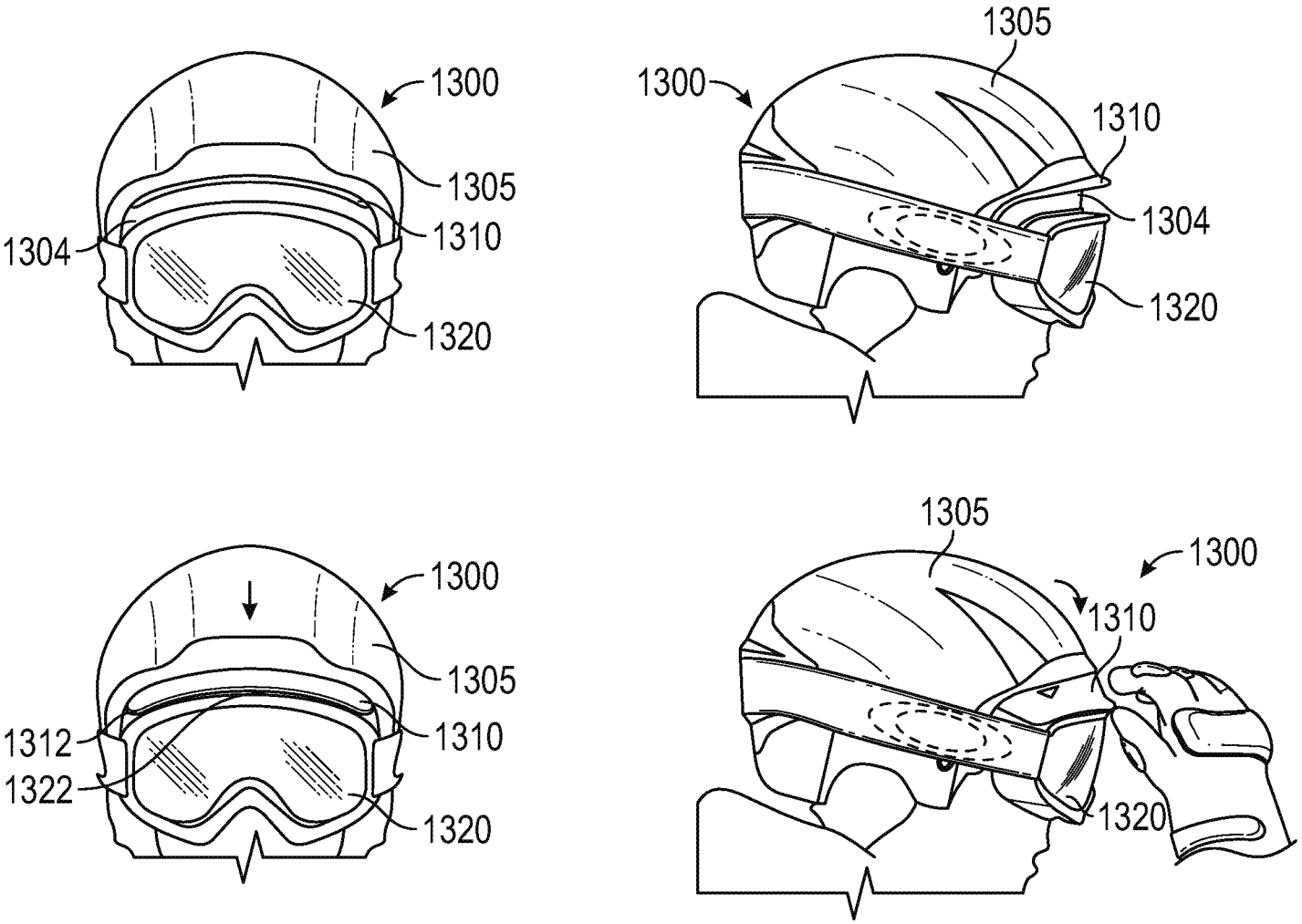
FIG. 13 illustrates another example modular helmet having a base portion and an eyewear adapter module configured to attach to the base portion and to be tailored to eyewear.

FIG. 13 illustrates an example helmet 1300 having a base portion 1305 and an eyewear adapter module 1310 configured to attach to the base portion 1305 and to be tailored to eyewear 320, such as goggles, sunglasses, glasses, or other such eyewear. The eyewear adapter module 1310 is further configured to be adjustable after being attached to the base portion 1305. For example, the eyewear adapter module 1310 can be configured to be adjusted by sliding the eyewear adapter module 1310 down from the base portion 1305 towards the eyewear 1320. This advantageously allows the eyewear adapter module 1310 to interface more closely with the eyewear 1320.

Due at least in part to differences between users' heads and faces, the same eyewear would be positioned differently on the face of each user. The eyewear may be higher or lower on the head, for example. In addition, the positioning of a helmet on a head of the wearer will differ between different wearers. In some instances, a gap 1304 between the helmet 1300 and the eyewear 1320 can be at least about 0.25 inches and/or less than or equal to about 2 inches, at least about 0.5 inches and/or less than or equal to about 1.5 inches, or at least about 0.75 inches and/or less than or equal to about 1 inch. Even with the eyewear adapter module 1310, the gap 1304 may still persist for some users. Accordingly, even though the eyewear adapter module 1310 is tailored to the eyewear 1320, there may still be an undesirably large gap or space 1304 between the eyewear adapter module 1310 and the base portion 1305 of the helmet 1300 when worn by some users. The adjustable eyewear adapter module 1310 allows the user to adjust the position of the eyewear adapter module 1310 so that it can be positioned adjacent to the eyewear 1320. For example, the eyewear adapter module 1310 can be adjusted to reduce the gap 1304 between a bottom portion 1312 of the eyewear adapter module 1310 and a majority of a top portion 1322 of the eyewear 1320 to be less than or equal to about 0.5 inches, to be less than or equal to about 0.25 inches, to be less than or equal to about 0.125 inches, or to be in contact with one another.

As described herein, the eyewear adapter module 1310 can be positioned so that an interface between the eyewear adapter module 1310 and the eyewear 1320 provides one or more advantages. For example, a bottom portion 1312 of the eyewear adapter module 1310 can be adjusted until it contacts a majority of a top portion 1322 of the eyewear 1320. The bottom portion 1312 of the eyewear adapter module 1310 can be a surface of the eyewear adapter module 1310. The eyewear adapter module 1310 can be plastic, metal, rubber, TPE, foam, a combination of these or some other materials that are displaceable, compressible, and/or deflectable. In particular, the bottom surface 1312 can be displaceable, compressible, and/or deflectable to facilitate contact between a majority of the bottom surface 1312 and a majority of the top surface 1322 of the eyewear 1320. The bottom surface 1312 can include securing mechanisms such as adhesives, loop-and-hook material, snaps, magnets, or the like so that the eyewear adapter module 1310 remains substantially attached to the eyewear 1320 during use. The top portion 1322 of the eyewear 1320 can similarly be a rigid edge or surface of the eyewear 1320 or it can include foam, rubber, plastic, TPE, or the like as well. The eyewear 120 can be configured to include securing mechanisms such as adhesives, hook-and-loop material, snaps, magnets, or the like that are compatible with the eyewear adapter module 1310 to help secure the eyewear adapter module 1310 in position against the eyewear 1320.

In some embodiments, the eyewear adapter module 1310 includes a locking mechanism that secures the eyewear adapter module 1310 substantially in place relative to the base portion 1305. For example, a friction-based locking device can be engaged to increase the friction between the eyewear adapter module 1310 and the base portion 1305 so that it becomes more difficult to move the eyewear adapter module 1310. As another example, a ratchet locking device can be engaged to lock the eyewear adapter module 1310 in place. As another example, a locking device can be used to limit movement of the eyewear adapter module 1310 to a certain point (e.g., in the upward or downward direction), allowing a limited range of movement of the eyewear adapter module 1310 when the locking device is engaged. In certain embodiments, the eyewear adapter module 1310 can be adjusted, locked, and unlocked without the use of tools (e.g., by hand).

Figure 14:
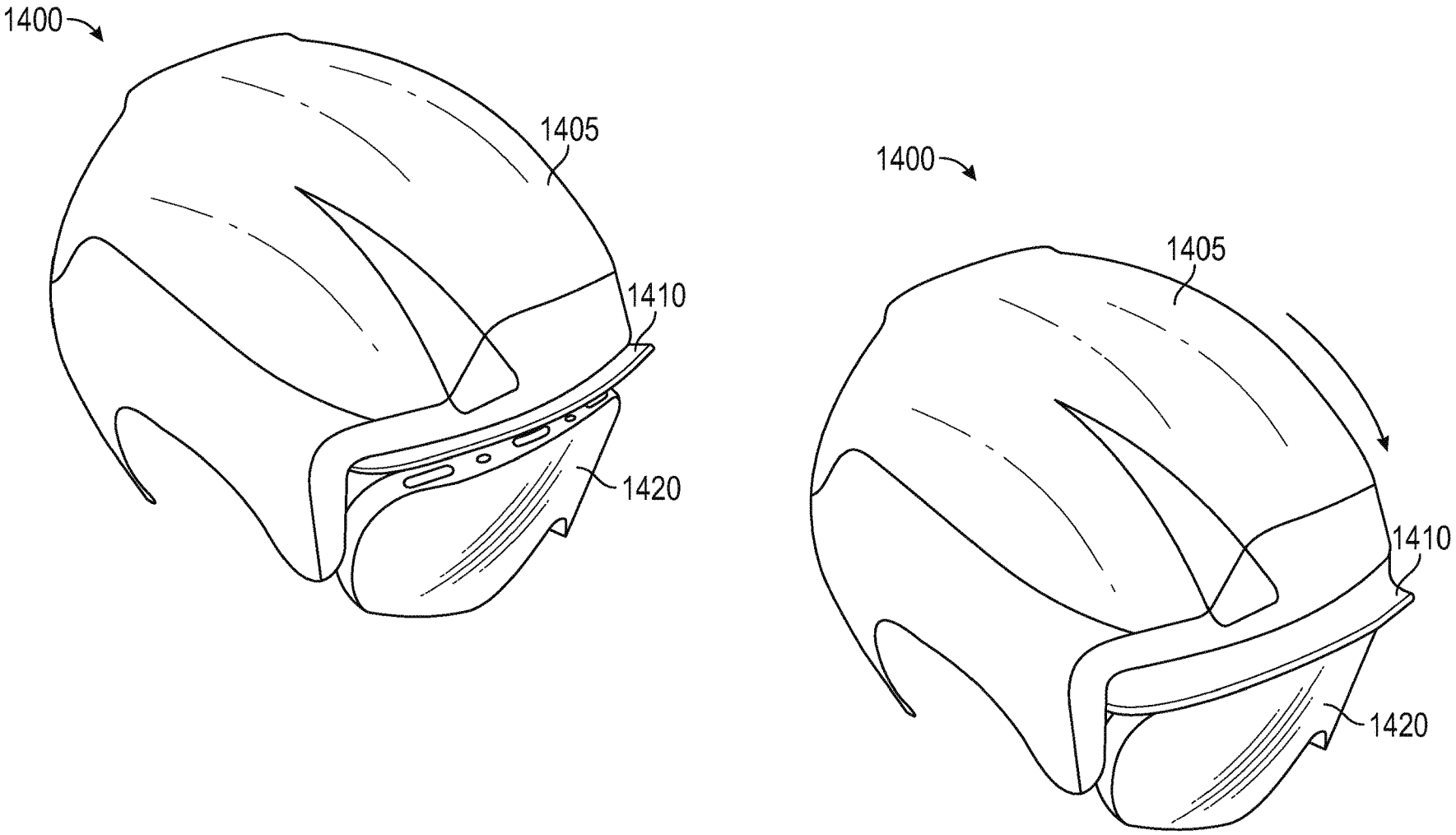
FIG. 14 illustrates another example of an adjustable eyewear adapter module attached to a base portion of a modular helmet.

FIG. 14 illustrates another example of an adjustable eyewear adapter module 1410 attached to a base portion 1405 of a helmet 1400. The adjustable eyewear adapter module 1410 can slide down to engage with eyewear 1420 to close a gap between the eyewear 1420 and the base portion 1405. This sliding eyewear adapter module 1410 can be configured to adjust to multiple eyewear sizes and heights, allowing for a more generic eyewear adapter module 1410 that is not necessarily tailored to particular eyewear, but can be generic to more general eyewear designs. In addition, foam, rubber, TPE or other similar displaceable, compressible, and/or deflectable material can be included on the eyewear adapter module 1410 so that the material can contact the eyewear 1420 and close gaps between the eyewear adapter module 1410 and the eyewear 1420 that may arise due at least in part to differing surface contours.

Figure 15A:
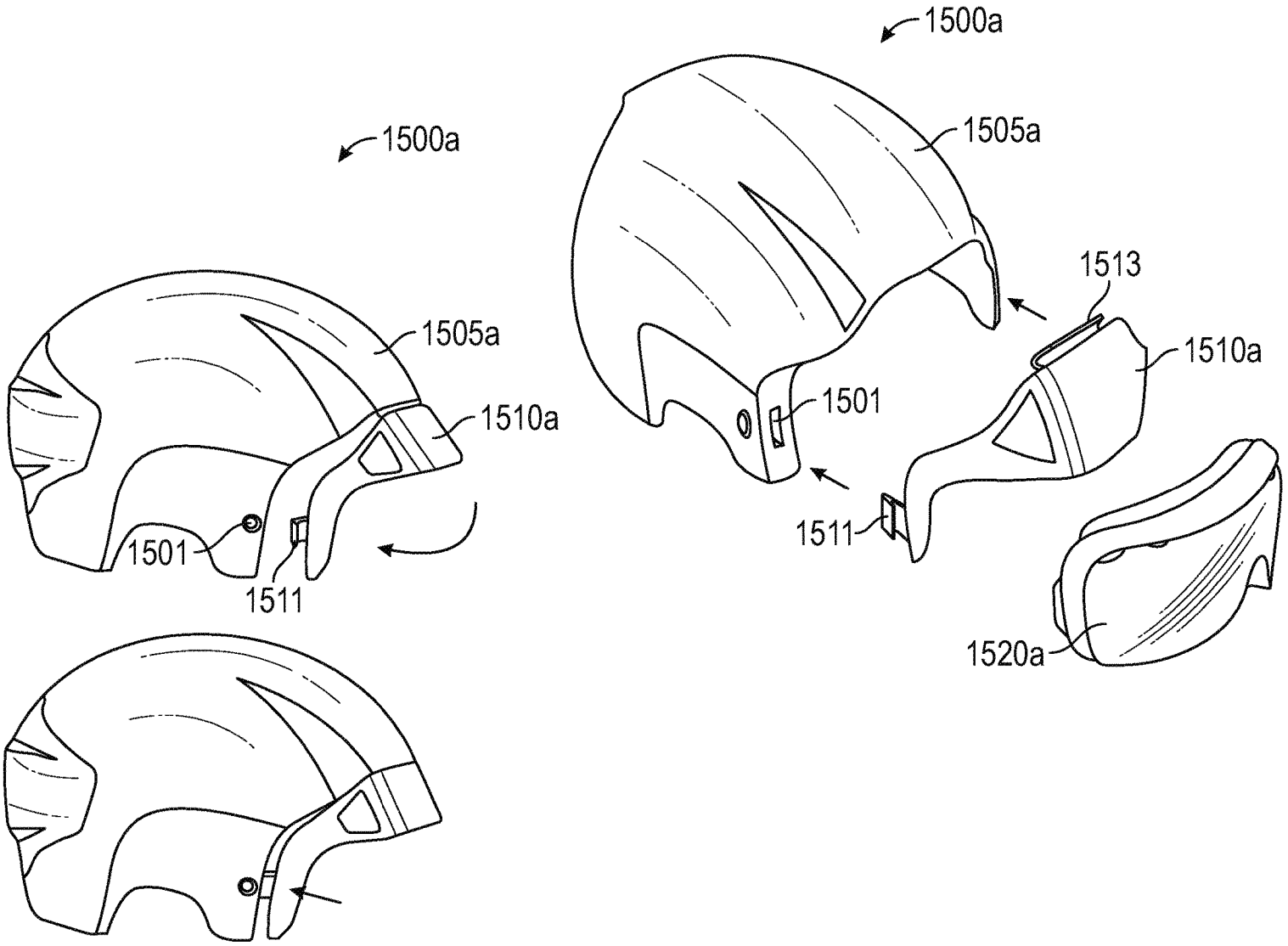
FIG. 15A illustrates an example of a modular helmet having a base portion and a rigid eyewear adapter module configured to securely attach to the base portion without the use of tools.

FIG. 15A illustrates an example of a helmet 1500*a* having a base portion 1505*a* and an eyewear adapter module 1510*a* configured to securely attach to the base portion 1505*a* without the use of tools. The eyewear adapter module 1510*a* can be configured to snap into the base portion 1505*a* through corresponding mechanical features on the eyewear adapter module 1510*a* and the base portion 1505*a*. For example, the eyewear adapter module 1510*a* can have hooks 1511 on the sides of the module that are configured to snap securely into corresponding divots or apertures 1501 on the base portion 1505*a*. In addition, the top of the eyewear adapter module 1510*a* can include a lip feature 1513 configured to seat into a channel or other similar feature on the base portion 1505*a*. To attach the eyewear adapter module 1510*a* to the base portion 1505*a*, a user can seat the lip feature 1513 into the channel on the base portion 1505*a* and then rotate the eyewear adapter module 1510*a* until the hooks 1511 snap into the apertures 1501 on the base portion 1505*a*. To remove the eyewear adapter module 1510*a*, force can be applied to the eyewear adapter module 1510*a* to rotate the sides of the module up and away from the base portion 1505*a*.

The eyewear adapter module 1510*a* can be configured to be tailored to the eyewear 1520*a* and the helmet 1500*a*. To accommodate different users, a range of sizes of eyewear adapter module 1510*a* can be created for a particular helmet 1500*a* and eyewear 1520*a* combination. This can allow different users to use the eyewear adapter module 1510*a* with the particular helmet 1500*a* and eyewear 1520*a* combination even where the fit of each would differ for different users. For example, a user may buy a helmet 1500*a* and eyewear 1520*a* and then try on a number of different eyewear adapter modules 1510*a* to find the eyewear adapter module 1510*a* that provides the best fit, look, and/or feel. This may advantageously allow a user to use a suitable eyewear adapter module 1510*a* without having to adjust the position of the eyewear adapter module 1510*a*. This may advantageously allow the eyewear adapter module 1510*a* to be non-adjustable or to have a limited range of adjustments available, potentially reducing costs and complexity associated with manufacturing the eyewear adapter module 1510*a*. Thus, the user can select an appropriate eyewear adapter module 1510*a* to maintain a desirable relationship between the helmet 1500*a* and the eyewear 1520*a* (e.g., by reducing or eliminating a gap between them) without adjusting a position of the eyewear adapter module 1510*a*.

Figure 15B:
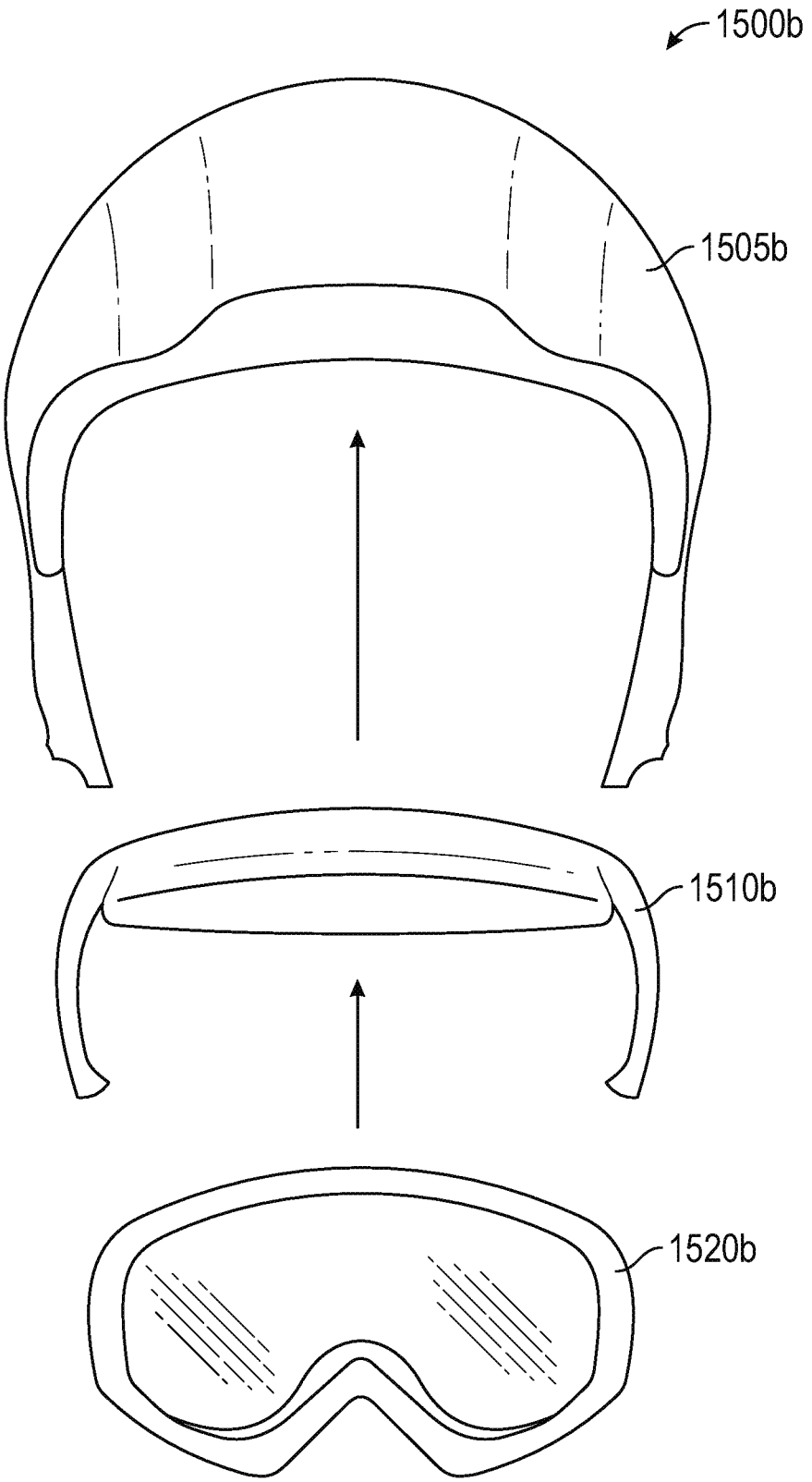
FIG. 15B illustrates an example of a modular helmet having an eyewear adapter module configured to secure eyewear in place without the use of earstems or a strap.

FIG. 15B illustrates an example of a modular helmet 1500*b* having an eyewear adapter module 1510*b* configured to secure eyewear 1520*b* in place without the use of a strap or earstems on the eyewear. For example, the earstems (or parts of the earstems) or straps can be removed from the eyewear 1520*b*. The eyewear 1520*b* can be attached to the eyewear adapter module 1510*b* through any suitable attachment means. The combined eyewear adapter module 1510*b* and eyewear 1520*b* can then be attached to the base portion 1505*b*. This can advantageously provide a pleasing aesthetic, reduce eyewear slippage during use, and allow a wearer to only adjust the combined eyewear adapter module and eyewear rather than each independently.

Alternatively, the illustrated eyewear adapter module 1510*b* can be used with eyewear 1520*b* with earstems or straps. For example, the eyewear adapter module 1510*b* can be configured to attach to the eyewear 1520*b* wherein the combined eyewear adapter module 1510*b* and eyewear 1520*b* can be worn with the helmet 1500*b* using the eyewear earstems or strap to secure the combined adapter 1510*b* and eyewear 1520*b* on the head of the wearer rather than attaching the eyewear adapter module 1510*b* to the base portion 1505*b*. This can advantageously reduce the forces imposed on the bridge of the nose of the wearer that may arise from a fixed brim on a helmet as well as ensure that the eyewear adapter module and eyewear are close to one another during use, reducing tendencies for eyewear and a helmet to separate during use due to helmet posterior creep.

Figure 16:
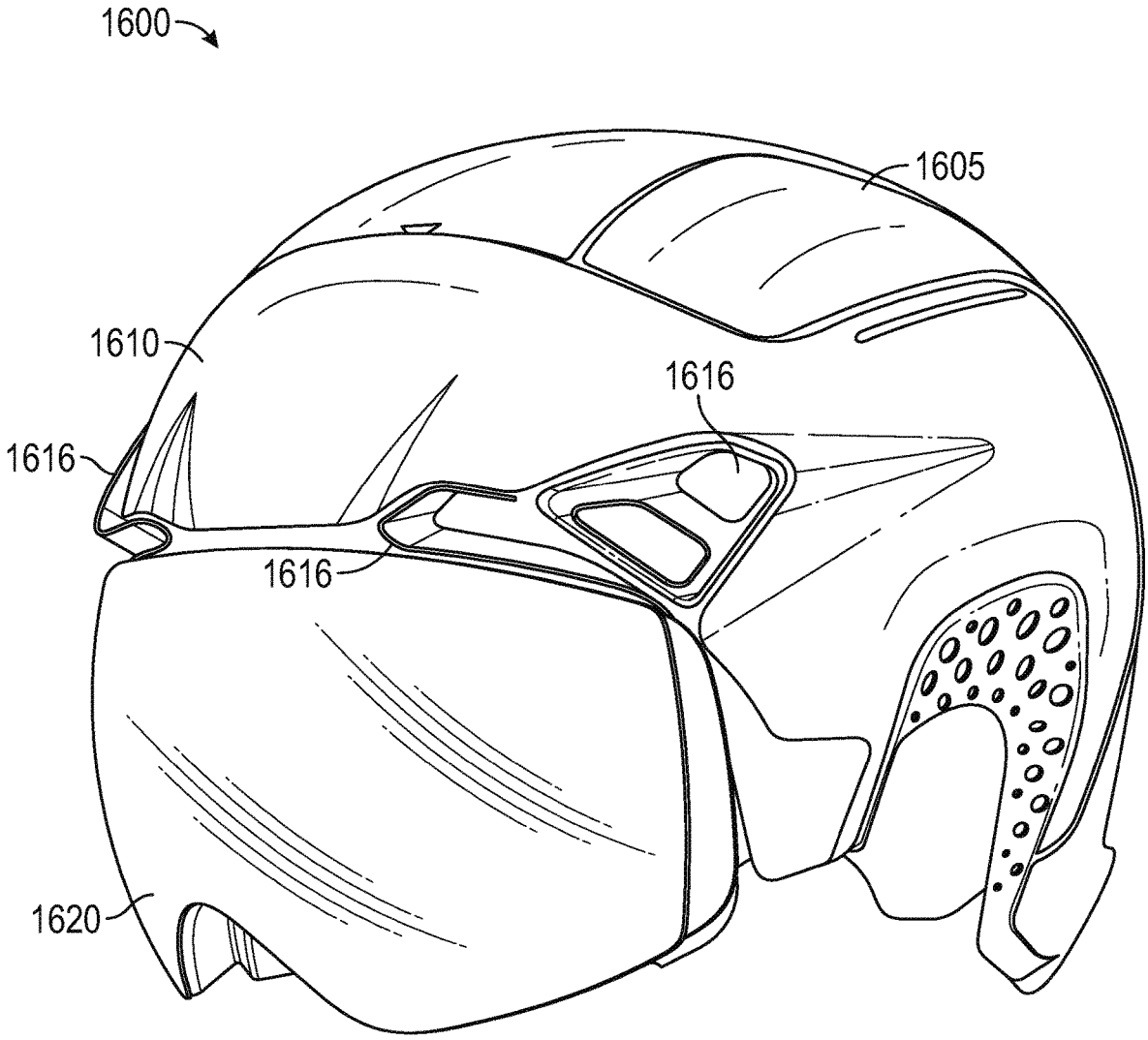
FIG. 16 illustrates an example of an eyewear adapter module configured to provide venting for eyewear.

FIG. 16 illustrates an example of an eyewear adapter module 1610 configured to provide venting for eyewear 1620 as used with a helmet 1600. The eyewear adapter module 1610 can be tailored for use with the eyewear 1620 to provide venting for the eyewear through the use of apertures 1616 in the eyewear adapter module 1610. The apertures 1616 can be configured to provide desirable or tailored air flow to reduce condensation or fogging in the eyewear 1620. The apertures 1616 can be configured to provide air flow to provide cooling for the wearer. For example, the apertures 1616 can be configured to generate a Venturi flow that generates a flow of air in the eyewear 1620 to assist in the removal of damp, warm air. Accordingly, the eyewear adapter module 1610 can be tailored for use with the eyewear 1620 to reduce or eliminate gaps between the eyewear 1620 and the helmet 1600 as well as provide tailored functionality for the helmet and eyewear combination, such as venting.

The eyewear adapter module 1610 can be configured to secure to an external surface of the base portion 1605, covering a substantial fraction of the base portion 1605. The eyewear adapter module 1610 can be configured to rotate around a pivot point to rotate into position relative to the eyewear 1620. Thus, the movement and positioning of the eyewear adapter module 1610 can be similar to a face shield of other helmets, except that the eyewear adapter module 1610 is configured to be a non-optical component and/or the eyewear adapter module 1610 is configured to not cross a line of sight of the wearer.

Figure 17A:
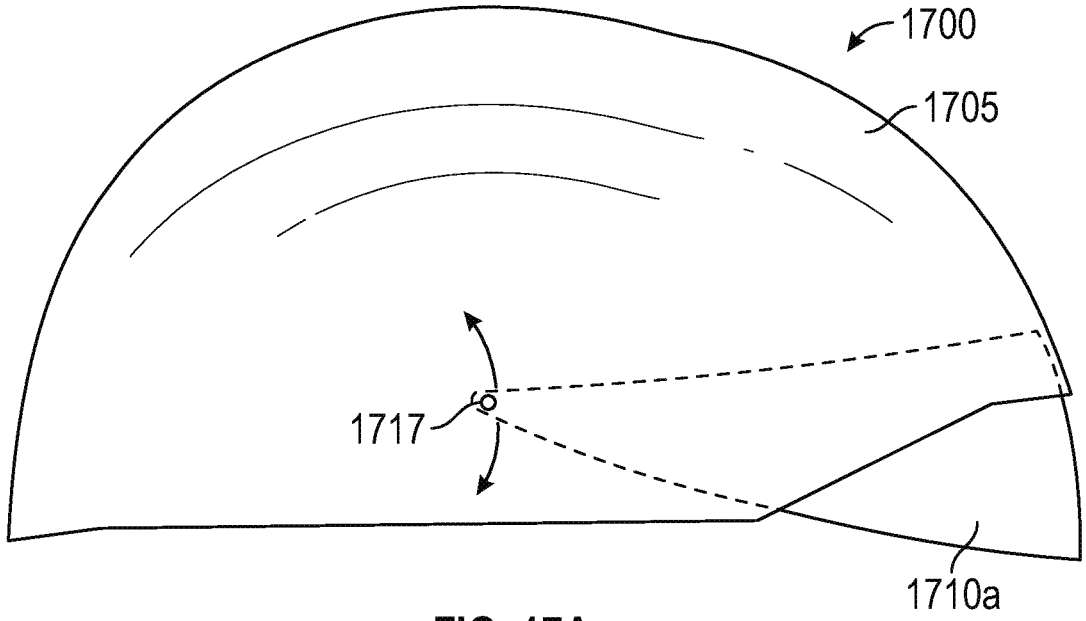
FIGS. 17A-17T illustrate examples of adjustable eyewear adapter modules attached to a base portion of a helmet.
Figure 17B:
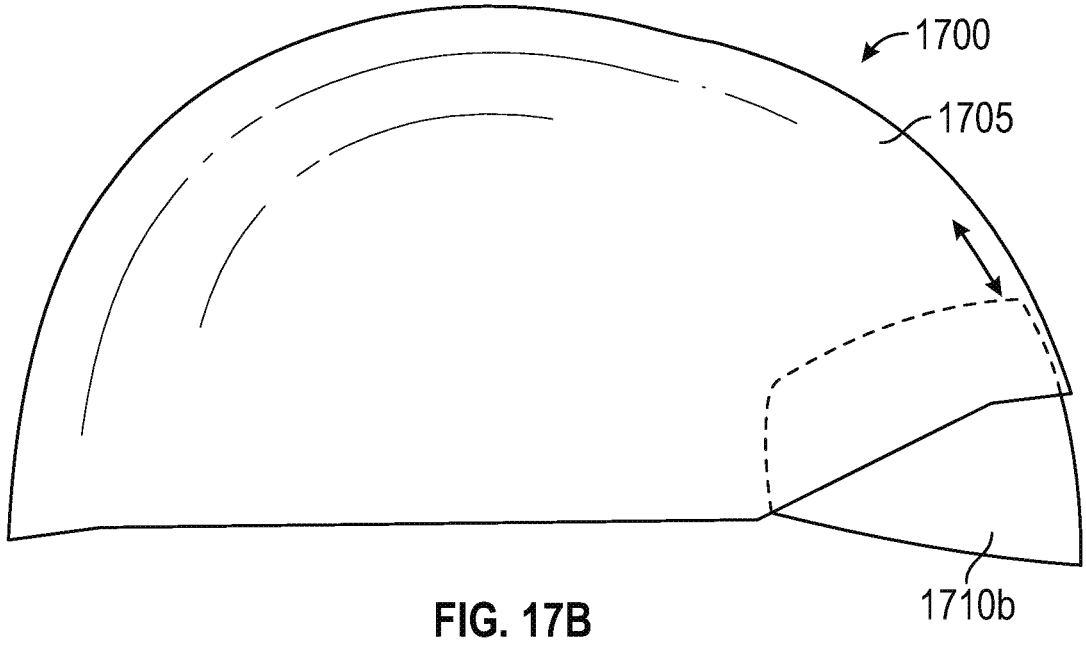

FIGS. 17A and 17B illustrate examples of adjusting mechanisms for an eyewear adapter module 1710*a*, 1710*b* attached to a base portion 1705 of a helmet 1700. As illustrated in FIG. 17A, the eyewear adapter module 1710*a* can be attached to the base portion 1705 at least at a pivot point 1717. The eyewear adapter module 1710*a* can thus be configured to pivot around the pivot point to allow a position of the module to be adjusted. This can be used to adjust a position of the eyewear adapter module 1710*a* to reduce or eliminate a gap between the helmet and eyewear (not shown). The range of motion of the eyewear adapter module 1710*a* can be limited so that the eyewear adapter module 1710*a* does not cross a line of sight of the wearer in use. The eyewear adapter module 1710*a* can be configured to be a non-optical component. For example, the eyewear adapter module 1710*a* can be opaque.

FIG. 17B illustrates the eyewear adapter module 1710*b* that can be attached to the base portion 1705 and adjusted by translating the eyewear adapter module 1710*b*. Translation of the eyewear adapter module 1710*b* can be along a substantially straight line, along a curve, and/or along a curve that substantially matches a curve of the base portion 1705. In some embodiments, the eyewear adapter module 1710*b* is deformable and can be slid into position. The eyewear adapter module 1710*b* can have a limited range of motion similar to the range of motion of the eyewear adapter module 1710*a*. Similarly, the eyewear adapter module 1710*b* can be a non-optical component like some embodiments of the eyewear adapter module 1710*a*.

Figure 17C:
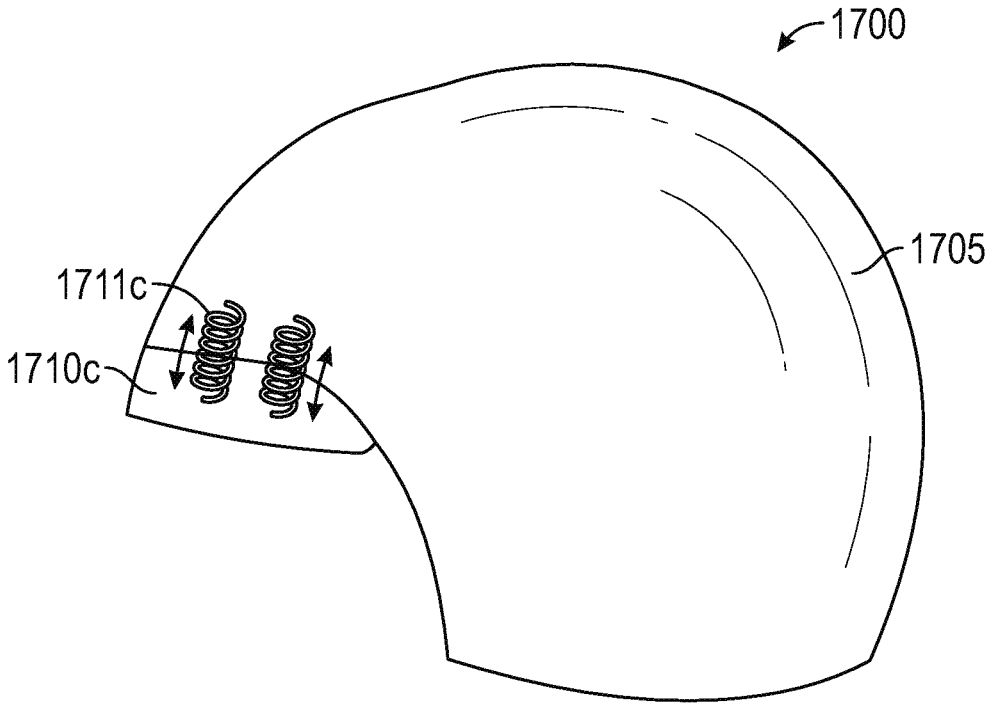

FIG. 17C illustrates a helmet 1700 having a base portion 1705 and an eyewear adapter module 1710*c*. The eyewear adapter module 1710*c* includes biasing elements 1711*c* configured to preferentially position the eyewear adapter module 1710*c* in a particular position. For example, a forward biasing element can be used to preferentially position the eyewear adapter module 1710*c* downward from the base portion 1705, towards eyewear. In such a configuration, the wearer can put the eyewear on and the biasing elements 1711*c* can apply a downward force on the eyewear adapter module 1710*c* to position the module 1710*c* against the eyewear. This can be done to maintain contact between the eyewear adapter module 1710*c* and the eyewear during use and/or to facilitate positioning of the eyewear adapter module 1710*c* when putting on the eyewear. For example, during use the helmet 1700 may tend to slide backward on the wearer and the biasing elements 1711*c* can adjust a position of the eyewear adapter module 1710*c* to maintain contact or a small gap between the eyewear adapter module 1710*c* and the eyewear. In some embodiments, the force of the forward biasing element 1711*c* is sufficiently small so as to not impart pressure onto the eyewear that is noticeable or uncomfortable for the wearer. In certain embodiments, the force of the forward biasing element 1711*c* is configured to allow movement of the eyewear adapter module 1710*c* during use with no significant pressure imparted onto the eyewear. In some embodiments, the eyewear adapter module 1710*c* includes a locking mechanism that can lock the eyewear adapter module 1710*c* in place after being positioned by the wearer, wherein the locking mechanism can resist the forces of the biasing elements 1711*c* to maintain the eyewear adapter module 1710*c* in place during use. This can advantageously reduce downward pressure on the eyewear that may be uncomfortable for the user. In some embodiments, a backward biasing element 1711*c* can be used to preferentially position the eyewear adapter module 1710*c* towards the base portion 1705. When the user puts on eyewear, the user can then apply force to slide the eyewear adapter module 1710*c* downward to a desirable position (e.g., in contact with the eyewear). A locking mechanism may then be engaged to secure the eyewear adapter module 1710*c* in place. In some embodiments, the locking mechanism may be engaged and released without the use of tools (e.g., using one hand). In some embodiments, the eyewear adapter module 1710*c* is advanceable through a range of positions. For example, the eyewear adapter module 1710*c* can include a ratchet mechanism that allows a user to adjust a position of the eyewear adapter module 1710*c* and to lock the module in place.

Figure 17D:
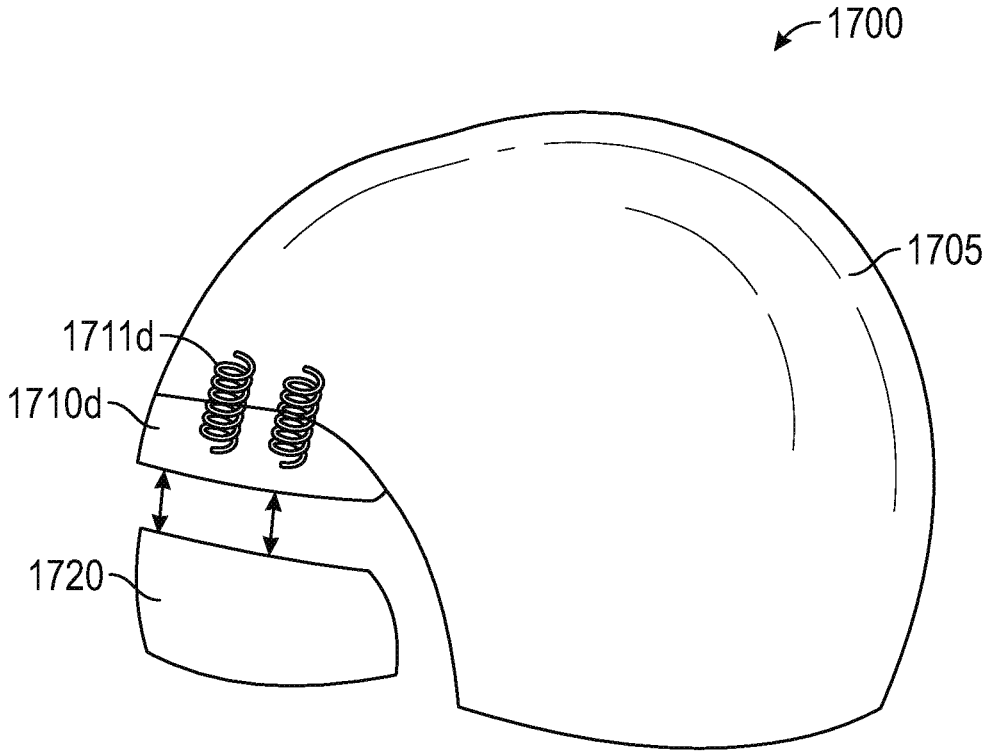

FIG. 17D illustrates another example embodiment of the helmet 1700 with biasing elements 1711*d*, similar to the example helmet described with reference to FIG. 17C. In addition to the biasing elements, the eyewear 1720 and/or the eyewear adapter module 1710*d* can be configured to include elements that provide an attractive force toward one another or a material that resists movement of the eyewear 1720 and adapter 1710*d* apart. For example, magnets can be placed on the eyewear 1720*d* and/or the adapter 1710*d* to generate an attractive force between them. Similarly, an adhesive, straps, latches, hook-and-loop material, or other similar material can be applied on one or both of the eyewear 1720*d* and adapter 1710*d* to secure each to the other. This can advantageously allow the adapter 1710*d* and eyewear 1720 to move during use while remaining close to one another. This may also advantageously reduce pressures on the wearer's nose that may arise from the combination of the eyewear 1720 and helmet 1700 sliding forward.

Figure 17E:
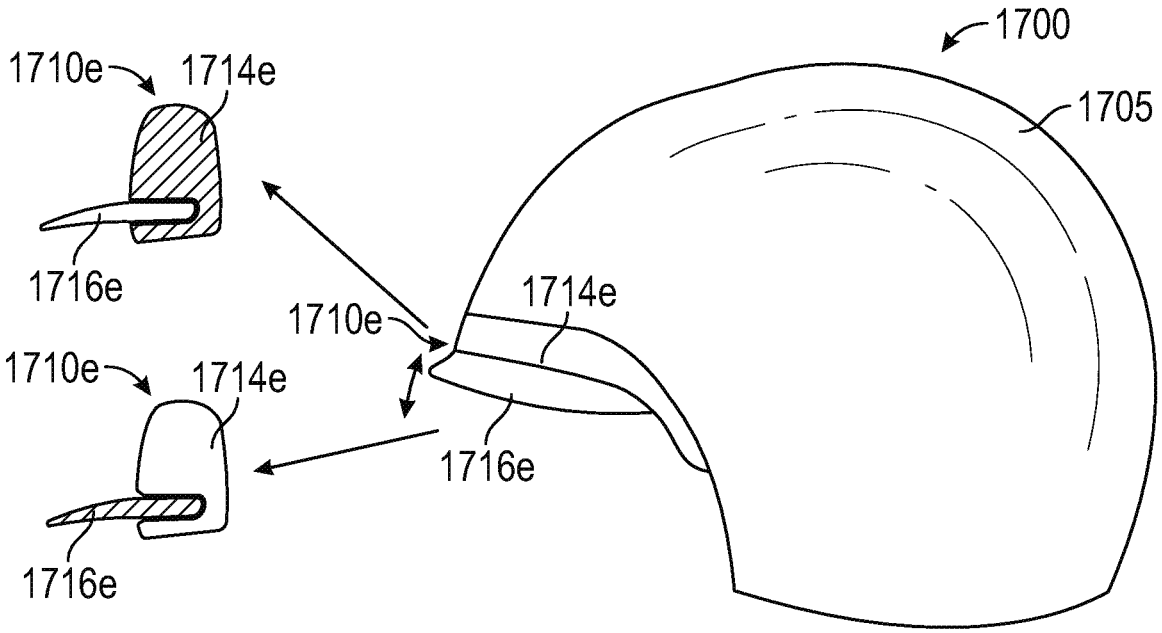

FIG. 17E illustrates an eyewear adapter module with a bridge portion 1714*e* and a brim portion 1716*e*. The bridge portion 1714*e* can be a soft, pliable, or displaceable material such as silicone, rubber, or the like while the brim portion 1716*e* can be a hard material such as plastic, metal, or the like. Alternatively, the brim portion 1716*e* can be a soft, pliable, or displaceable material such as silicone, rubber, or the like while the bridge portion 1714*e* can be a hard material such as plastic, metal, or the like. By combining rigid or hard materials and displaceable or soft materials in the eyewear adapter module 1710*e*, the module can be configured to automatically adjust to movement of the base portion 1705, eyewear, or a combination of both while maintaining a targeted or desired separation between the adapter 1710*e* and the eyewear. This advantageously reduces the necessity of manually adjusting the eyewear and/or module 1710*e* to maintain the desired or targeted spacing between the eyewear and the helmet 1700.

Figure 17F:
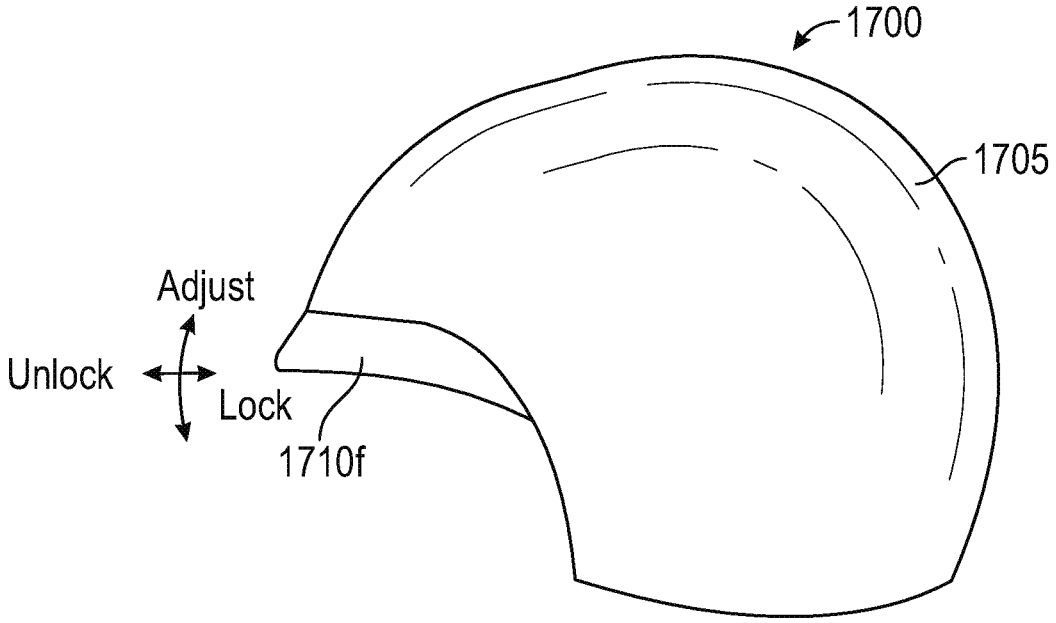

FIG. 17F illustrates an eyewear adapter module 1710*f* that is configured to be able to be unlocked and locked by respectively pulling the module 1710*f* outward or pressing the module 1710*f* inward. When unlocked, the eyewear adapter module 1710*f* can be rotated, slid, or otherwise moved relative to the base portion 1705. When locked, the eyewear adapter module 1710*f* can resist movement, staying substantially stationary relative to the base portion 1705. This advantageously provides the ability to adjust the module 1710*f* to account for movement of the eyewear, helmet 1700, different users, different circumstances, or the like. This can also advantageously allow a wearer adjust the module 1710*f* and lock it in place so that the adjustment can remain fixed during multiple uses.

Figure 17G:
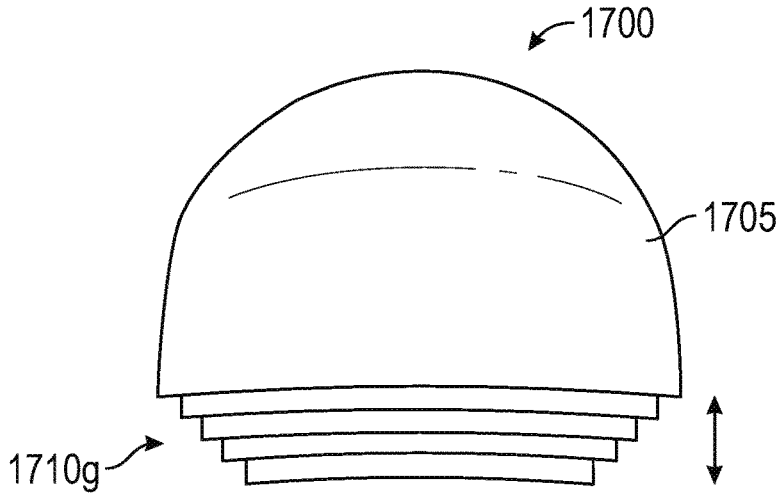

FIG. 17G illustrates an eyewear adapter module 1710*g* with telescoping components so that the components can adjust to the position of the eyewear. In some embodiments, the base portion 1705 includes telescoping components to adjust how the base portion 1705 fits on the wearer's head. This can also allow a user to adjust the relative positions of the eyewear and adapter module 1710*g*. In some embodiments, the telescoping components can be biased downward to apply a small but persistent pressure on the eyewear. In some embodiments, gravity is used to bias the telescoping components of the module 1710*g* downward. This can advantageously reduce the pressure on the nose of the wearer and discomfort associated with this pressure.

Figure 17H:
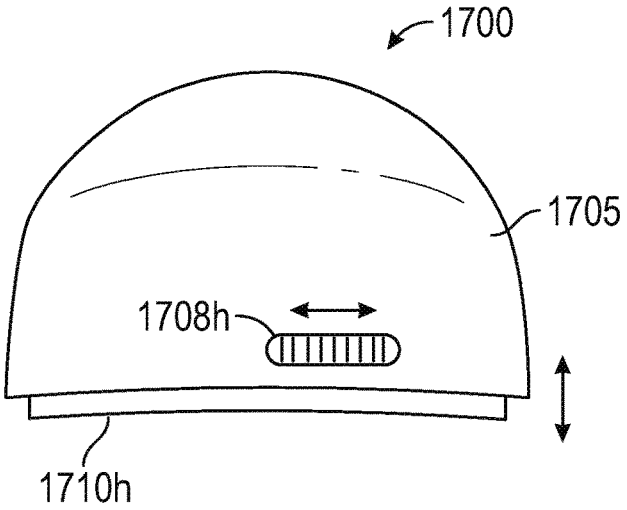

FIG. 17H illustrates a base portion that includes an adjuster knob 1708 that moves the eyewear adapter module 1710*h*. The adjuster knob 1708 can be configured to lock in place or have sufficient friction so that after the eyewear adapter module 1710*h* is moved into position, the adapter remains substantially fixed in place.

Figure 17I:
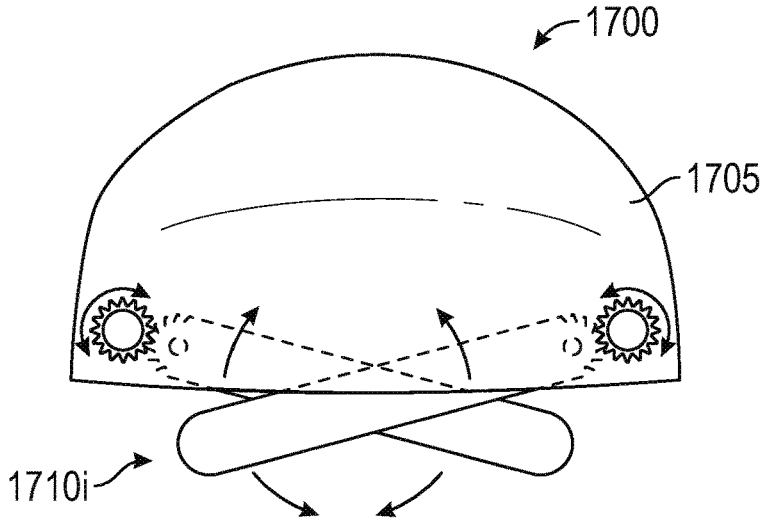

FIG. 17I illustrates an eyewear adapter module 1710*i* that includes a plurality of leaves and gears that cause the leaves to rotate to provide a configurable contour for the module 1710*i*. The leaves can be rotated using accessible knobs or other elements. The leaves may be allowed to rotate freely, with sufficient friction to resist movement caused by small forces. In some embodiments, the gears provide sufficient friction to resist movement of the leaves that is not deliberate or caused by the wearer (e.g., it reduces or eliminates movement caused by incidental forces or accelerations).

Figure 17J:
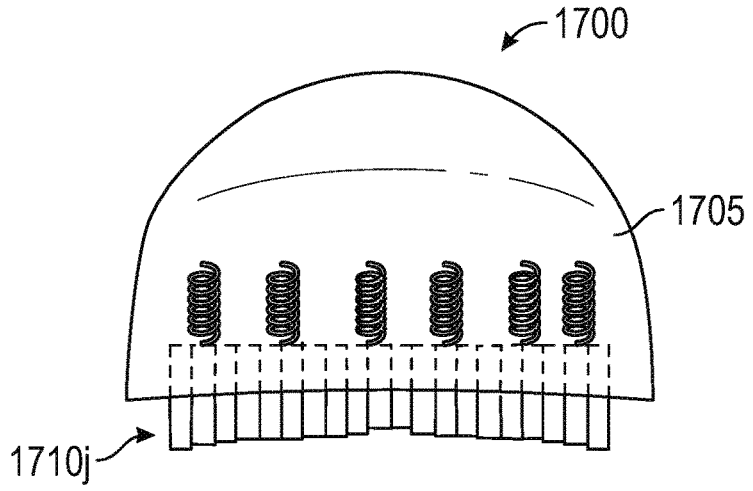

FIG. 17J illustrates an eyewear adapter module 1710*j* comprising a plurality of teeth attached to biasing elements. The teeth can be biased downward so that when the wearer puts on eyewear the teeth adjust to substantially match the contour of the eyewear.

Figure 17K:
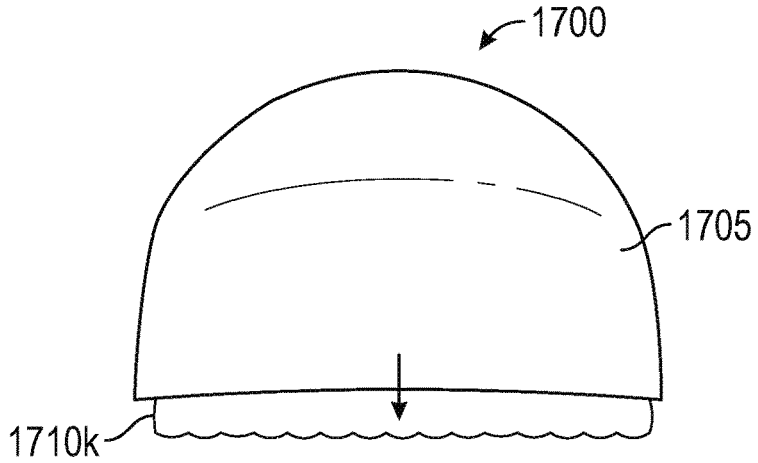

FIG. 17K illustrates an eyewear adapter module 1710*k* comprising an inflatable pouch that can be used to adjust the eyewear adapter module 1710*k*. For example, increasing air pressure in the inflatable pouch pushes a brim or curtain of the eyewear adapter module 1710*k* down to be near or contact eyewear.

Figure 17L:
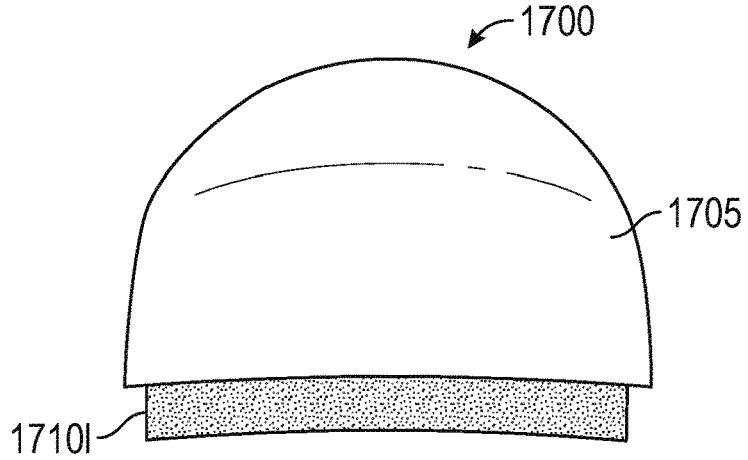

FIG. 17L illustrates an eyewear adapter module 17101 comprising low-density foam. The low-density foam can be configured to compress when eyewear is worn so that the eyewear adapter module 1710*k* maintains contact with the eyewear during use.

Figure 17M:
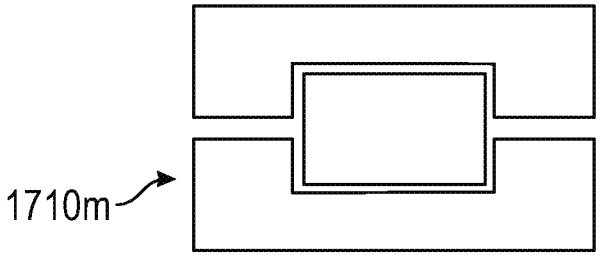

FIG. 17M illustrates an eyewear adapter module 1710*m* having multiple joints that allow for automatic adjustment of the eyewear adapter module 1710*m*. The joints can flex or allow other such movement to allow a brim or other portion of the eyewear adapter module 1710*m* to move during use and/or to be adjusted by a user.

Figure 17N:
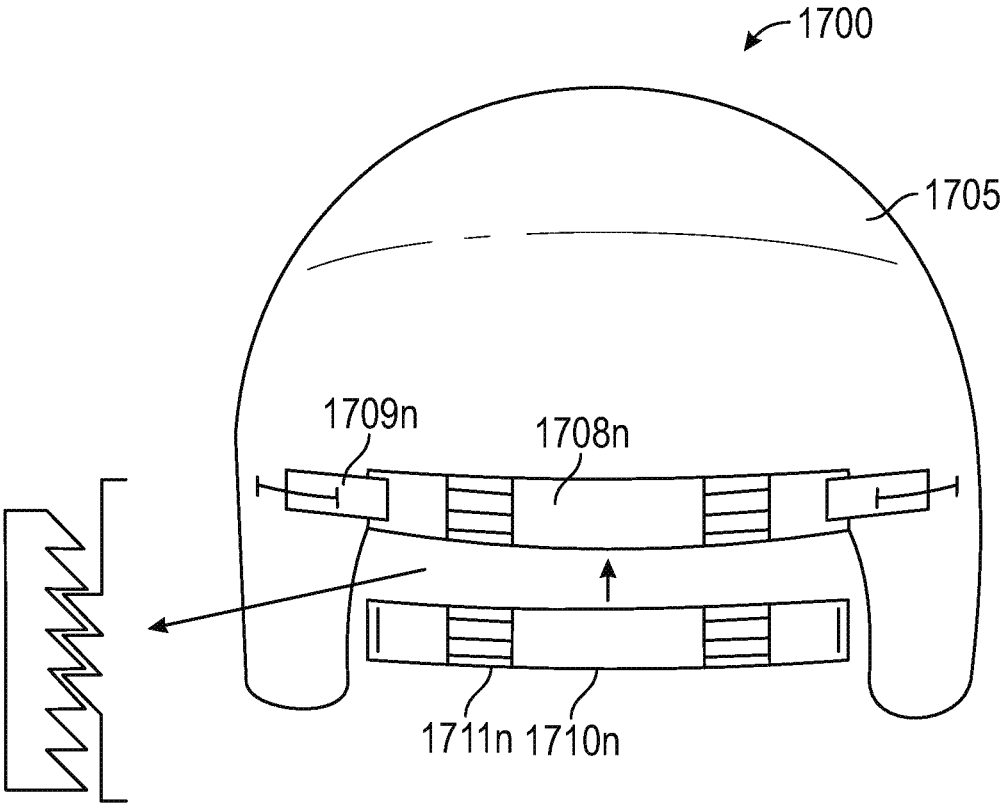

FIG. 17N illustrates an eyewear adapter module 1710*n* having an over-center latch system 1709*n* (e.g., a ski boot style latch system) with an over-center latch and an over-center latch receiver. The base portion 1705 includes an adjustment mechanism 1708*n* that includes teeth that mate with teeth on an adjustment mechanism 1711*n* of the eyewear adapter module 1710*n*. The teeth can be used to adjust a position of the eyewear adapter module 1710*n* relative to the base portion 1705. The latch system 1709*n* can be used to secure the eyewear adapter module 1710*n* in place. This advantageously allows a user to finely position the eyewear adapter module 1710*n* and lock the eyewear adapter module 1710*n* in place.

Figure 17O:
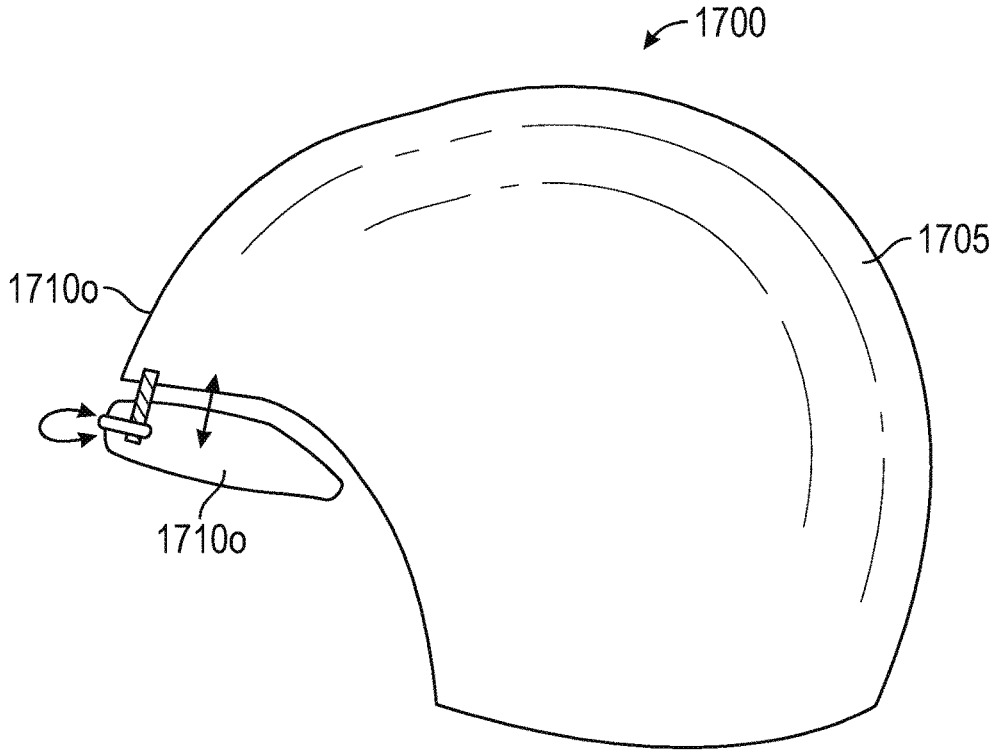
Figure 17P:
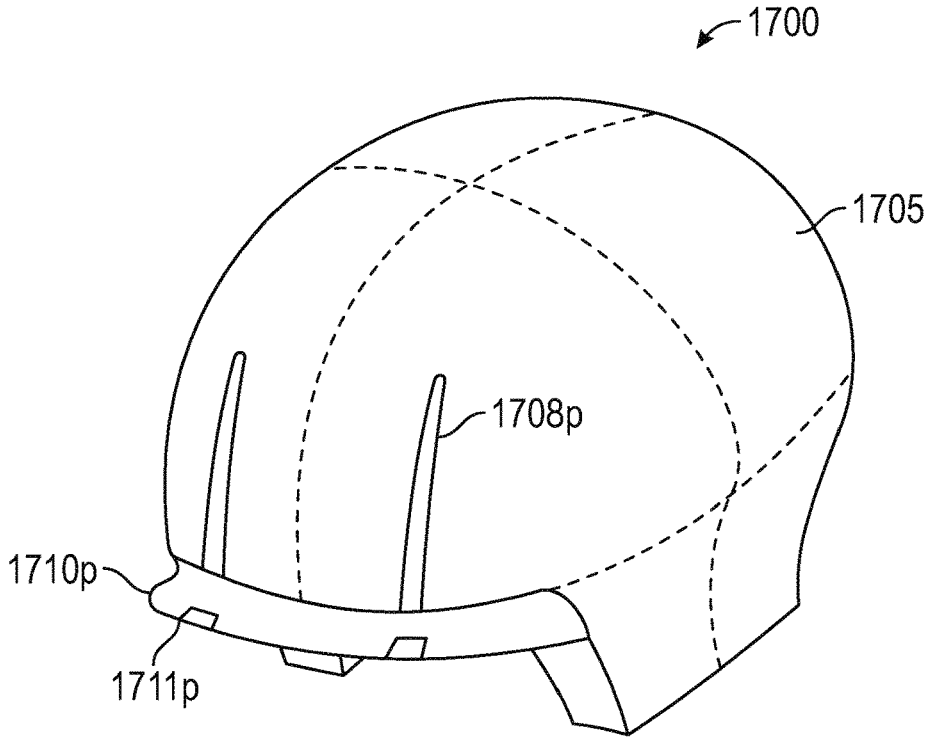

FIG. 17O illustrates an eyewear adapter module 1710*o* having an adjustment mechanism 17110 comprising, for example, a dial and a set screw. The dial causes adjustment of the set screw. The eyewear adapter module 1710*o* moves in response to changes in position of the set screw. This advantageously allows a user to finely position the eyewear adapter module 1710*n*.

FIG. 7P illustrates an eyewear adapter module 1710*p* that is adjustable using pinch pads 1711*p* for movement of the eyewear adapter module 1710*p* within resistance slide channels 1708*p*. For example, the user can pinch the pinch pads 1711*p* by squeezing the bottom of the eyewear and the top of the pinch pads 1711*p*. In response, the eyewear adapter module 1710*p* can slide downward within the resistance slider channels 1708*p* until a desirable or targeted position is achieved. This can advantageously allow a simple method for adjustment of the eyewear adapter module 1710*p* without the use of tools. This adjustment mechanism may also advantageously be easily manipulated while using gloves.

Figure 17Q:
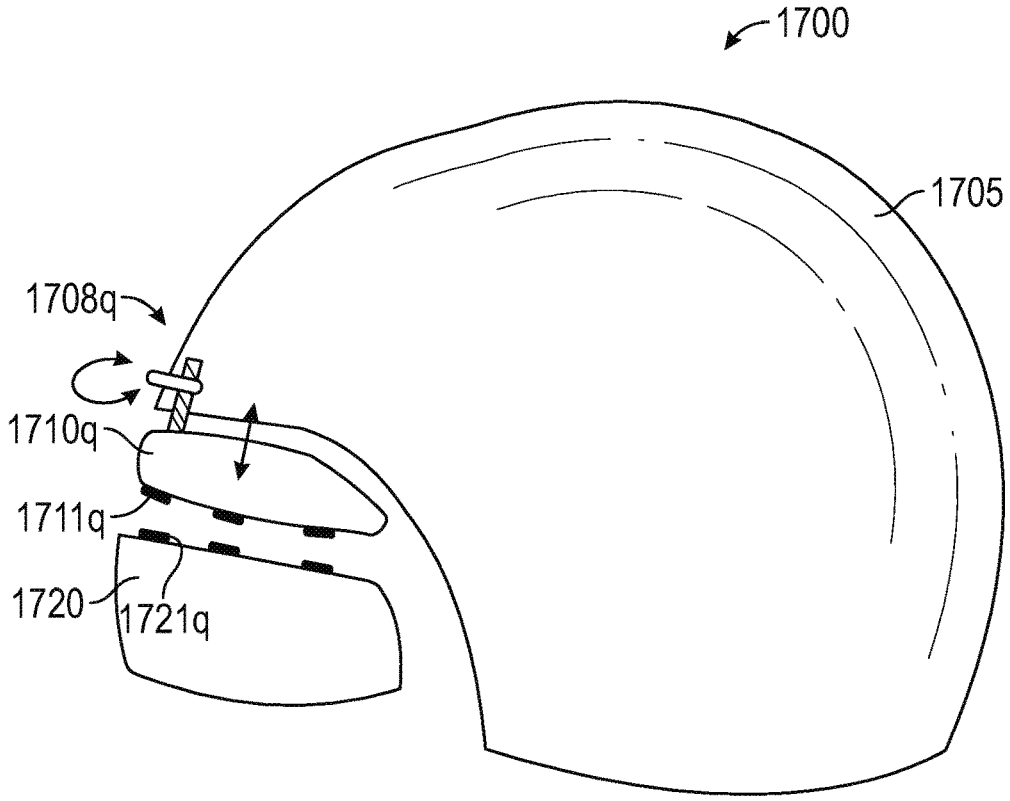

FIG. 17Q illustrates an eyewear adapter module 1710*q* similar to the eyewear adapter module 1710*o* described with reference to FIG. 17O. The eyewear adapter module 1710*q* is configured to move in response to manipulation of adjustment mechanism 1708*q* on the base portion 1705 (e.g., adjustment of a set screw with a knob). In addition, one or more of the eyewear adapter module 1710*q* and the eyewear can include magnets 1711*q*, 1721*q* to bias the eyewear adapter module 1710*q* and the eyewear toward one another and/or to resist separation. Similarly, other attachment methods can be used to resist separation of the eyewear and the eyewear adapter module 1710*q*, as described elsewhere herein.

Figure 17R:
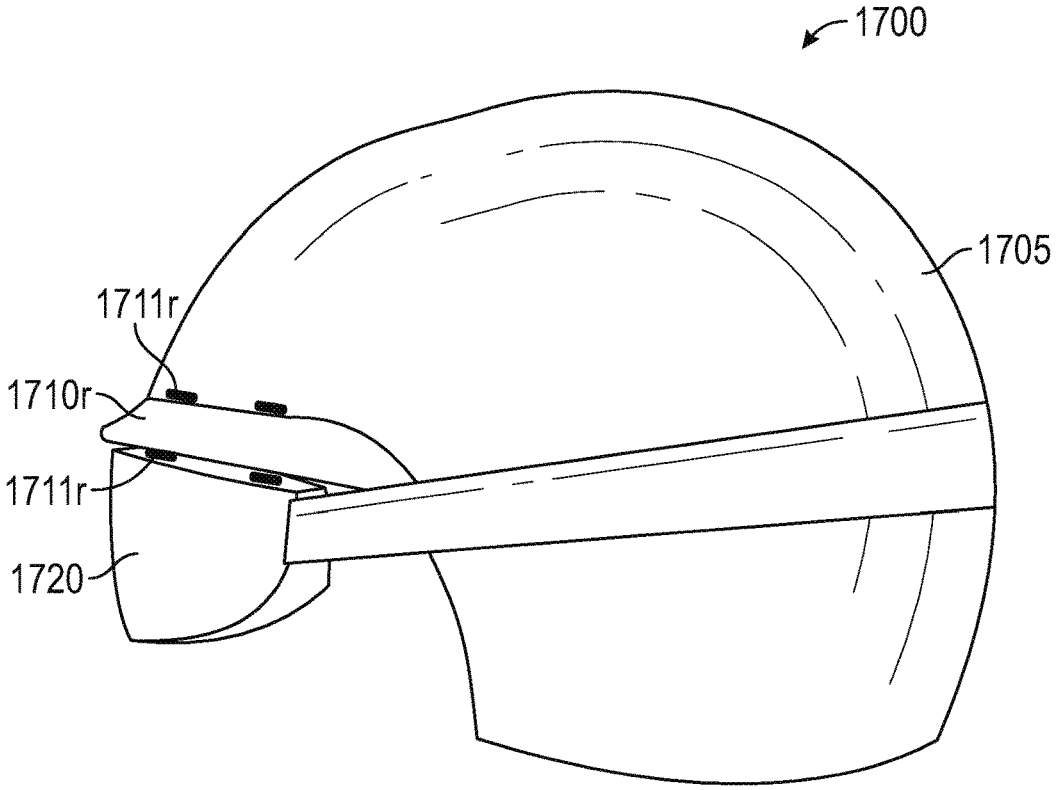

FIG. 17R illustrates an eyewear adapter module 1710*r* having reverse polarity magnets to create a floating eyewear adapter module 1710*r*. This can advantageously allow the eyewear adapter module 1710*r* to preferentially rest against a top of eyewear. The magnets 1711*r* can be attached to the eyewear adapter module 1710*r* and/or the base portion 1705.

Figure 17S:
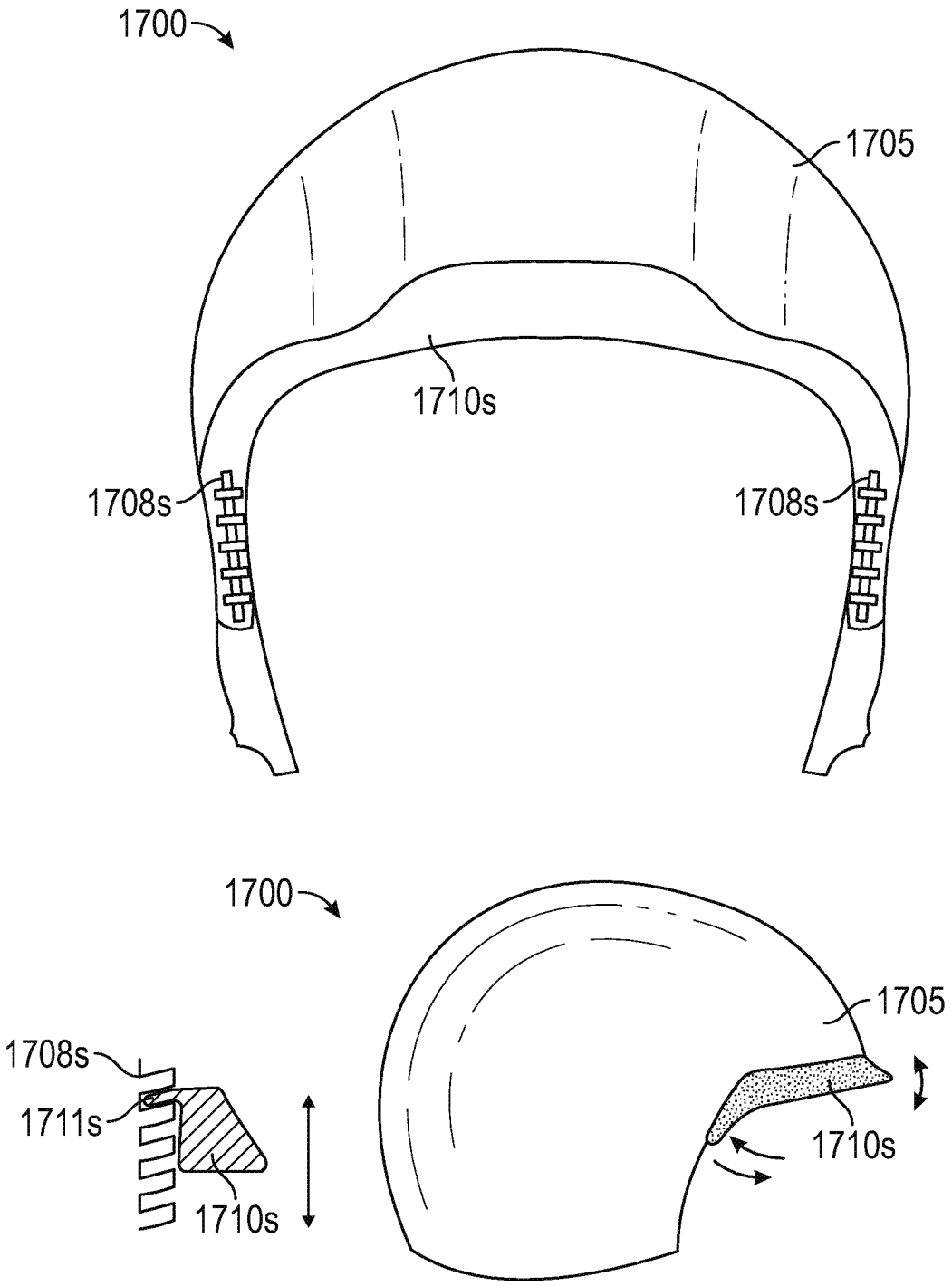

FIG. 17S illustrates an eyewear adapter module 1710*s* that is adjustable by interaction of a lip portion 1711*s* of the eyewear adapter module 1710*s* with teeth of an adjustment mechanism 1708*s* on the base portion 1705. The adjustment mechanism 1708*s* includes a plurality of teeth into which the lip portion 1711*s* can seat to substantially secure the eyewear adapter module 1710*s* in place. To adjust the position of the eyewear adapter module 1710*s*, the eyewear adapter module 1710 can be rotated away from the base portion 1705 while applying upward or downward force. To secure the eyewear adapter module 1710*s* into a selected position, the eyewear adapter module 1710*s* is rotated back toward the base portion 1705 so that the lip portion 1711*s* seats within the teeth of the adjustment mechanism 1708*s*.

Figure 17T:
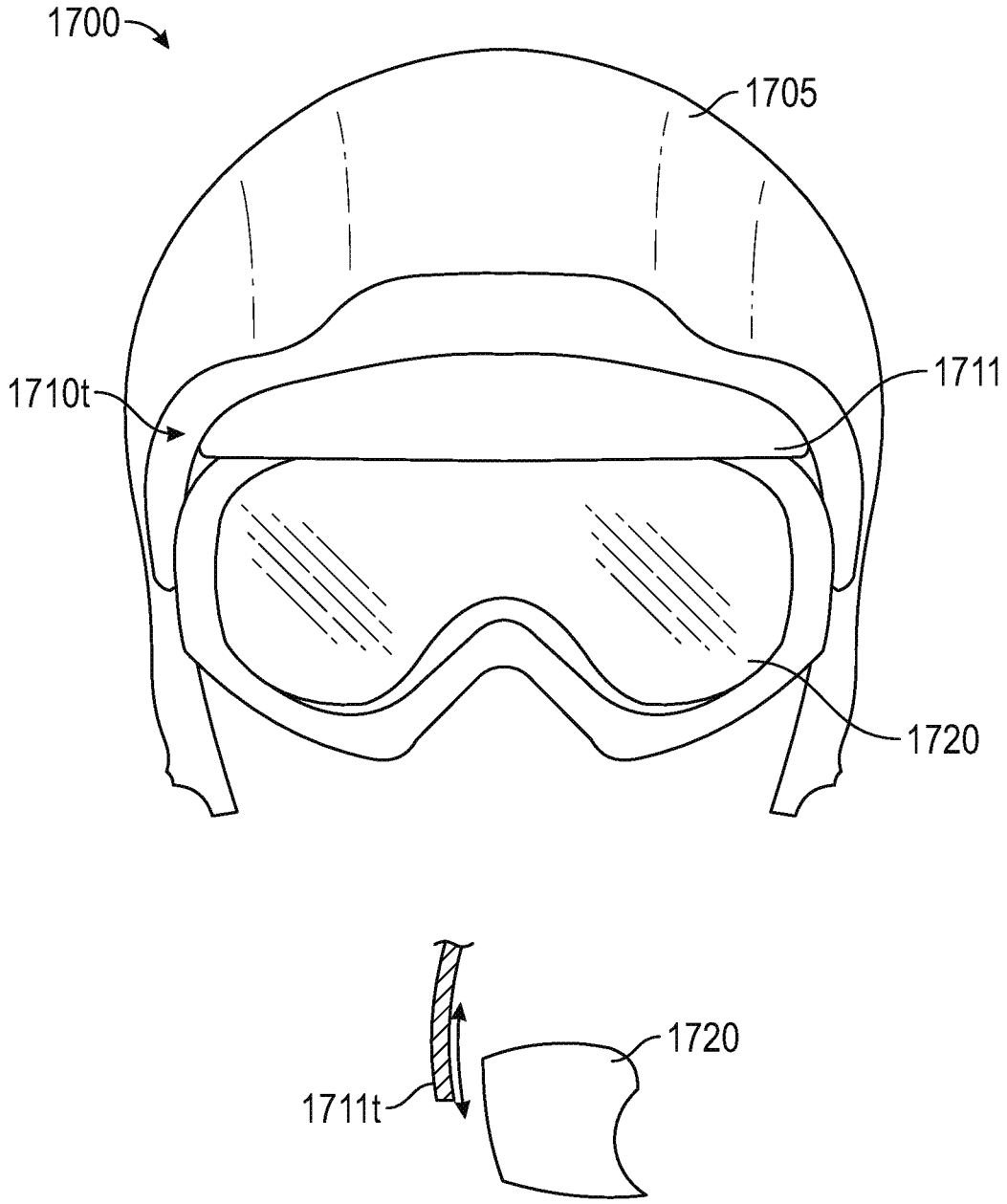

FIG. 17T illustrates an eyewear adapter module 710*t* having a brim or overhang portion 1711 configured to be positioned in front of the eyewear 1720. In some embodiments, the overhang portion 1711 is configured to not contact the eyewear 1720. In some embodiments, the overhang portion 1711 is made of a displaceable material so that it can contact the eyewear 1720 without causing a relatively large force on the eyewear 1720. This can advantageously allow for a pleasing aesthetic appearance and provide little or no visible gap between the eyewear adapter module 1710*t* and the eyewear 1720.

Attachment Mechanisms for Securing an Eyewear Adapter Module to a Helmet

FIGS. 18-34 provide examples of mechanisms for attaching an eyewear adapter module to a base portion of a helmet. It is to be understood that the mechanisms described herein for attaching eyewear adapter modules to a base portion of a helmet apply to other modules described herein that can be attached to the base portion. In addition, similar attachment mechanisms can be used to attach modules to one another. For example and without limitation, attachment or securing mechanisms can include connectors and/or mating connectors such as a detent, ball and socket, a key and slot, zippers, sliderless zippers, or any other suitable connecting feature or mechanism.

Figure 18:
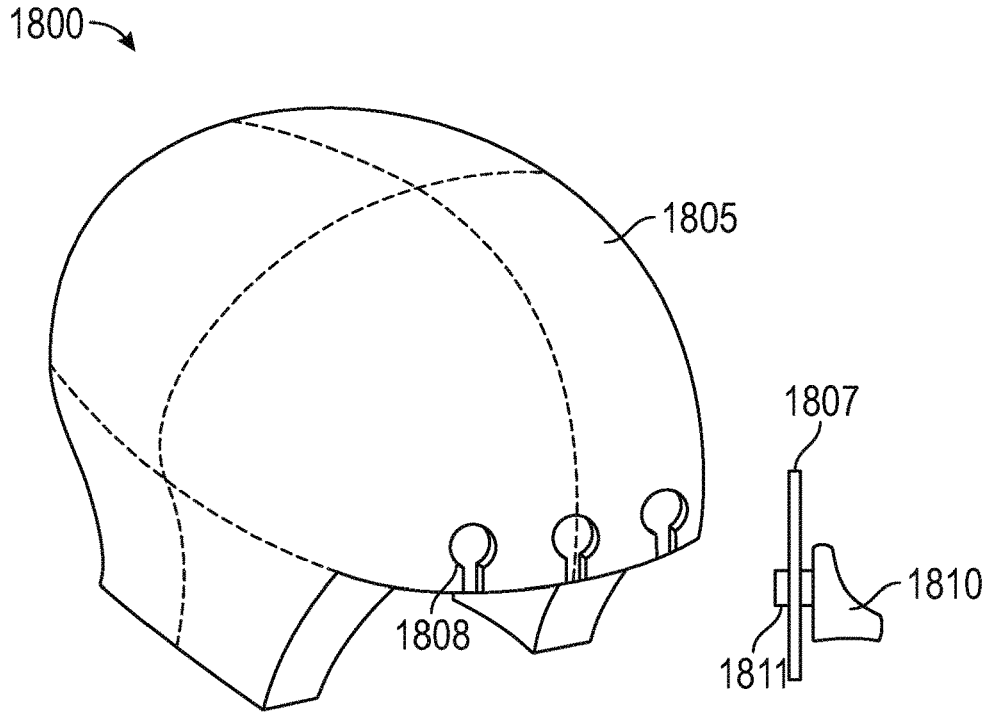
FIGS. 18-36 illustrate examples of mechanisms for attaching an eyewear adapter module to a base portion of a helmet.

FIG. 18 illustrates an example base portion 1805 of a helmet 1800, the base portion including a shell 1807. An eyewear adapter module 1810 can be attached to the base portion 1805 through features 1811 that extend from the back of the eyewear adapter module 1810 and that mate with receptacles 1808 on the shell 1807. The features 1811 can be deformable and/or the receptacles 1808 can be deformable. The receptacles 1808 can be shaped like a keyhole to allow the features 1811 to pass through the narrow portion of the keyhole and be secured within the larger portion of the keyhole. This can allow for a secure attachment that can be installed and removed with the application of force in the appropriate direction.

Figure 19:
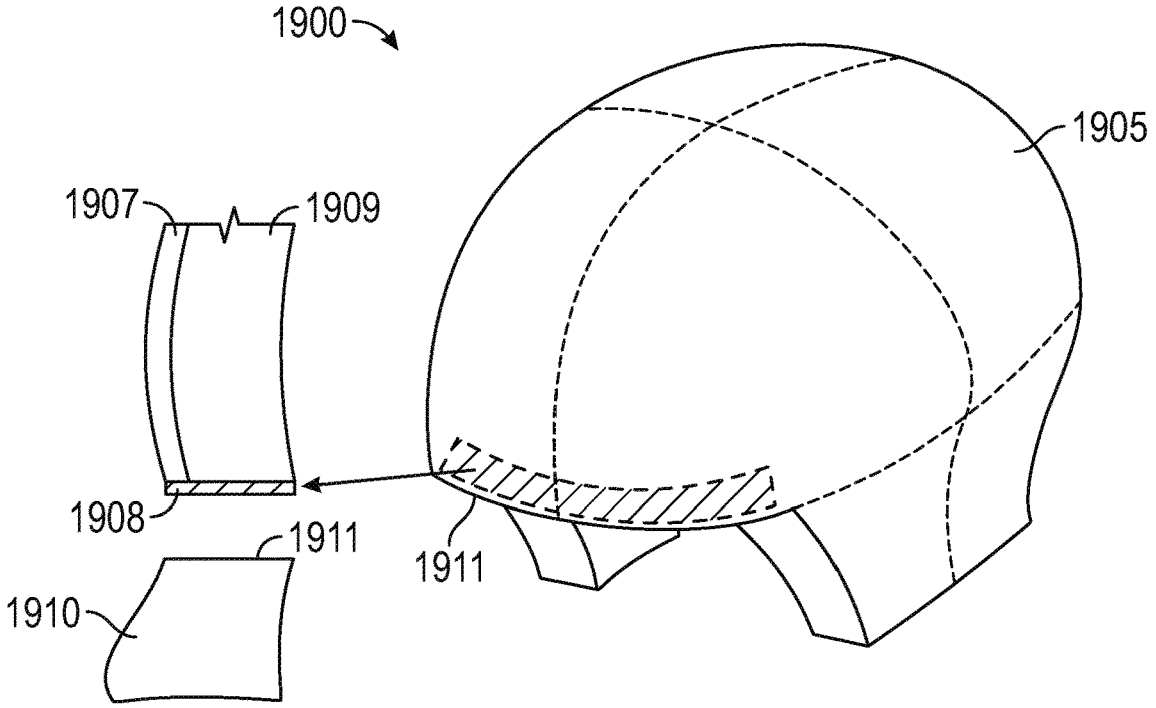

FIG. 19 illustrates an example base portion 1905 of a helmet 1900 wherein the base portion includes a shell 1907 and foam 1909. The shell 1907 and/or foam 1909 can include material on a surface 1908 of the base portion 1905, the material configured to provide semi-permanent or releasable attachment materials such as adhesives or hook-and-loop fastener material. A corresponding eyewear adapter module 1910 can then be secured in place against the helmet 1900 using the attachment materials (e.g., adhesives or hook-and-loop material), by abutting a surface 1911 of the eyewear adapter module 1910 against the surface 1908. A suitable downward force can be used to disengage the surfaces 1908, 1911 for removal of the eyewear adapter module 1910.

Figure 20:
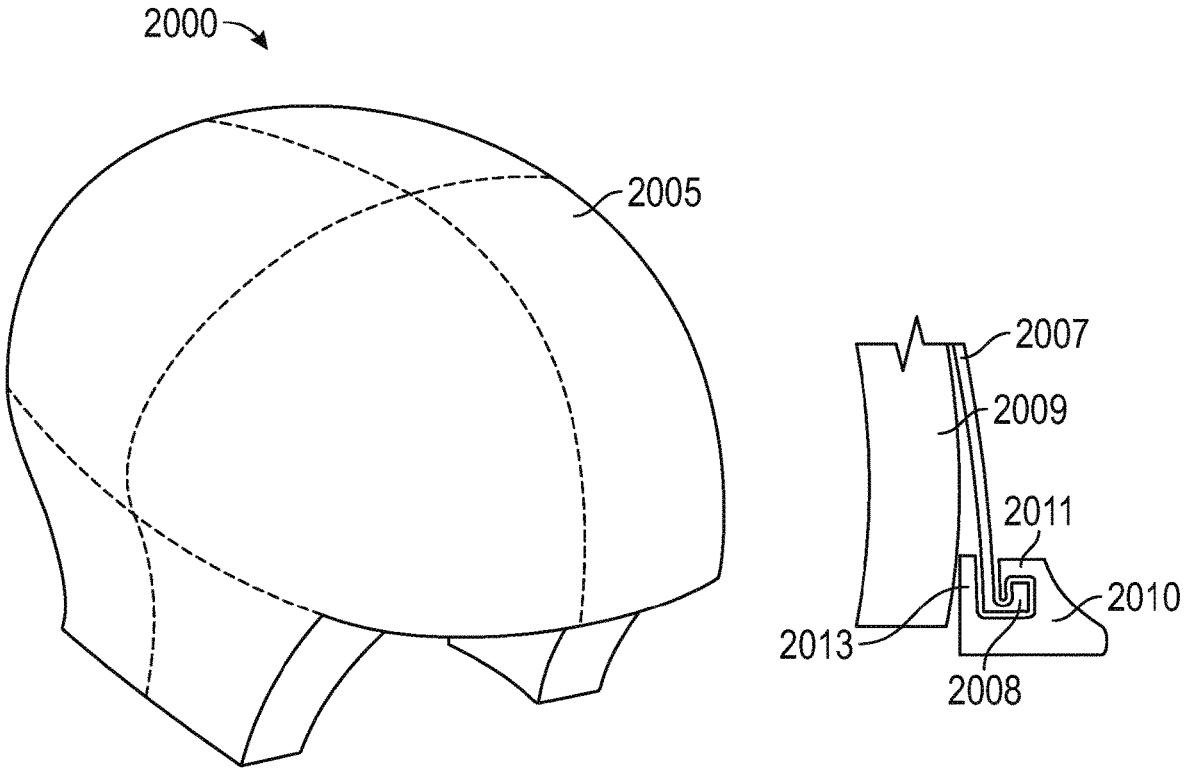

FIG. 20 illustrates a helmet 2000 having a base portion 2005 with a shell 2007 and foam 2009, the shell 2007 having a molded edge 2008. An eyewear adapter module 2010 includes a lip 2011 configured to mate with the molded edge 2008 of the shell 2007. The eyewear adapter module 2010 can be attached by sliding the eyewear adapter module 2010 up so that the lip 2011 overlaps the molded edge 2008 and a back wall 2013 of the eyewear adapter module 2010 is seated between the foam 2009 and the shell 2007. Similarly, applying a suitable downward force can disengage the eyewear adapter module lip 2011 from the molded edge 2008, allowing for removal of the eyewear adapter module 2010.

Figure 21:
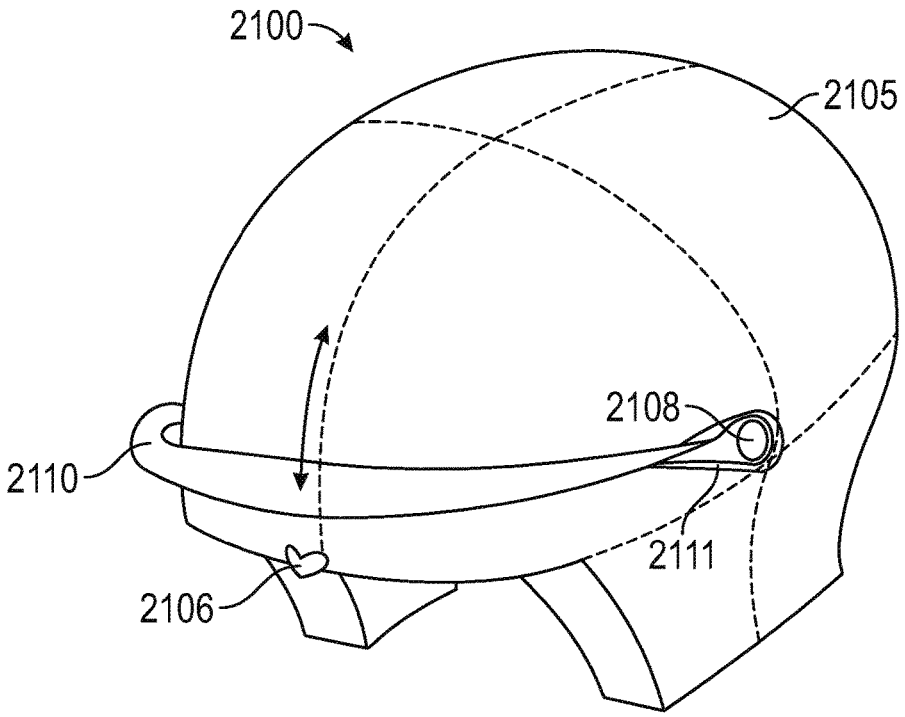

FIG. 21 illustrates a helmet 2100 having a roll and hook fastening mechanism on the base portion 2105 to attach an eyewear adapter module 2110. The base portion 2105 includes a roll 2108 configured to extend from the base portion 2105 so that a corresponding hook 2111 on the eyewear adapter module 2110 can latch onto the roll 2108. The roll 2108 can be located on corresponding sides of the base portion 2105 so that when the hooks 2111 of the eyewear adapter module 2110 are attached to the rolls 2108 of the base portion 2105, the eyewear adapter module 2110 can rotate down. The eyewear adapter module 2110 can be configured to be secured in place with a snap or latch 2106 on the base portion 2105. For example, when the eyewear adapter module 2110 rotates down to a particular point relative to the base portion 2105, the snap 2106 engages with a surface of the eyewear adapter module 2110 to secure it in place. Similarly, rotating the eyewear adapter module 2110 up with suitable force can disengage the snap 2106, allowing for removal of the eyewear adapter module 2110.

Figure 22:
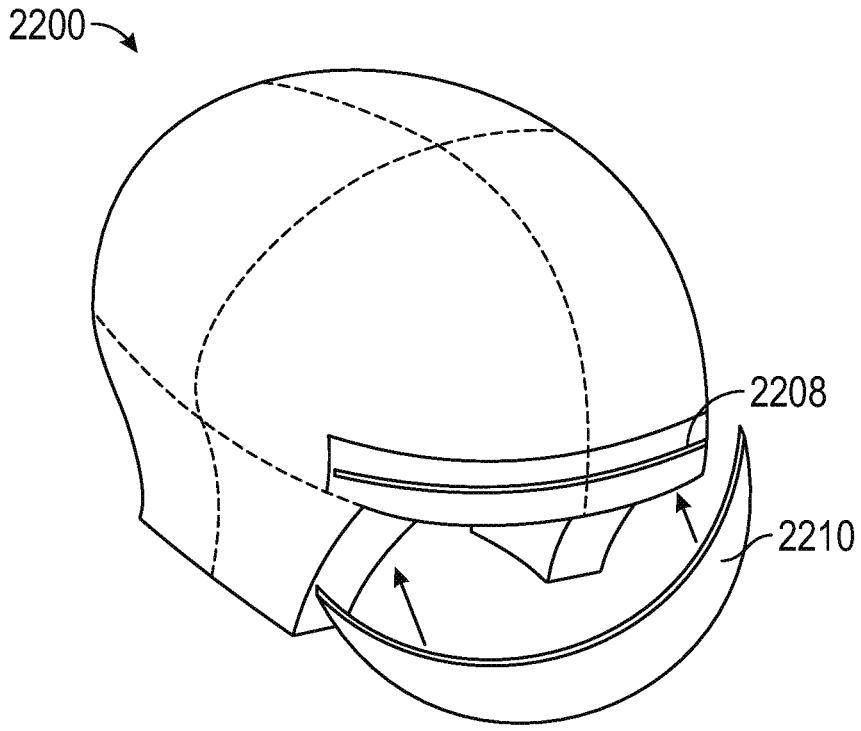

FIG. 22 illustrates a helmet 2200 having a base portion 2205 with a track 2208 configured to receive an eyewear adapter module 2210. An edge of the eyewear adapter module 2210 can be seated within the track 2208 to secure the eyewear adapter module 2210 in place. To remove the eyewear adapter module 2210, the eyewear adapter module 2210 can be pulled from the base portion 2205 until the eyewear adapter module 2210 is released from the track 2208.

Figure 23:
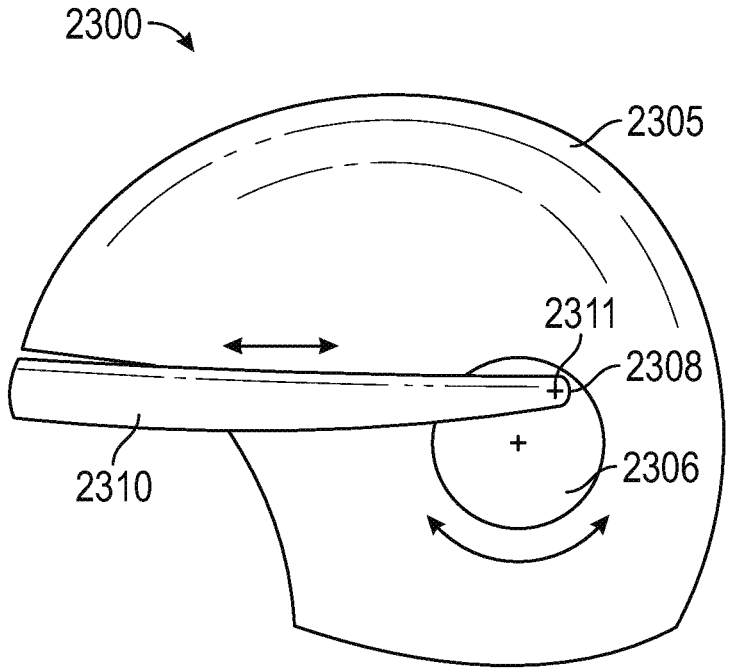

FIG. 23 illustrates a helmet 2300 with a twist lock mechanism for securing an eyewear adapter module 2300 to a base portion 2305. The base portion 2305 can include a knob 2306 having a latch 2308 for receiving a corresponding latch 2311 on the eyewear adapter module 2310. The eyewear adapter module 2310 can be flexible to allow for the eyewear adapter module latches 2311 to be seated onto the base portion latches 2308. Once attached, the knob 2306 can be rotated to advance and lock the eyewear adapter module 2310 into place. Similarly, rotating the knob 2306 in the other direction can be used to disengage and remove the eyewear adapter module 2310.

Figure 24:
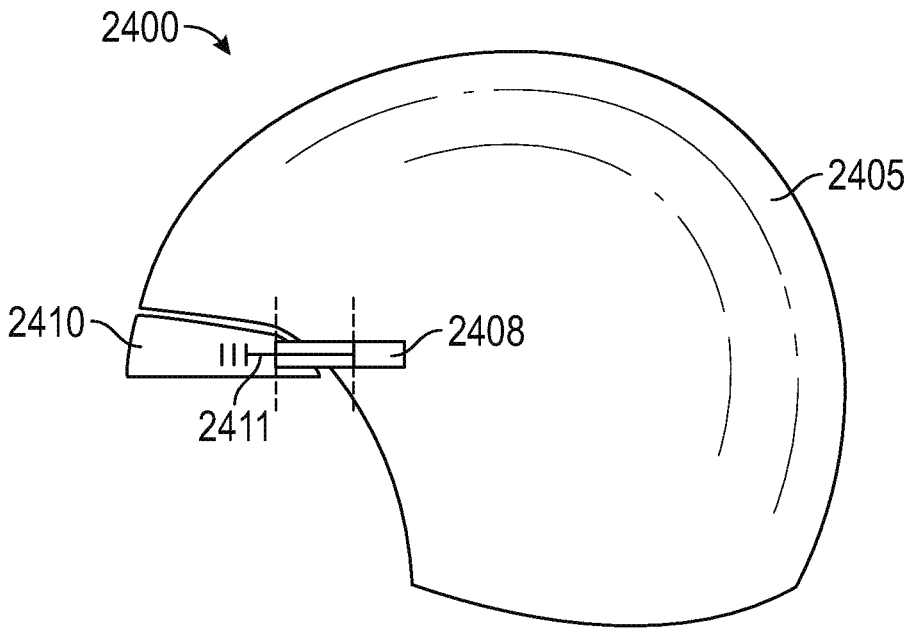

FIG. 24 illustrates a helmet 2400 having a base portion 2405 with buckle hooks 2408 for attaching an eyewear adapter module 2410 having buckles 2411. This mechanism is similar to buckles on ski boots. For example, the eyewear adapter module 2410 can be placed in position and the buckles 2411 can be seated into a suitable buckle hook 2408 on the base portion 2405. The buckles 2411 can be rotated to secure the eyewear adapter module 2410 into place pulling the eyewear adapter module 2410 against the base portion 2405. Undoing the buckles 2411 by rotating them in the opposite direction will remove the pressure between the eyewear adapter module 2410 and the base portion 2405, allowing for removal of the eyewear adapter module.

Figure 25:
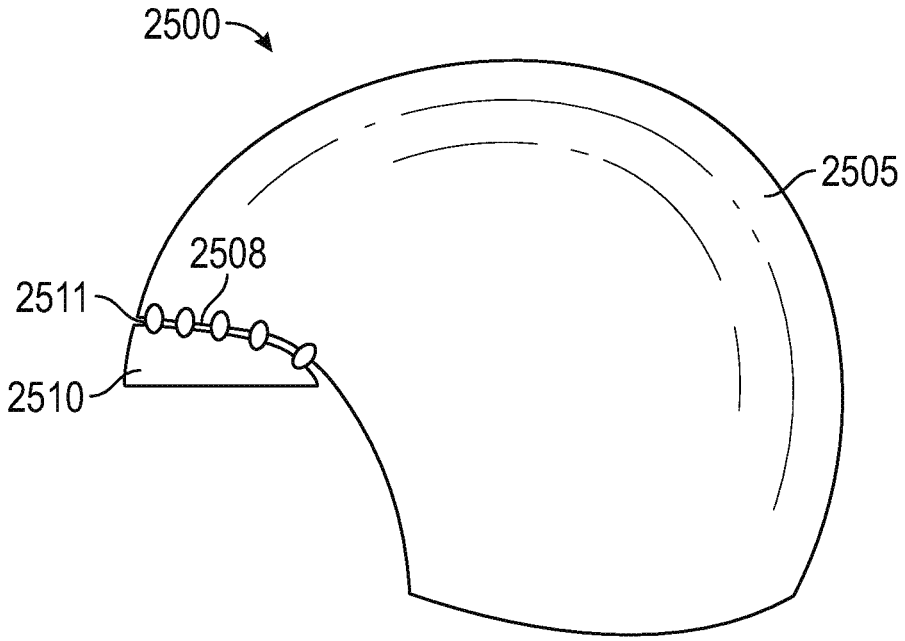

FIG. 25 illustrates a helmet 2500 comprising a base portion 2505 with a plurality of holes 2508. An eyewear adapter module 2510 can include pliable material 2511 to secure the eyewear adapter module 2510 against the base portion 2505 by tying or otherwise securing the pliable material through the holes 2508. For example, the pliable material 2511 can include zip ties or laces that can be used to secure the eyewear adapter module 2510 to the base portion 2505.

Figure 26:
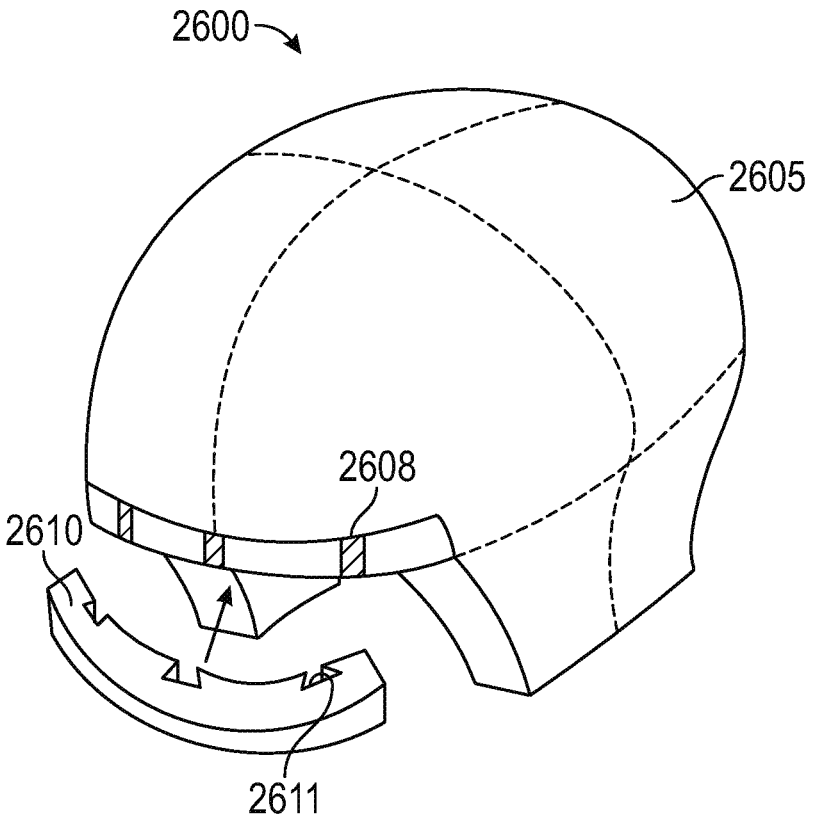

FIG. 26 illustrates a helmet 2600 having a base portion 2605 with a plurality of dove-tail protrusions 2608 on a front surface. An eyewear adapter module 2610 can include complementary dove-tail recessions 2611 that mate with the dove-tail protrusions 2608. By applying suitable force upward, the dove-tail protrusions 2608 can be seated within the dove-tail recessions 2611 and secure the eyewear adapter module 2610 in place. In some implementations, the fit between the protrusions and receptacles is such that friction secures the eyewear adapter module 2610 in place. In certain implementations, an additional locking mechanism can be used to secure the eyewear adapter module 2610 in place.

Figure 27:
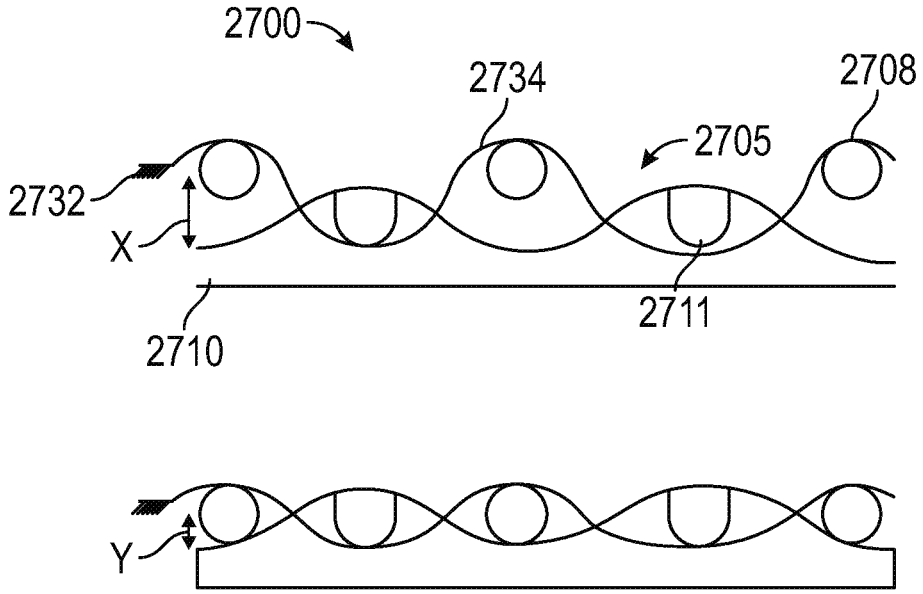

FIG. 27 illustrates an attachment mechanism configured to secure an eyewear adapter module 2710 to a base portion 2705 of a helmet 2700. The base portion 2705 can include an anchor point 2732 configured to secure one end of a wire 2734. The wire 2734 can be configured to be weaved or interleaved between support points 2708 on the base portion 2705 and protrusions 2711 on the eyewear adapter module 2710. When the wire 2734 is pulled, the force causes the eyewear adapter module 2710 to be forced adjacent to the base portion 2705, securing the eyewear adapter module 2710 in place. To remove, the wire 2734 can be loosened, allowing the eyewear adapter module 2710 to be removed from the base portion 2705. For example, a knob can be used to engage the wire 2734 and turning the knob can pull the wire 2734 to tighten the wire 2734. To loosen, the knob can be pulled to disengage the wire 2734.

Figure 28:
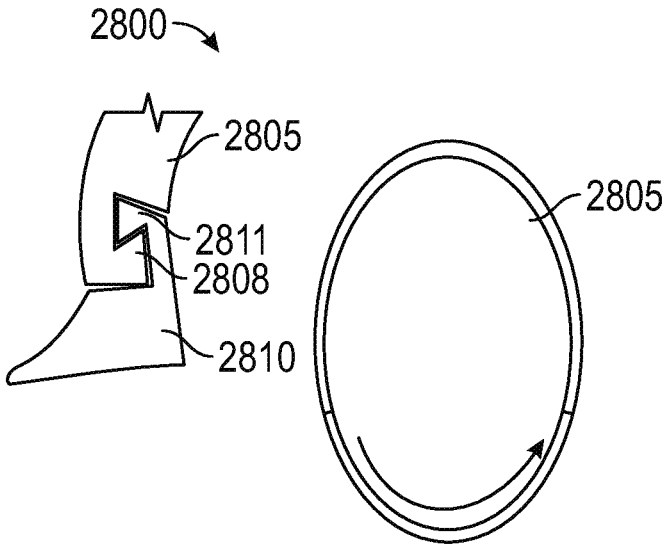

FIG. 28 illustrates a helmet 2800 having a base portion 2805 with a dove-tail recession 2808 molded into an edge of the base portion 2805. An eyewear adapter module 2810 can include a complementary dove-tail protrusion 2811 that mates with the dove-tail recession 2808. The dove-tail recession 2808 can run along a lower surface of the base portion 2805, above the eyes of a wearer. By applying suitable force, the dove-tail protrusion 2811 can be fed into the dove-tail recession 2808. The eyewear adapter module 2810 can be secured in place by sliding the flexible eyewear adapter module 2810 around until fully seated on the base portion 2805. In some implementations, the fit between the protrusions and receptacles is such that friction secures the eyewear adapter module 2810 in place. In certain implementations, an additional locking mechanism can be used to secure the eyewear adapter module 2810 in place.

Figure 29:
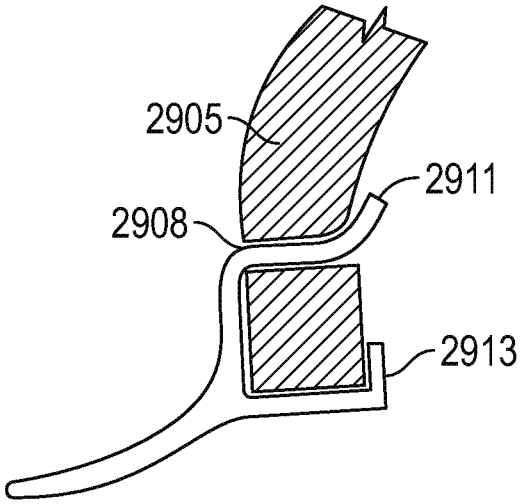

FIG. 29 illustrates a helmet 2900 having a base portion 2905 with a plurality of apertures 2908 configured to receive a plurality of corresponding protrusions 2911 of an eyewear adapter module 2910. The eyewear adapter module 2910 can additionally include a bottom lip 2913 configured to mate with a bottom surface of the base portion 2905. By placing the bottom lip 2913 so that it mates with the bottom surface of the base portion 2905, the eyewear adapter module 2910 can then be rotated upwards to seat the protrusions 2911 within corresponding apertures 2908. The configuration of the protrusions 2911, apertures 2908, and bottom lip 2913 can be such that the eyewear adapter module 2910 is secured in place when the protrusions are seated within the apertures 2908. Removal of the eyewear adapter module 2910 can be accomplished through suitable force applied to rotate the eyewear adapter module 2910 downward.

Figure 30:
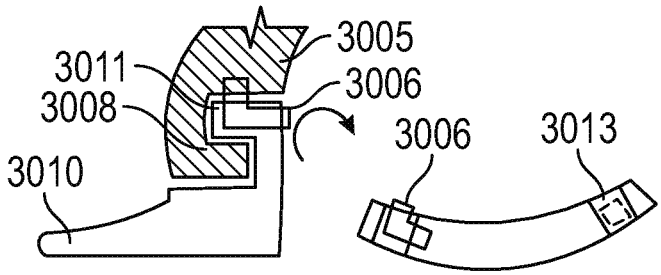

FIG. 30 illustrates a helmet 3000 having a base portion 3005 with a recession 3008 molded into an edge of the base portion 3005. An eyewear adapter module 3010 can include a complementary protrusion 3011 that mates with the recession 3008. The eyewear adapter module 3010 can be installed by seating the protrusion 3011 within the recession 3008. The eyewear adapter module 3010 can be locked into place using a suitable fastener 3006, such as a quarter-turn fastener (e.g., a DZUS® fastener). The eyewear adapter module 3010 can include a suitable aperture 3013 configured to allow the fastener 3006 to rotate into and out of a secured, fastened position. Removal of the eyewear adapter module 3010 can be accomplished by removing or loosening the fastener.

Figure 31:
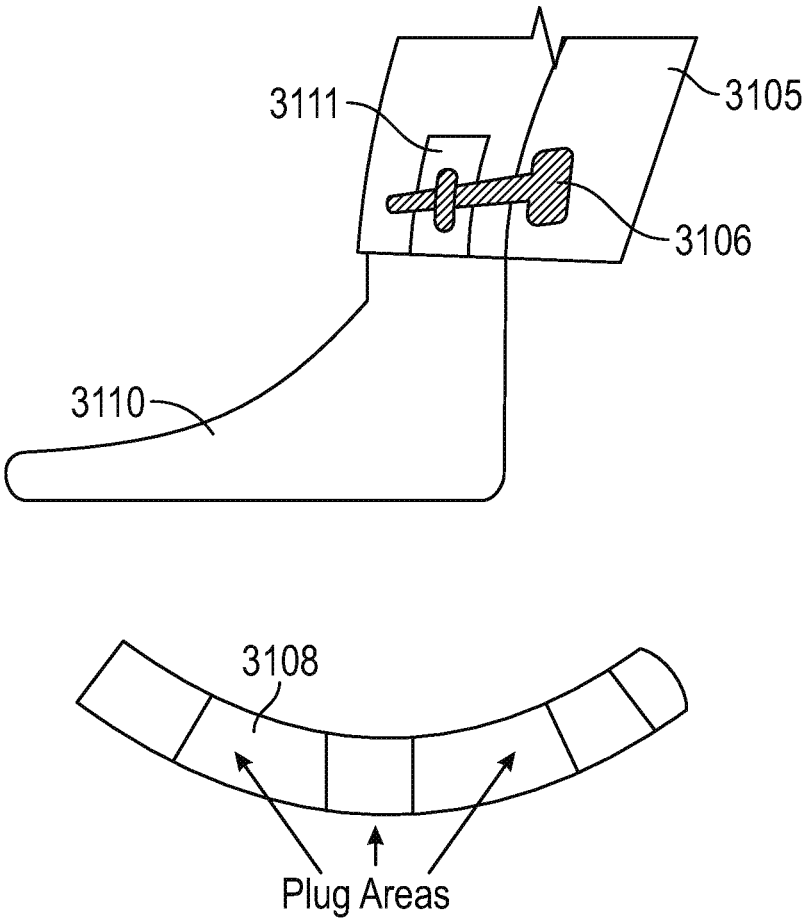

FIG. 31 illustrates a helmet 3100 having a base portion 3105 with a plurality of plug areas 3108. An eyewear adapter module 3110 can be configured to be attached to the base portion by inserting a portion of the eyewear adapter module 3110 into the plug areas 3108 and inserting a plurality of plugs 3106 through corresponding plug areas 3108 and through corresponding holes 3111 in the eyewear adapter module 3110. The plugs 3106 can be inserted from the interior of the helmet 3100 towards the exterior, or from the exterior of the helmet 3100 towards the interior. Removal of the eyewear adapter module 3110 can be accomplished by removing the plurality of plugs 3106.

Figure 32:
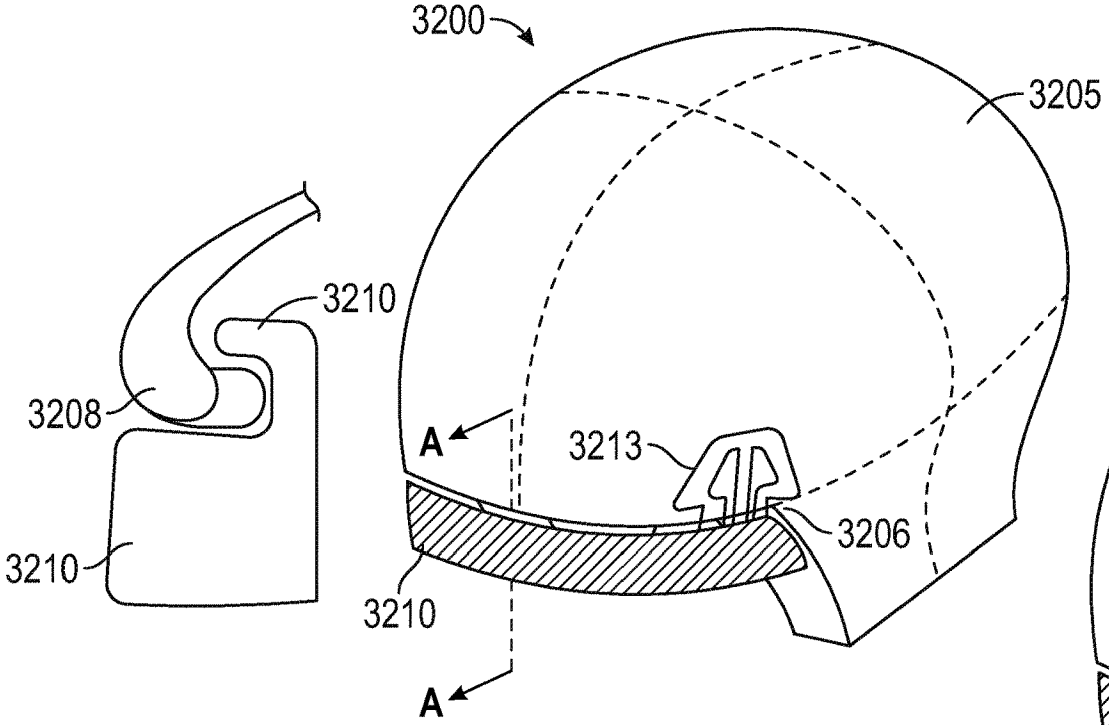

FIG. 32 illustrates a helmet 3200 having a base portion 3205 configured to receive an eyewear adapter module 3210. The base portion 3205 and eyewear adapter module 3210 include corresponding mechanical features at the front of the helmet 3200 that allow the eyewear adapter module 3010 and the base portion to interlock. The eyewear adapter module 3210 includes a lip 3211 configured to be compatible with a lip 3208 on the base portion 3205. The eyewear adapter module 3210 can be rotated to engage the eyewear adapter module lip 3211 and the base portion lip 3208. In addition, securing attachments 3213 on the eyewear adapter module 3210 can rotate into and through corresponding securing apertures in the base portion 3205. The securing attachments 3213 can be configured to deform when sliding through the securing apertures and return to their size after being pushed through the apertures to secure the eyewear adapter module 3210 in place. To remove the eyewear adapter module 3210, the eyewear adapter module 3210 can be rotated up and away from the base portion 3205 while putting inward pressure in the securing attachments 3213 to allow them to deform for passage through the securing apertures.

Figure 33:
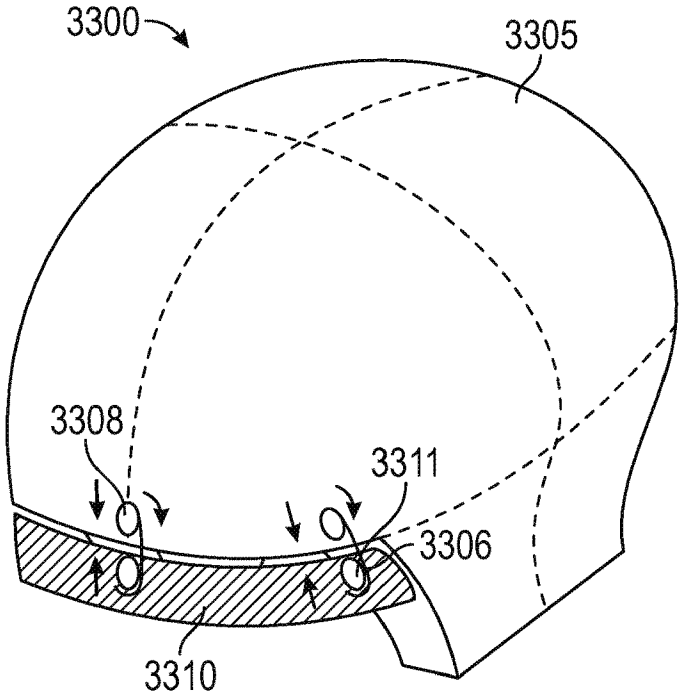

FIG. 33 illustrates a helmet 3300 having a plurality of rotating fasteners 3308 with hooks 3306 on a base portion 3305. An eyewear adapter module 3310 includes a plurality of corresponding latches 3311 configured to receive the hooks 3306. When the hooks 3306 are engaged on the latches 3311, the rotating fasteners 3308 can be rotated to close the gap between the eyewear adapter module 3310 and the base portion 3305 and to secure the eyewear adapter module 3310 to the base portion 3305. Removal of the eyewear adapter module 3310 can be accomplished by rotating the rotating fasteners in the opposite direction and disengaging the hooks 3306 and the latches 3311.

Figure 34:
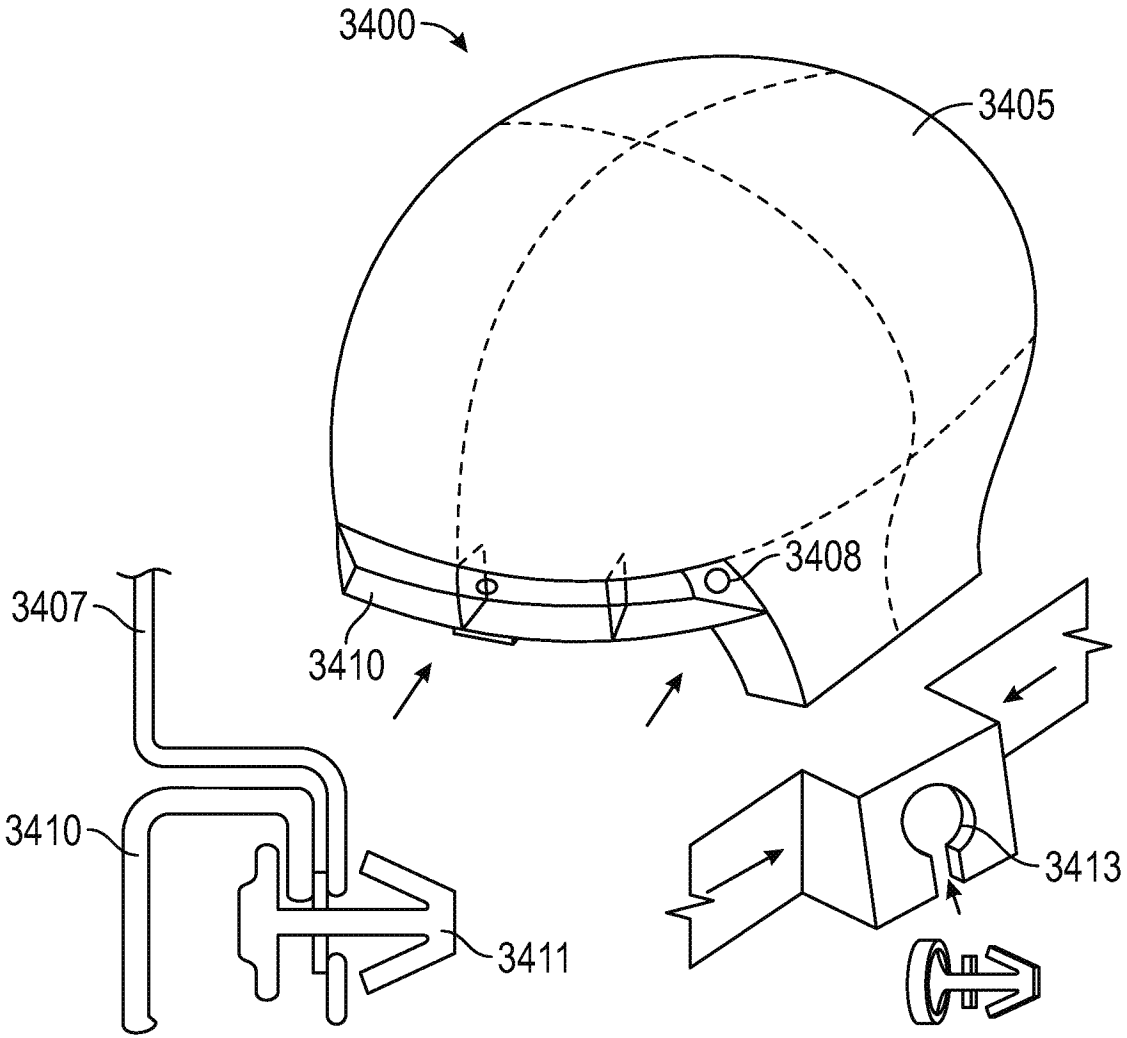

FIG. 34 illustrates a helmet 3400 having a base portion 3405 with a plurality of holes 3408. An eyewear adapter module 3410 can include a plurality of Christmas tree fasteners 3411 aligned with the plurality of holes 3408 when installed. The fasteners 3411 can be installed in corresponding receptacles 3413 on the eyewear adapter module 3410. To install the eyewear adapter module 3410, the eyewear adapter module 3410 is advanced toward the base portion 3405 until the fasteners 3411 pass through the corresponding holes 3408 to secure the eyewear adapter module 3410 in place. Suitable force pulling the eyewear adapter module 3410 away from the base portion 3405 can be applied for removal.

Figure 35:
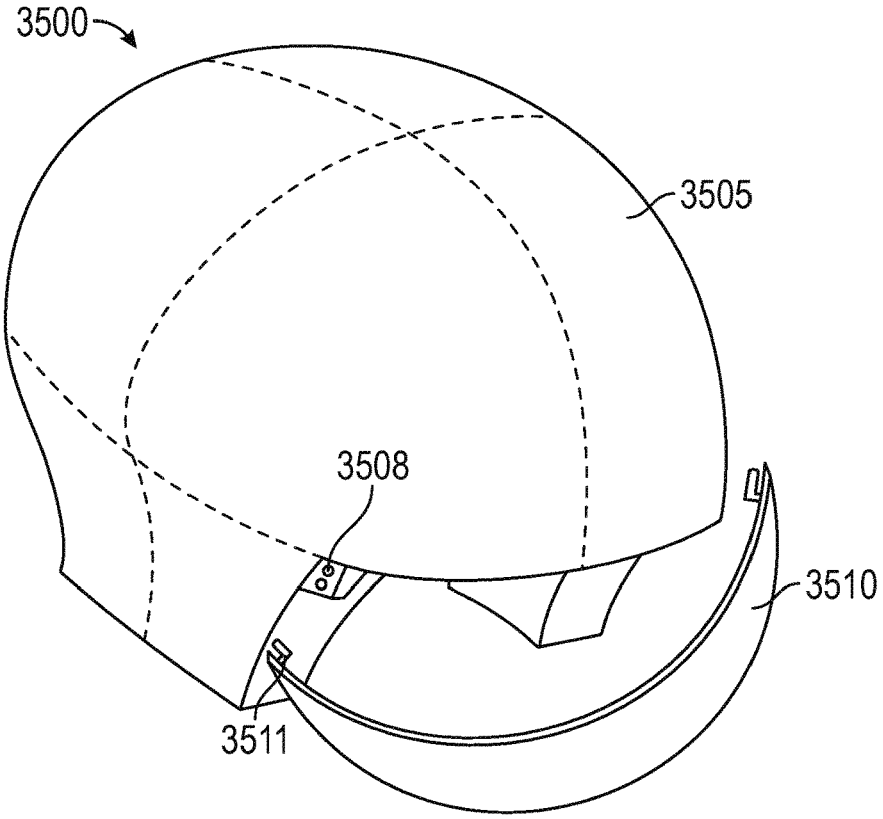
Figure 36:
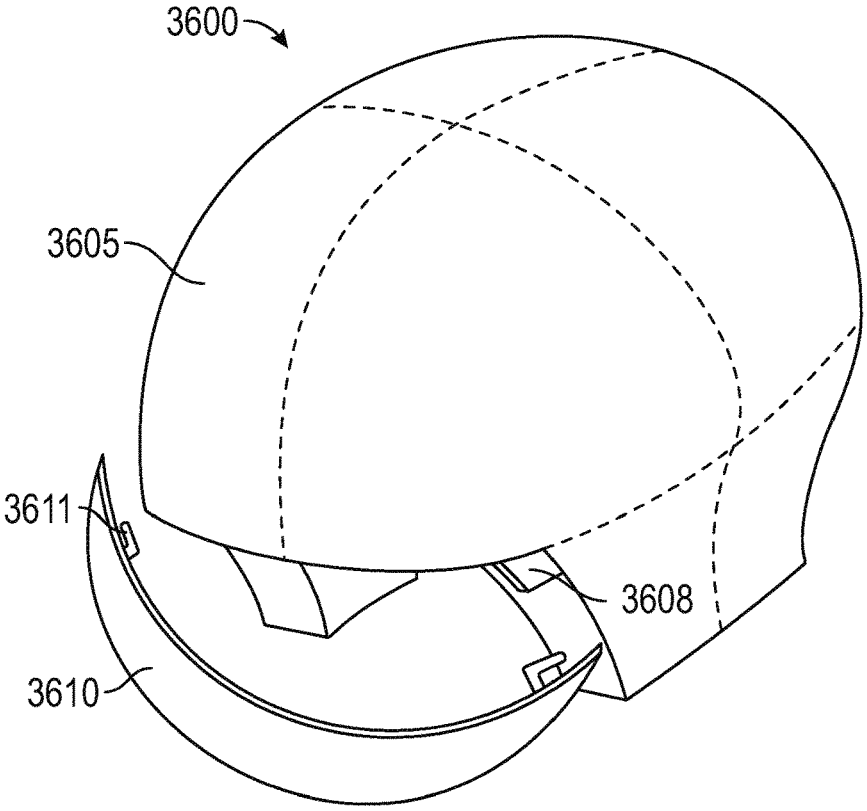

FIG. 35 illustrates a helmet 3500 having clip receptacles 3508 on the base portion 3505 to receive complementary clips 3511 on eyewear adapter module 3510. The eyewear adapter module 3510 can be flexible to allow it to be opened and closed for installation and removal. The clips 3511 can be c-clips that allow easy installation and removal in concert with the receptacles 3508. FIG. 36 illustrates a helmet 3600 having hook attachments 3608 on the base portion 3605 to receive hooks 3611 on an eyewear adapter module 3610. The eyewear adapter module 3610 can be made of a flexible material to allow compression. The hooks 3611 can be configured to attach on the inside of the base portion 3605 in multiple positions. Both the eyewear adapter module 3510 and the eyewear adapter module 3610 can be configured to be removed and installed in a variety of positions, allowing the user to adjust the position of the eyewear adapter module 3510, 3610.

Example Mechanical Modules for a Helmet with Modular Components

Figure 37A:
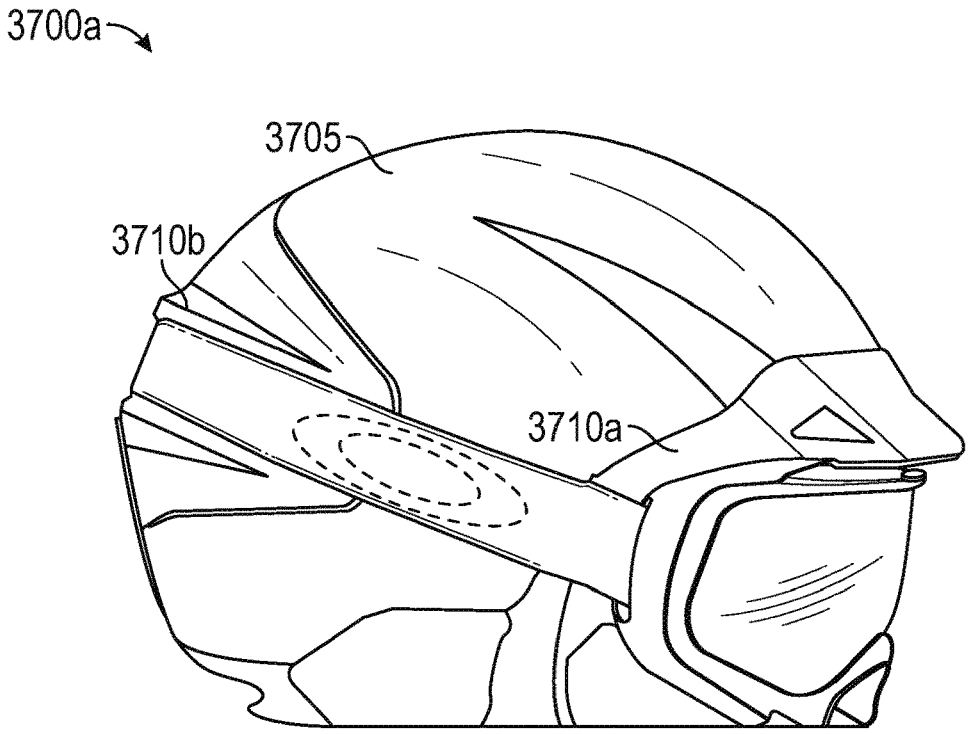
FIGS. 37A-38 illustrate example mechanical modules that can be attached to modular helmet.
Figure 37B:
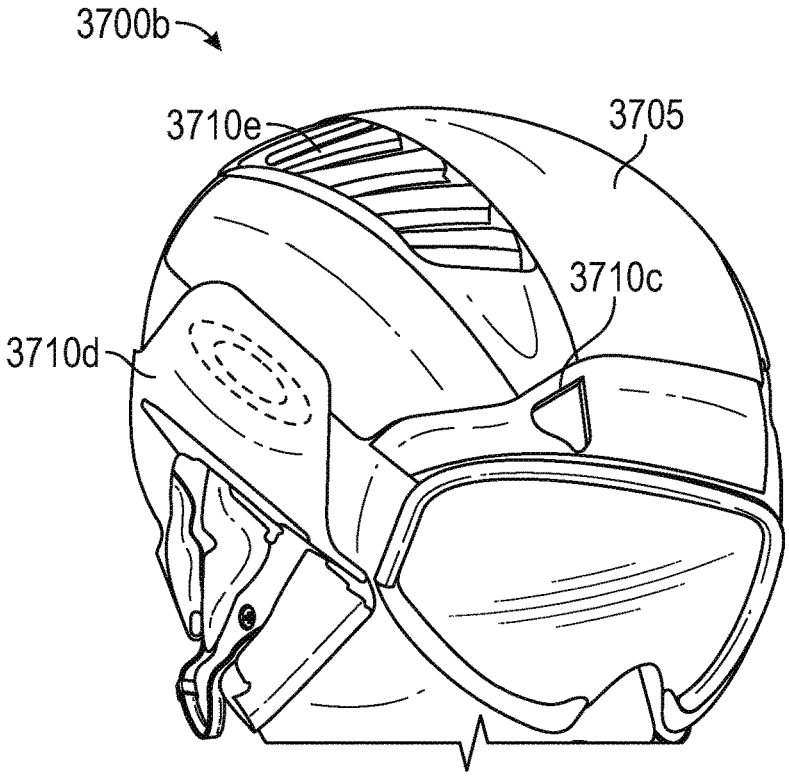
Figure 38:
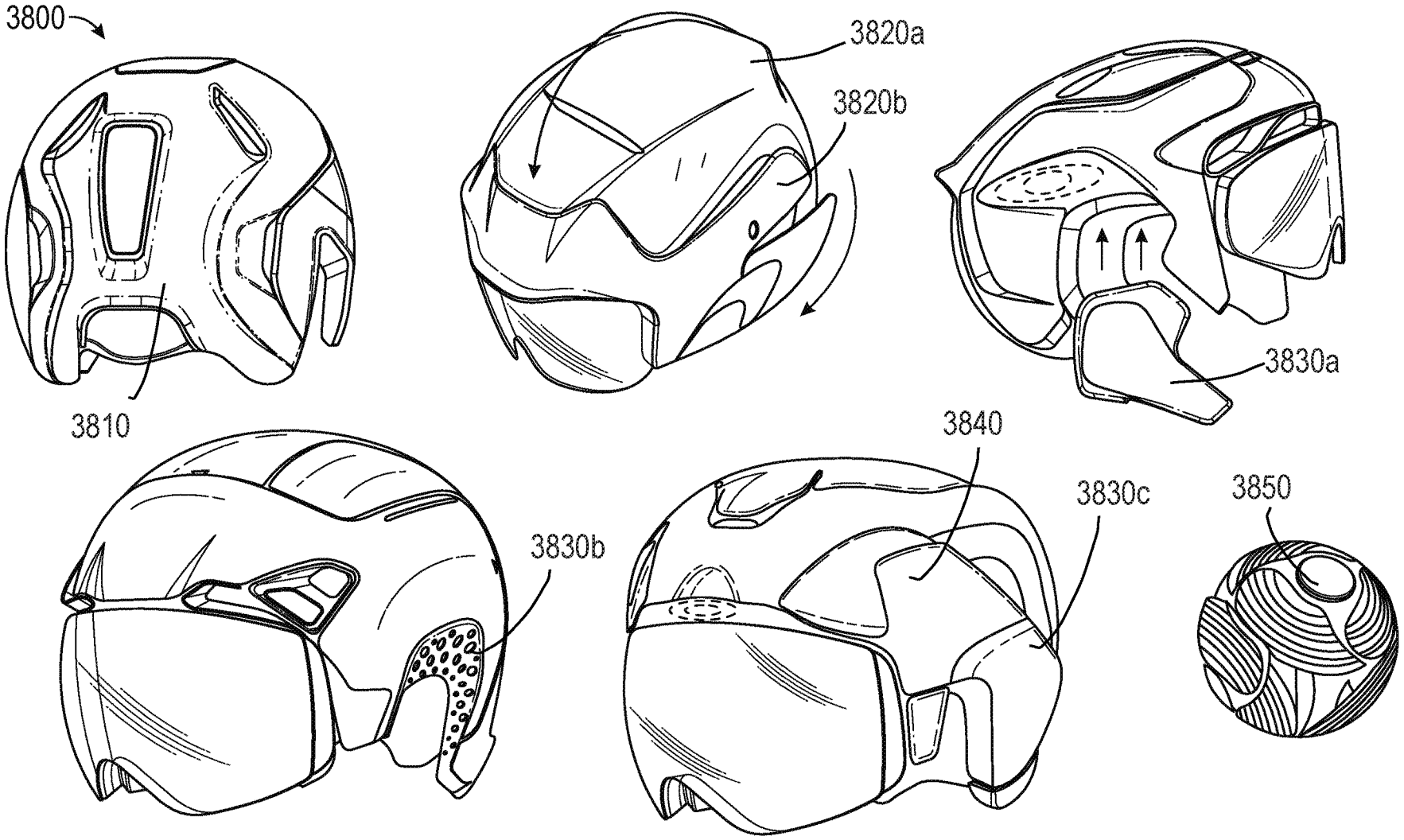
Figure 39A:
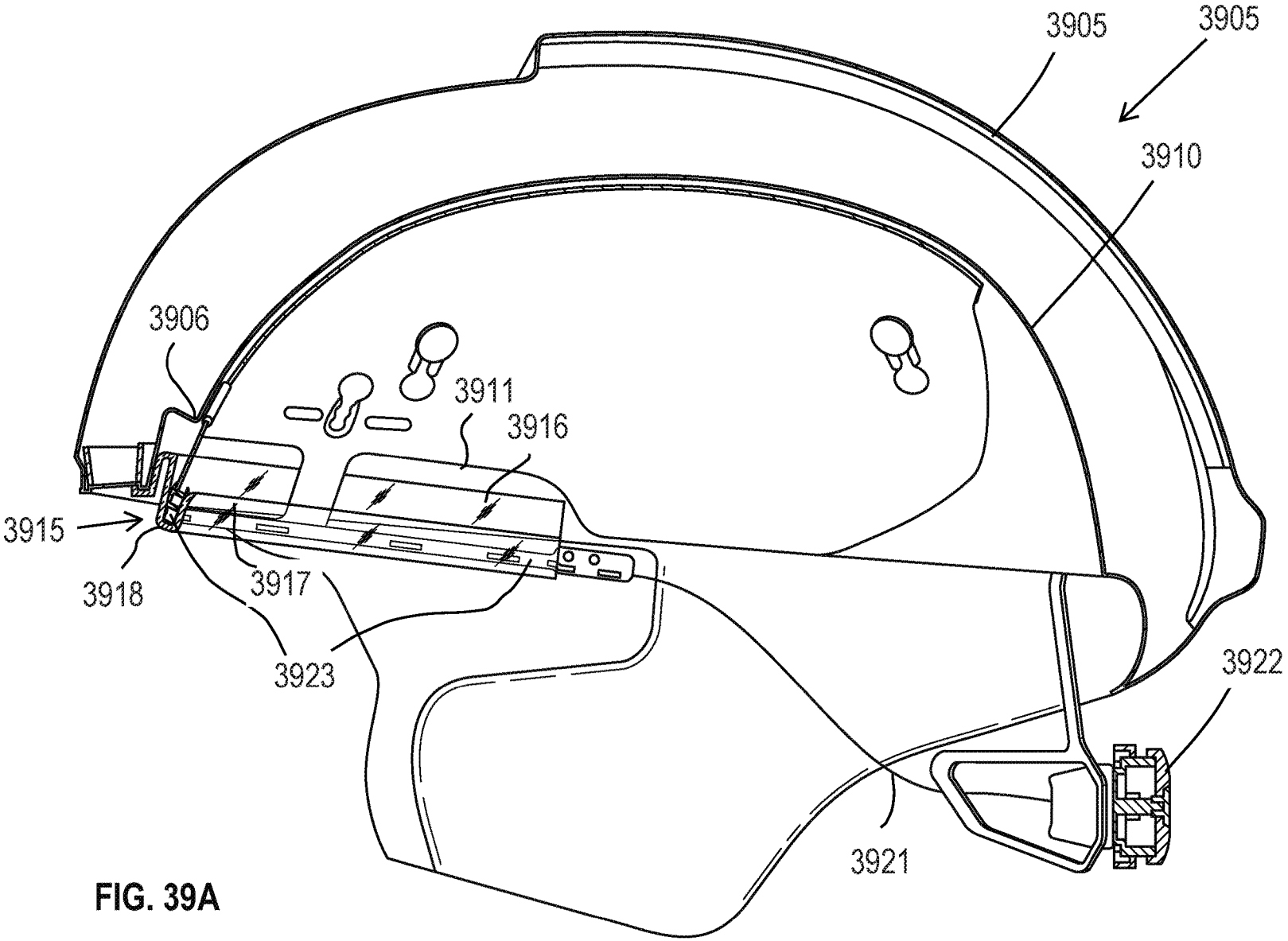
FIGS. 39A-D illustrate a helmet having an internal gutter for capturing and directing sweat and other liquids away from a face of a wearer.
Figure 39B:
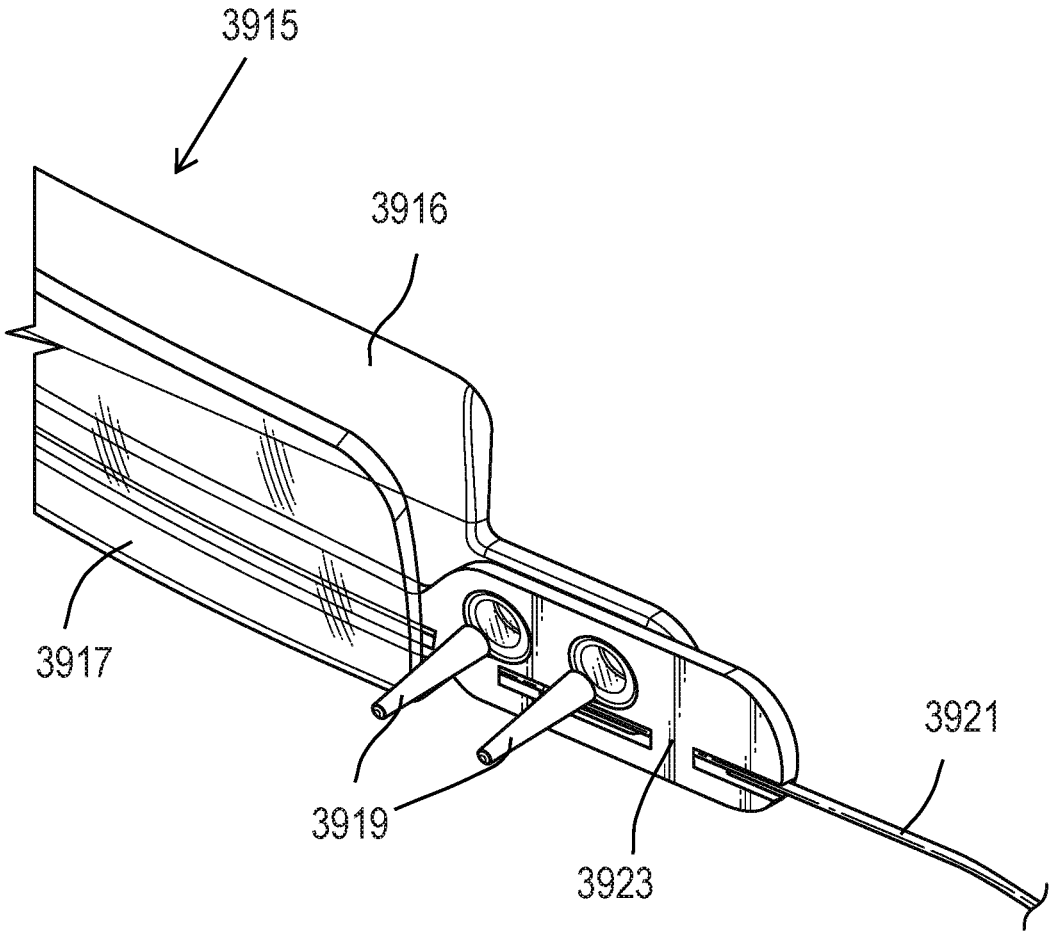
Figure 39C:
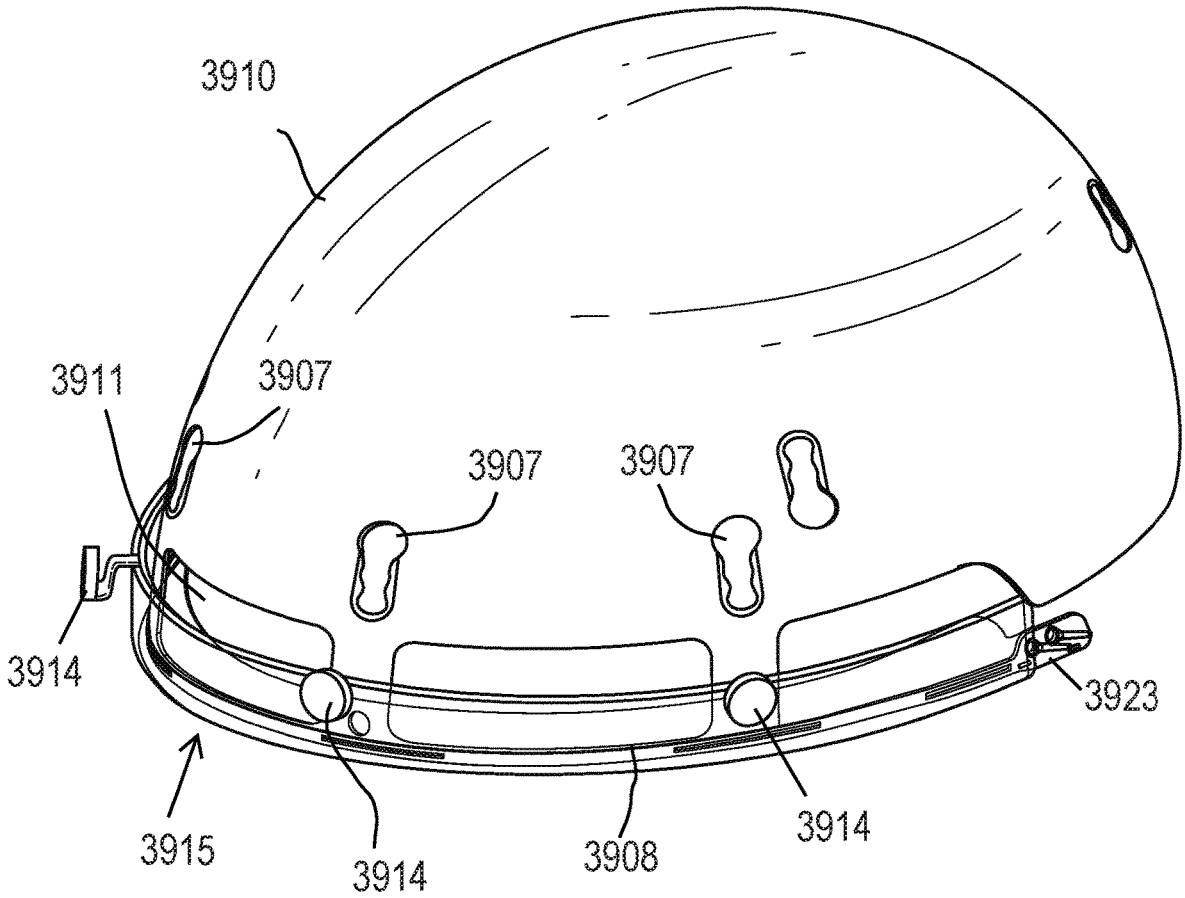
Figure 39D:
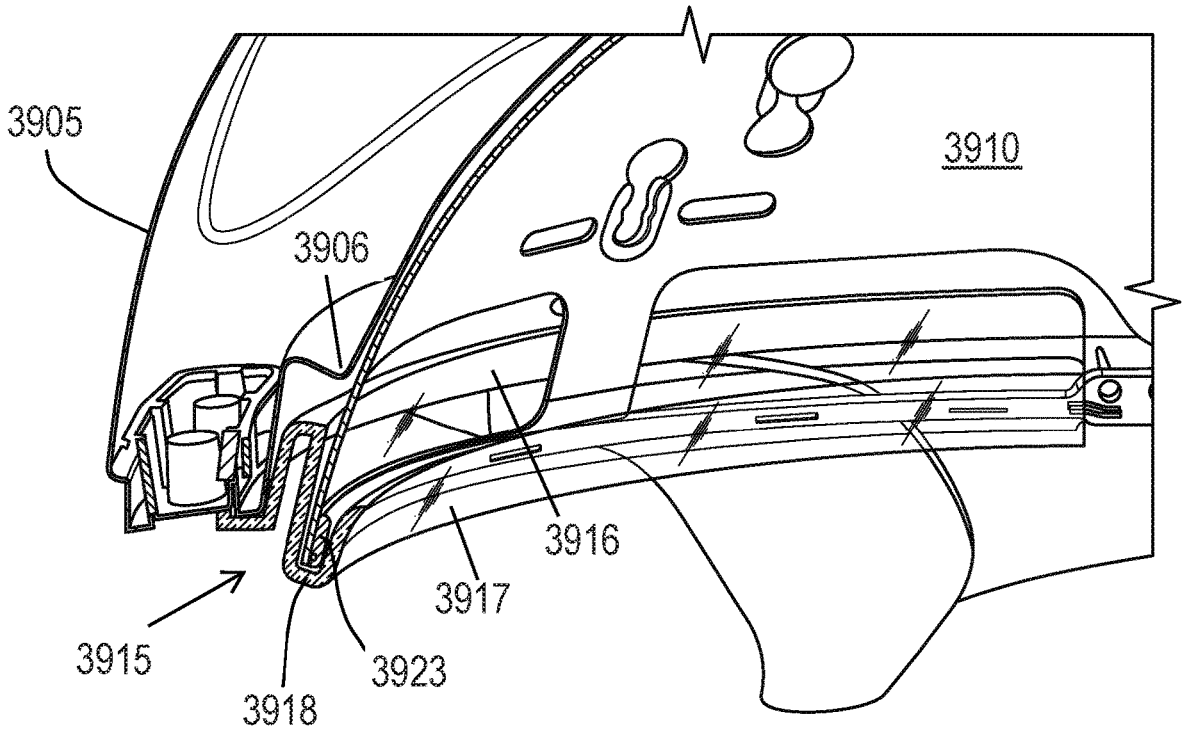

FIGS. 37A-38 illustrate mechanical modules that can be attached to helmets with modular components. FIGS. 37A-B illustrates interchangeable features that can be added to a helmet 3700*a*, 3700*b*. For example, an eyewear adapter module 3710*a* and a goggle strap rear guide module 3710*b* can be attached to the base portion 3705 to form the helmet 3700*a*. As another example, an eyewear adapter module 3710*c* and a goggle strap slot module 3710*d* can be added to the base portion 3705 to form helmet 3700*b*. In certain implementations, the goggle strap slot module 3710*d* can be hinged to allow rotation between one or more positions, snapped onto the base portion 3705, and/or can be configured to break away under suitable pressure. Other modules can include air venting modules 3710*e*, where the air venting modules 3710*e* are interchangeable to accommodate different conditions. Other ornamental or functional elements can also be added to the modular helmet such as, for example and without limitation, ear pads, vents, rear portions, eyewear attachment points or anchors, camera mounts, lights, or the like.

FIG. 38 illustrates additional examples of modular components that can be added to a modular helmet 3800. For example, foam supports 3810 can be added and/or removed from a helmet 3800. A rear portion 3820*a* and/or side portion 3820*b* can be added to the helmet 3800 and made to pivot on the helmet 3800 to provide a variety of venting options. Different ear pieces 3830*a-c* can be added and/or removed. In some embodiments, the ear piece 3830*b* can cover a front portion of the helmet 3800 to provide aerodynamic benefits, venting benefits, and/or aesthetic qualities. A strap guide or clip 3840 can be added using a modular approach, as well. In addition, different layers can be added or removed, such as a shock layer 3850.

Sports Helmet with Internal Gutter

FIGS. 39A-D illustrate a helmet 3900 having an internal gutter 3915 for capturing and directing sweat or water or any other liquids away from a face of a wearer. The helmet 3900 includes an outer shell 3905 and an inner layer 3910, which may include a low friction layer (e.g., a MIPS™ layer). The internal gutter 3915 is configured to form an inwardly curved shape with a descending or sloped wall and a catch region where one or more liquids can be channeled, directed, and/or captured. For example, as illustrated, some embodiments of the internal gutter 3915 can comprise a J shape in cross section with a first predominantly or generally vertical side 3916 in contact or adjacent to the inner layer 3910, and a second predominantly or generally vertical leg 3917 configured to be in contact with or adjacent to the wearer's head with a channel 3918 between the first leg 3916 and the second leg 3917. In some embodiments, as illustrated, the first leg 3916 can be longer than the second leg 3917.

The helmet 3900 can include a fit system comprising a mechanical reel 3922 that changes the length of a lace 3921. Any suitable fit system may be used including a reel and lace system, a ratchet system, a non-cable system that uses flexible pieces to tighten an internal headband, and the like. Examples of reel-based closure systems are provided in U.S. Pat. No. 7,954,204, entitled "Reel Based Closure System," issued Jun. 7, 2011, the entire contents of which are incorporated herein by reference for all purposes. The lace 3921 includes a portion 3923 that lies within the channel 3918 of the internal gutter 3915. When the mechanical reel 3922 cinches the lace 3921, it applies an inward force that causes the shorter or inner leg 3917 of the internal gutter 3915 to remain in contact with the head of the wearer while also causing the channel of the internal gutter 3915 to remain open to receive and to direct liquid (e.g., sweat) away from the wearer's face. In some embodiments, the outer or first leg 3916 is attached to the inner layer 3910 and/or the shell 3905 so that when the force is applied on the second leg 3917, the channel remains open due at least in part to the first leg 3916 being attached to the helmet 3900. In some embodiments, the internal gutter 3915 is attached to the inner layer 3905. In some embodiments, the internal gutter is attached to a MIPS layer, if provided. For example, in some embodiments, the internal gutter 3915 can be configured to include flexible hooks 3914 extending from the first leg 3916 or other mechanical fasteners and the inner layer 3905 can be configured to include corresponding openings 3907 or corresponding engagement portions in the inner layer 3905, where the hooks 3914 can be inserted (not shown as inserted) through the openings 3907 to connect the internal gutter 3915 to the inner layer 3905. In some embodiments, the internal gutter 3915 can be attached to the portion 923 of the lace 921 using features 3919. In some embodiments, a periphery 3908 of the inner layer 3905 sits within the channel 3918 of the internal gutter 3915. This can aid in keeping the channel 3918 open. In certain embodiments, the internal gutter 3915 may be a modular feature that can be added and removed from a helmet system. In some embodiments, the internal gutter 3915 is integrated with the helmet 3900, the shell 3910, and/or the inner layer 3905.

The internal gutter 3915 can be made of any suitable material that is flexible and impermeable, such as silicone. The material can be configured to conform to a surface, such as a forehead of a wearer, and may create a seal against the forehead of the wearer. The internal gutter 3915 can be configured to direct the liquid to different parts of the wearer's head. For example, the internal gutter 3915 can direct liquid behind the ears of the wearer, in front of the ears, just behind the eyes of the wearer, or at the back of the head of the wearer.

The shell 3905 or inner layer 3910 can include one or more features that enhance sweat collection in the internal gutter 3915. For example, the shell 3905 and/or inner layer 3910 can include a jog 3906 above the internal gutter 3915. As liquid flows down the interior of the shell 3905 and/or inner layer 3910, it drops from the jog 3906 into the internal gutter 3915. Similarly, the inner layer 3910 can include features that facilitate sweat collection in the internal gutter 3915. For example, the inner layer can include openings 3911 that allow sweat to drip into the gutter and/or break out moisture in the helmet 3900 so that it collects in the internal gutter 3915.

In some embodiments, the internal gutter 3915 can be configured to allow movement between the shell 3905 and the inner layer 3910. The internal gutter 3915 can be configured to be spaced from the jog 3906 to allow the shell 3905 to move relative to the inner layer 3910 without impeding the movement up to the distance between the jog 3906 and the first leg 3916 of the internal gutter 3915.

Terminology

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without other input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Disjunctive language such as the phrase "at least one of X, Y, Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

While the above detailed description has shown, described, and pointed out novel features as applied to various embodiments, it can be understood that various omissions, substitutions, and changes in the form and details of the devices or algorithms illustrated can be made without departing from the spirit of the disclosure. Any structure, feature, step, or process disclosed herein in one embodiment can be used separately or combined with or used instead of any other structure, feature, step, or process disclosed in any other embodiment. Also, no structure, feature, step, or processes disclosed herein is essential or indispensable; any may be omitted in some embodiments. The scope of certain embodiments disclosed herein is indicated by the appended claims rather than by the foregoing description. All changes which come within the meaning and range of equivalency of the claims are to be embraced within their scope.

The following is claimed:

1. A modular helmet comprising:

a first eyewear adapter module that is releasably attachable to the modular helmet and configured to interface with a corresponding first eyewear in an orientation that permits a wearer of the modular helmet to see through the first eyewear, wherein the first eyewear adapter module comprises a first brim; and a second eyewear adapter module that is releasably attachable to the modular helmet and configured to interface with a corresponding second eyewear in an orientation that permits a wearer of the modular helmet to see through the second eyewear, wherein the second eyewear adapter module comprises a second brim, wherein the first eyewear and the second eyewear are not identical, wherein at least one of a contour, size, and shape of the second eyewear adapter module is different from a contour, size, and shape of the first eyewear adapter module, wherein the first eyewear adapter module and the second eyewear adapter module extend across a forehead portion of the modular helmet from a first side of the modular helmet to a second side of the modular helmet, wherein the first and second eyewear adapter modules are interchangeable and the modular helmet is configured to interface with one eyewear adapter module at a time, and wherein the first and second eyewear adapter modules are configured such that, in use, the first and second eyewear adapter modules enhance fit or function of the corresponding first or second eyewear to provide, in combination with the modular helmet and the first or second eyewear, one or any combination of more than one functional advantage selected from the group consisting of:

improved air flow across or through portions of the modular helmet and the first or second eyewear via at least one vent;

improved aerodynamics of the modular helmet based on a contour of the first or second eyewear adapter module substantially matching a contour of the first or second eyewear;

improved sweat control provided by either the at least one venting port or an internal gutter of the modular helmet configured to direct liquid away from the face of the wearer; and improved fit provided by at least one of: the contour of the first or second eyewear adapter module substantially matching the contour of the first or second eyewear, or sliding the first or second eyewear adapter module relative to the modular helmet to reduce a gap between the first or second eyewear and the corresponding first or second eyewear adapter module.

2. The modular helmet of claim 1, wherein the first and second eyewear adapter modules releasably attach to a base portion of the modular helmet, the base portion comprising a shell and an inner layer coupled to the shell, the base portion configured to absorb or distribute force from an impact.

3. The modular helmet of claim 1, wherein at least one of the first or second eyewear modules is further configured to releasably attach to the corresponding first or second eyewear.

4. The modular helmet of claim 1, wherein the first or second eyewear adapter module is further configured to be adjustable to position the eyewear adapter relative to the modular helmet and the first or second eyewear to account for anatomical variations between different wearers.

5. The modular helmet of claim 1, wherein at least one of the first or second eyewear comprises goggles.

6. The modular helmet of claim 1, wherein at least one of the first or second eyewear adapter modules further comprises at least one electronic module.

7. The modular helmet of claim 1, wherein, in use, the first or second brim defines a contour, and wherein the first and second brim is configured to (a) direct air downward toward an inner surface of the first and second eyewear, when in use, based on the contour defined by the brim, (b) cover one or more openings on a front portion of the modular helmet, or (c) a combination of (a) and (b).

8. The modular helmet of claim 1, wherein, in use, the first or second brim is configured to extend outward beyond an outer surface of the first or second eyewear.

9. The modular helmet of claim 1, wherein, in use, the first or second brim is configured to cover one or more openings on a front portion of the modular helmet.

10. The modular helmet of claim 1, wherein the first or second eyewear adapter module is secured to the modular helmet to allow the secured eyewear adapter module to be adjusted by sliding the secured eyewear adapter module relative to a base portion of the modular helmet.

11. The modular helmet of claim 1, wherein the first or second eyewear adapter module is in contact with the corresponding first or second eyewear along the contour of an upper edge of the eyewear adapter module.

12. The modular helmet of claim 1, wherein the first or second eyewear adapter include additional venting ports configured to provide, in use, venting between the corresponding first or second eyewear and a base portion of the modular helmet.

13. The modular helmet of claim 1, wherein the first or second eyewear adapter module is being configured to be secured to a base portion of the modular helmet such that, in use, the contour of the first or second eyewear adapter module forms a gap of less than or equal to 1.25 cm (0.5 inches) from a top portion of the corresponding first or second eyewear.

14. An eyewear adapter comprising:

a first brim that is releasably attachable to a helmet and configured to interface with corresponding first eyewear in an orientation that permits a wearer of the helmet to see through the first eyewear, wherein a contour of the first brim is substantially similar to a contour of the first eyewear;

a second brim that is releasably attachable to a helmet and configured to interface with corresponding second eyewear in an orientation that permits the wearer of the helmet to see through the second eyewear, wherein the first eyewear and the second eyewear are not identical, wherein at least one of a contour, size, and shape of the second brim is different from the contour, size, and shape of the first brim, wherein the first brim and the second brim are interchangeable and the helmet is configured to interface with one brim at a time, wherein at least one of the first brim or the second brim is configured to extend outward beyond an outer surface of the first or second eyewear, wherein the eyewear adapter is configured such that, in use, the eyewear adapter enhances fit or function of the first or second eyewear to provide, in combination with the helmet and eyewear, improved aerodynamics of the helmet based on a contour of the eyewear adapter substantially matching the contour of the first eyewear, wherein the first or second brim is configured to be in contact with an upper edge of the corresponding first or second eyewear in an orientation that permits the wearer of the helmet to see through the eyewear.

15. The eyewear adapter of claim 14, wherein the first and second brims releasably attach to a base portion of the helmet, the base portion comprising a shell and an inner layer coupled to the shell, the base portion configured to absorb or distribute force from an impact.

16. The eyewear adapter of claim 14, wherein, in use, the first and second brims are configured to direct air downward toward an inner surface of the first and second eyewear.

17. The eyewear adapter of claim 14, wherein, in use, the first and second brims are configured to extend outward beyond an outer surface of the first and second eyewear.

18. The eyewear adapter of claim 14, wherein:

the helmet comprises a base portion configured to absorb or distribute force from an impact;

the eyewear adapter being further configured to be secured to the base portion of the helmet such that, in use, the contour of the eyewear adapter forms a gap of less than or equal to 0.5 inches from a top portion of the corresponding first and second eyewear.

19. A modular helmet comprising:

a first eyewear adapter module that is releasably attachable to the modular helmet and configured to interface with an upper edge of a corresponding first eyewear in an orientation that permits a wearer of the modular helmet to see through the first or second eyewear; and a second eyewear adapter module that is releasably attachable to the modular helmet and configured to interface with an upper edge of a corresponding second eyewear in an orientation that permits a wearer of the modular helmet to see through the second eyewear, wherein at least one of a contour, size, and shape of the second eyewear adapter module is different from a contour, size, and shape of the first eyewear adapter module, wherein the first and second eyewear adapter modules are interchangeable and the modular helmet is configured to interface with one eyewear adapter module at a time, wherein the first and second eyewear adapter modules are configured such that, in use, the first and second eyewear adapter modules enhance a fit or function of the corresponding first or second eyewear to provide, in combination with the modular helmet and the first or second eyewear, an improved air flow across or through at least a portion of the modular helmet and the first or second eyewear as compared to the use of the modular helmet and the first or second eyewear without the first or second eyewear adapter module, the first or second eyewear adapter module being configured to promote airflow around an inner surface of the first or second eyewear via at least one venting port.

20. The modular helmet of claim 19, wherein the first and second eyewear adapter modules include additional venting ports configured to provide, in use, venting between the corresponding first or second eyewear and a base portion of the helmet.

21. The modular helmet of claim 19, wherein the first or second eyewear adapter is in contact with the corresponding first or second eyewear along the contour of the eyewear adapter.

22. The modular helmet of claim 19, wherein the first or second eyewear adapter module is configured to be secured to a base portion of the helmet such that, in use, the contour of the first or second eyewear adapter module forms a gap of less than or equal to 1.25 cm (0.5 inches) from a top portion of the corresponding first or second eyewear.

23. The modular helmet of claim 19, wherein at least one of the first or second eyewear adapter modules comprises a corresponding first or second brim.

24. The modular helmet of claim 23, wherein, in use, the first or second brim defines a contour, and wherein the first and second brim is configured to (a) direct air downward toward an inner surface of the first and second eyewear, when in use, based on the contour defined by the brim, (b) cover one or more openings on a front portion of the modular helmet, or (c) a combination of (a) and (b).

25. The eyewear adapter of claim 14, wherein the eyewear adapter is configured to attach the helmet to the first and second eyewear, and the first and second brim is further configured to attach to the corresponding first and second eyewear in the orientation that permits the wearer of the helmet to see through the first and second eyewear.

26. The modular helmet of claim 1, wherein the first eyewear is a first goggle.

27. The modular helmet of claim 26, wherein the second eyewear is selected from the group consisting of a second goggle, sunglasses, eyeglasses, a visor, and a face shield, and wherein at least one of the contour, size, and shape of the second eyewear is different from the contour, size, and shape of the first eyewear.

28. The eyewear adapter of claim 14, wherein the contour of the second brim is substantially similar to a contour of the second eyewear.

* * * * *